US005376509A

United States Patent [19]

Yoshimoto et al.

[11] Patent Number: 5,376,509

[45] Date of Patent: Dec. 27, 1994

[54] SOLID PROCESSING COMPOSITIONS FOR LIGHT-SENSITIVE SILVER HALIDE PHOTOGRAPHIC MATERIALS

[75] Inventors: Hiroshi Yoshimoto; Shoji Nishio; Hideki Komatsu; Satomi Kawasaki, all of Hino, Japan

[73] Assignee: Konica Corporation, Japan

[21] Appl. No.: 982,400

[22] Filed: Nov. 27, 1992

[30] Foreign Application Priority Data

Nov. 27, 1991 [JP] Japan ..... 3-312527
Feb. 14, 1992 [JP] Japan ..... 4-028181

[51] Int. Cl.[5] ..... G03C 5/18; G03C 5/26

[52] U.S. Cl. ..... 430/449; 430/444; 430/465; 430/484; 430/487; 430/489

[58] Field of Search ..... 430/403, 404, 444, 449, 430/465, 484, 487, 489, 639

[56] References Cited

U.S. PATENT DOCUMENTS 935,156 9/1909 Kelly ..... 430/465
2,196,901 4/1940 Ham ..... 430/465
4,873,182 10/1989 Delprato et al. ..... 430/449
4,966,833 10/1990 Inoue ..... 430/378

FOREIGN PATENT DOCUMENTS 2286415 4/1976 France .
3506955 8/1985 Germany .
53-48735 5/1978 Japan .
63-276050 11/1988 Japan .
809 3/1983 WIPO .

OTHER PUBLICATIONS

U.S. Statutory Invention Registration H1020, Nishio et al., Feb. 1992.

Patent Abstracts of Japan, vol. 13, No. 93 (P-838); Mar. 6, 1989 JPA-63-276,050; Nov. 14, 1988.

Database WP1, Section P1, Weck 7824, Class P83, AN-78-42732A JPA-53-48,735; May 2, 1978.

*Primary Examiner*—Janet C. Baxter
*Assistant Examiner*—J. Pasterczyk
*Attorney, Agent, or Firm*—Jordan B. Bierman

[57] ABSTRACT

A processing chemical for light-sensitive silver halide photographic material, comprising a cyclodextrin compound, which can contribute a decrease in packaging materials, transportation cost and storage space, can be free from lateral cracking at the formation of tablets, and can bring about an improvement in storage stability after being formed into processing solutions (i.e., more free from occurrence of stain during developing and scratches in light-sensitive materials having been processed, caused by deposition of crystals).

8 Claims, No Drawings

SOLID PROCESSING COMPOSITIONS FOR LIGHT-SENSITIVE SILVER HALIDE PHOTOGRAPHIC MATERIALS

FIELD OF THE INVENTION

The present invention relates to solid processing compositions for light-sensitive silver halide photographic materials. More particularly, it relates to solid processing compositions for light-sensitive silver halide photographic materials, improved in suitability to the social environment, suitability to work environment, anti-laminating at tableting ("laminating" means lateral cracking), storage stability (i.e., being free from occurrence of stain at development and scratches in light-sensitive materials after processing) and dissolving performance.

BACKGROUND OF THE INVENTION

Light-sensitive silver halide photographic materials are usually photographically processed using processing solutions such as a black and white developing solution, a fixing solution, e color developing solution, a bleaching solution, a bleach-fixing solution and a stabilizing solution to give an imagewise reproduction. The respective processing solutions used here are each put into a plastic bottle or bottles in the form of a single or plural parts of liquid concentrates, and supplied to users as processing chemical kits. When used, users dilute these processing chemical kits with water to prepare service solutions (starting solutions or replenishing solutions).

In recent years, in the photographic processing business, there is a rapid increase in small-scale photofinishing laboratories called mini-labs. With a wide spread of such mini-labs, the quantity of use of processing chemical kit plastic bottles is rapidly increasing year by year.

Plastics used therefor are also widely used for articles other than photographic processing chemical kit bottles because of their light and tough properties. The production of plastics throughout the world is steadily increasing year by year, and has increased to an amount more than one hundred million in metric tons the year 1988. On the other band, waste plastic materials are also in an enormous amount. Taking an example in Japan, about 40% of the whole production is disposed of every year. Such waste plastic materials, when thrown away in the ocean, cause pollution of the environment for orceanic life. In the area of Europe, waste plastic materials are burned in incinerators having imperfect exhaust-gas disposal equipment to cause the problem of acid rain or the like, which has become an important subject of discussion.

For this reason, prompt countermeasures are earnestly sought to be taken. Under existing circumstances, it is active in Europe and America to recycle waste plastic materials or prohibit their dumping, or legally obligate to use degradable plastics.

Under such circumstances, it is very unpreferable to use plastic bottles in a large quantity for photographic processing chemicals even if their use is a part of the whole.

Now, one may contemplate to form liquid concentrates into powdered chemicals. In such an instance, there is a high possibility that fine powder rises or flies up when the powdered chemicals are dissolved in water and operators breathe the powder. This may bring about the problem of a possible influence on health, or the problem that any components of the processing chemicals that have flown about mix into other photographic processing solutions to contaminate them to cause troubles. On account of such problems, for example, Japanese Patent Publication Open to Public Inspections (hereinafter "Japanese Patent O.P.I. Publication(s)") No. 109042/1990 and No. 109043/1990, U.S. Pat. No. 2,843,484, Japanese Patent O.P.I. Publication No. 39735/1991 have proposed techniques in which photographic processing chemicals are formed into granules to give a granular mixture. However, there still remain the problem on labor safety and sanitation, caused by dust of flying chemicals, and the problems of difficulties in preparation operability such that the flying chemicals mix into other photographic processing solutions as impurities, caking may occur which is a phenomenon in which processing chemicals settle down to the bottom of a container and coagulate there when dissolved, and the powder may be covered with its own wet films to cause a poor dissolution. Thus, under existing circumstances, the scope of chemicals suited for being formed into powder of granules is very limited.

Now, it is proposed in Japanese Patent O.P.I. Publication No. 61837/1976 to form processing chemicals into tablets as a form preferable for processing chemicals making the most of the advantages attainable when they are in a dried state.

However, laminating at tableting (cracking of a tablet in the lateral direction) has occurred when the photographic processing chemicals are formed into granules, so that they cannot be well formed into tablets, bringing about a problem. Polyethylene glycol commonly used as a binder for tablets of medical use is an undesirable binder since, when used in developers, it adversely affects photographic performance and becomes inactive. Now, it is desired to newly provide a binder that does not affect photographic performances.

Besides, in the case of the liquid concentrate types, incorporation of an acid, an alkali or a pH adjuster which are components of processing chemicals may bring about additional problems such that the processing chemical components contained in liquid concentrates cause a chemical reaction to form a precipitate, they can not be added in a large quantity because of restriction in solubility, and, if a liquid solvent is added, various organic compound components contained may dissolve to undergo oxidation deterioration, resulting in decomposition of the components. As for the solid types such as powder, granules and tablets, they have difficulty in dissolving performance as previously stated, which is caused by a slightly water-soluble organic compound incorporated as a component of processing chemicals. Hence, it becomes often impossible to add the slightly water-soluble organic compound that is a processing chemical component important for photographic performance. Thus, it has been sought to establish a technique for incorporating such a slightly water-soluble organic compound into the solid type processing chemicals.

SUMMARY OF THE INVENTION

The present inventors have discovered that a cyclodextrin compound does not adversely affect the photographic performances and is a preferable binder, and thus have accomplished the present invention. It has been unexpected from any conventional knowledge that as another effect the compound can improve the rate of dissolution or dissolving speed of solid processing chemicals and the stability of solutions formed. Moreover, when the slightly water-soluble organic compound is used together with the cyclodextrin compound, the solubility becomes extraordinarily higher. In addition, this cyclodextrin compound enables solidification of liquid compounds, and is a compound very advantageous for preparing solid processing chemicals.

Accordingly, an object of the present invention is provide a solid processing chemical for light-sensitive silver halide photographic materials, having the following characteristic features.

(1) The processing compositions can decrease use of packaging materials, in particular plastic bottles, and have a suitability to social environment.

(2) The processing compositions have been made light-weight because of the solid form, promise reduction of transportation cost, and require no wide space for keeping them in photofinishing laboratories.

(3) They have been improved in storage stability, and can be free from occurrence of stain at development and scratches in light-sensitive materials having been processed.

(4) They can be free from flying up of fine powder of solid photographic processing chemicals, and have a suitability to work environment.

(5) The dissolving performance of solid processing compositions can be improved.

The present invention that can achieve the above object of the invention is constituted as follows:

1. A processing composition for light-sensitive silver halide photographic material, comprising a cyclodextrin compound.
2. The processing composition for light-sensitive silver halide photographic material as described in paragraph 1, wherein said cyclodextrin compound is selected from the group consisting of cyclodextrin, a cyclodextrin derivative, a branched cyclodextrin and a cyclodextrin polymer.
3. The processing composition for light-sensitive silver halide photographic material as described in paragraph 1 or 2, wherein said solid processing composition is in the form of a tablet.
4. The processing composition for light-sensitive silver halide photographic material as described in paragraph 1, 2 or 3, further comprising a compound represented by the following Formula I.

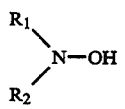

Formula I wherein $R_1$ and $R_2$ each represent a substituted or unsubstituted alkyl group, a substituted or unsubstituted aryl group, $R_3$—C(=O)— or a hydrogen atom, provided that $R_1$ and $R_2$ are not hydrogen atoms at the same time, or may combine with each other to form a ring. $R_3$ represents a substituted or unsubstituted alkoxy group, a substituted or unsubstituted alkyl group or a substituted or unsubstituted aryl group.

DETAILED DESCRIPTION OF THE INVENTION

The cyclodextrin compound used in the present invention will be first described below.

In the present invention, the cyclodextrin compound is meant to be cyclodextrin, a cyclodextrin derivative, a branched cyclodextrin or a cyclodextrin polymer.

The cyclodextrin is represented by the following Formula II.

Formula II

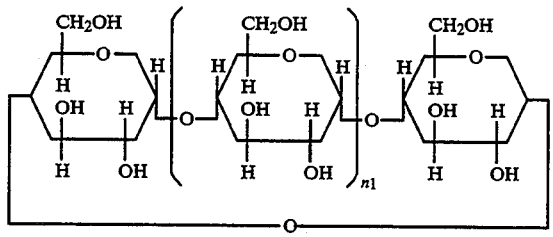

wherein $n_1$ represents a positive integer of 4 to 10.

Of the above, compounds particularly useful in the present invention are $n_1=4$ α-cyclodextrin, $n_1=5$ β-cyclodextrin and $n_1=6$ γ-cyclodextrin.

The cyclodextrin moiety has an inclusion action to form a clathrate compound or inclusion compound. In the present invention, such an inclusion compound can also be used. As described, for example, in F. Cramer, Einschlus Verbindungen, Springer (1954) or M. Hagen, Clathrate Inclusion Compounds, Reinhold (1962), the inclusion compound of cyclodextrin refers to "a substance in which cavities with appropriate size are present in the interior of a three-dimensional structure formed by combination of atoms or molecules and other atoms or molecules are locked within it in a given compositional ratio to form a specific crystalline structure."

Reference publications describing preparation examples for the inclusion compound of cyclodextrin are shown below. These are mere examples, and examples are by no means limited to these.

Journal of the American Chemical Society, Vol. 71, p.354, 1949.

Chemische Berichte, Vol. 90, p.2572, 1957.

Ditto, Vol. 90, p.2561, 1957.

The cyclodextrin derivative mentioned above will be described below.

The cyclodextrin derivative used in the present invention may include known derivatives obtained by replacing the hydroxyl groups of the cyclodextrin represented by Formula II, by ether groups, ester groups or amino groups. These cyclodextrins are described in detail in M. L. Bender and M. Komiyama, Cyclodextrin Chemistry, Springe-Lerlag Co., 1978.

The cyclodextrin derivative used in the present invention may also include a compound represented by Formula III or IV.

Formula III

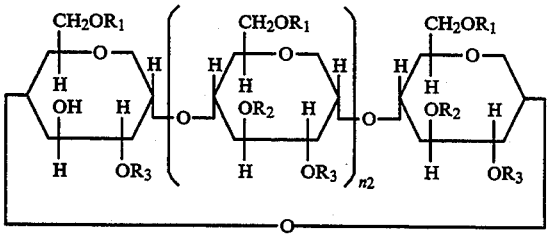

wherein $n_2$ represents a positive integer of 4 to 10.

In Formula III, $R_1$ to $R_3$ may be the same or different, and each represent a hydrogen atom, an alkyl group or a substituted alkyl group. Particularly preferred is a compound wherein $R_1$ and $R_3$ are alkylated.

Examples of this compound can be heptakis-2,6-dimethyl-β-cyclodextrin, hexakis-2,6-dimethyl-α-cyclodextrin and octakis-2,6-dimethyl-α-cyclodextrin.

Formula IV ti CD—(O—R)$_l$

In Formula IV, R represents a hydrogen atom, —$R^2$-$CO_2H$, —$R^2SO_3H$, —$R^2NH_2$ or $(R^3)_2N$—, where $R^2$ represents a straight-chain or branched alkylene group having 1 to 5 carbon atoms, $R^3$ represents a straight-chain or branched alkyl group having 1 to 5 carbon atoms, and l represents an integer of 1 to 5. CD represents cyclodextrin.

Examples of the compound represented by Formula IV are shown below. Examples are by no means limited to these.

| Exemplary Compound No. | R | l |
|---|---|---|
| m-1 | —$CH_2COOH$ | 3 |
| m-2 | —$CH_2COOH$ | 5 |
| m-3 | —$(CH_2)_4SO_3H$ | 1 |
| m-4 | —$(CH_2)_4SO_3H$ | 3 |
| m-5 | —$N(C_2H_5)_2$ | 2 |

The branched cyclodextrin used in the present invention will be described below.

The branched cyclodextrin used in the present invention refers to a compound comprised of a known cyclodextrin to which a water-soluble substance such as a monosaccharide or disaccharide as exemplified by glucose, maltose, cellobiose, lactose, sucrose, galactose or glucosammine has been branchingly added or linked, and may preferably include maltosylcyclodextrin comprised of cyclodextrin to which maltose has been linked (the number of linking molecules of maltose may be 1, 2 or 3, whichever is available), and glucosylcyclodextrin, comprised of cyclodextrin to which glucose has been linked (the number of linking molecules of glucose may be 1, 2 or 3, whichever is available).

These branched cyclodextrins can be synthesized specifically by the known synthesis method as described, for example, in DENPUN KAGAKU (Starch Chemistry), Vol. 30, No. 2, pp.231-239 (1983). For example, the maltosylcyclodextrin can be produced by a method in which cyclodextrin and maltose are used as starting materials and the maltose is linked to cyclodextrin by utilizing an enzyme such as isoamilase or pullulanase. The glucosylcyclodextrin can also be produced by a similar method.

In the present invention, preferably usable branched cyclodextrin may include the following specific exemplary compounds.

Exemplary Compounds

D-1 α-Cyclodextrin to which one molecule of maltose has been linked.

D-2 β-Cyclodextrin to which one molecule of maltose has been linked.

D-3 γ-Cyclodextrin to which one molecule of maltose has been linked.

D-4 α-Cyclodextrin to which two molecules of maltose have been linked.

D-5 β-Cyclodextrin to which two molecules of maltose have been linked.

D-6 γ-Cyclodextrin to which two molecules of maltose have been linked.

D-7 α-Cyclodextrin to which three molecules of maltose have been linked.

D-8 β-Cyclodextrin to which three molecules of maltose have been linked.

D-9 γ-Cyclodextrin to which three molecules of maltose have been linked.

D-10 α-Cyclodextrin to which one molecule of glucose has been linked.

D-11 β-Cyclodextrin to which one molecule of glucose has been linked.

D-12 γ-Cyclodextrin to which one molecule of glucose has been linked.

D-13 α-Cyclodextrin to which two molecules of glucose have been linked.

D-14 β-Cyclodextrin to which two molecules of glucose have been linked.

D-15 γ-Cyclodextrin to which two molecules of glucose have been linked.

D-16 α-Cyclodextrin to which three molecules of glucose have been linked.

D-17 β-Cyclodextrin to which three molecules of glucose have been linked.

D-18 γ-Cyclodextrin to which three molecules of glucose have been linked.

Structures of these branched cyclodextrins have been variously studied by measuring methods such as HPLC, NMR, TLC (thin-layer chromatography) and INEPT (insensitive nuclei enhanced by polarization transfer). However, none have been definitely determined; nonetheless, the above measuring methods have made it sure that each monosaccharide or disaccharide is linked to cyclodextrin. For this reason, in the present invention, the instance where polymolecules of a monosaccharide or disaccharide are linked to cyclodextrin includes both an instance in which they are individually linked to each glucose of cyclodextrin and an instance in which they are linked to one glucose in a linear fashion, as shown in the following drawings.

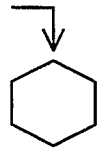

(Linearly linked)

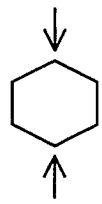

(Individually linked)

-continued

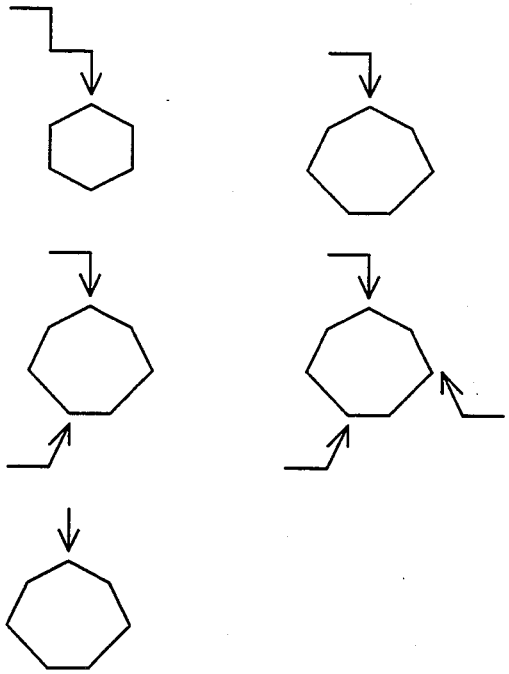

—: α-1,4 linkage

⟶: α-1,6 linkage

Since the ring structure of the existing cyclodextrin is retained as it is, these compounds are characterized in that they have the same inclusion action as the existing cyclodextrin and are dramatically improved in their solubility in water because of the addition of the highly water-soluble maltose or glucose.

The branched cyclodextrin used in the present invention are also commercially available. For example, the maltosylcyclodextrin is on the market as ISOELITE (trademark), produced by Ensuiko Sugar Refining Co., Ltd.

The cyclodextrin polymer used in the present invention will be described below.

The cyclodextrin polymer used in the present invention may preferably be a polymer represented by the following Formula V.

Formula V

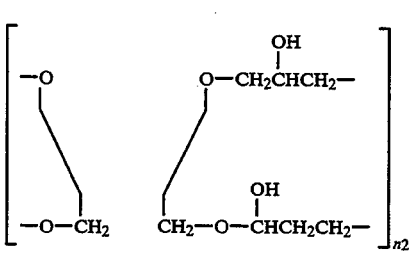

The cyclodextrin polymer used in the present invention can be produced, for example, by cross-linkingly polymerizing the cyclodextrin with epichlorohydrin.

The cyclodextrin polymer may preferably have a water-solubility, i.e., a solubility in water, of not less than 20 g per 100 ml of water at 25° C. For this end, the degree of polymerization $n_2$ in Formula V shown above may be controlled to be 3 or 4. The smaller this value is, the higher the water-solubility of the cyclodextrin polymer itself and the solubilization effect of the above substance.

These cyclodextrin polymers can be synthesized by the commonly available methods as disclosed, for example, in Japanese Patent O.P.I. Publication No. 97025/1986 and German Patent No. 3,544,842.

With regard to the cyclodextrin polymer, it also may be used in the form of an inclusion compound of the cyclodextrin, as previously stated.

Among these cyclodextrin groups, the most preferable group is a branched cyclodextrin group.

The compound represented by Formula I according to the present invention will be described below in detail.

In the compound of Formula I, the substituted or unsubstituted alkyl group represented by $R_1$ and $R_2$ may be straight-chain or branched. $R_1$ and $R_2$ may be the same or different, and may each preferably be an alkyl group having 1 to 10 carbon atoms, and more preferably 1 to 5 carbon atoms, as exemplified by a methyl group, an ethyl group, a propyl group, an isopropyl group, a methoxyethyl group, a hydroxyethyl group, a propenyl group, a t-butyl group, a hexyl group or a benzyl group. The substituent for the alkyl group may preferably include a halogen atom as exemplified by a chlorine atom or a bromine atom, an aryl group as exemplified by a phenyl group, a hydroxyl group, a carboxyl group, a sulfo group, a phosphono group, a phosphamic acid residual group, a cyano group, and an alkoxy group as exemplified by a methoxy group or an ethoxy group, or an amino group, an ammonio group, a carbonamido group, a sulfonamido group, a carbamoyl group, a sulfamoyl group, a sulfonyl group, an oxycarbonyl group and a carbonyloxy group each of which may be substituted with an alkyl group and/or an aryl group.

The substituted or unsubstituted aryl group represented by $R_1$ and $R_2$ may include, for example, a phenyl group, an o-methoxyphenyl group and a m-chlorophenyl group. The substituent for the aryl group may preferably include the same groups as in the case of the alkyl group described above.

$R_1$ and $R_2$ may combine with each other to form a ring, and, for example, may form a heterocyclic ring such as piperidine, pyridine, triazine or morpholine.

$R_3$ represents an alkoxyl group, an alkyl group or an aryl group. More particularly, of these alkoxyl group, alkyl group and aryl group, the alkyl group may preferably include those as defined for $R_1$ and $R_2$.

Specific examples of the hydroxylamine compound represented by Formula I are disclosed in U.S. Pat. No. 3,287,125, No. 3,329,034 and No. 3,287,124. As particularly preferred specific exemplary compounds, it may include compounds A-1 to A-39 disclosed in Japanese Patent Application No. 203169/1990, pages 36–38 of its specification; compounds 1 to 53 disclosed in Japanese Patent O.P.I. Publication No. 33845/1991, pages 3–6 of its specification; compounds 1 to 52 disclosed in Japanese Patent O.P.I. Publication No. 63646/1991, pages 5–7 of its specification; and compounds 1 to 54, in particular, 1 and 7 disclosed in Japanese Patent O.P.I. Publication No. 184044/1991, pages 4–6 of its specification.

Particularly preferred specific exemplary compounds of the compound of Formula I are shown below.

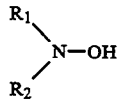

| Exemplary Compound No. | $R_1$ | $R_2$ |
|---|---|---|
| I-1 | $-C_2H_5$ | $-C_2H_5$ |
| I-2 | $-CH_3$ | $-CH_3$ |
| I-3 | $-C_3H_7$ | $-C_3H_7$ |
| I-4 | $-C_3H_7(i)$ | $-C_3H_7(i)$ |
| I-5 | $-CH_3$ | $-C_2H_5$ |
| I-6 | $-C_2H_5$ | $-C_3H_7(i)$ |
| I-7 | $-CH_3$ | $-C_3H_7(i)$ |
| I-8 | $-H$ | $-C_2H_5$ |
| I-9 | $-H$ | $-C_3H_7$ |
| I-10 | $-H$ | $-CH_3$ |
| I-11 | $-H$ | $-C_3H_7(i)$ |
| I-12 | $-C_2H_5$ | $-C_2H_4OCH_3$ |
| I-13 | $-C_2H_4OH$ | $-C_2H_4OH$ |
| I-14 | $-C_2H_4SO_3H$ | $-C_2H_5$ |
| I-15 | $-C_2H_4COOH$ | $-C_2H_4COOH$ |
| I-16 | $-CH_2COOH$ | $-CH_2COOH$ |
| I-17 | $-CH(C_2H_5)COOH$ | $-CH(C_2H_5)COOH$ |
| I-18 | $-CH_2CH_2SO_3H$ | $-CH_2CH_2SO_3H$ |
| I-19 | $-CH_2CH_2PO_3H_2$ | $-CH_2CH_2PO_3H_2$ |
| I-20 | $-CH_2CH_2\overset{+}{N}(CH_3)_3$ | $-CH_2CH_2\overset{+}{N}(CH_3)_3SO_4^{2-}$ |
| I-21 | $-CH_3$ | $-C_2H_4OCH_3$ |
| I-22 | $-C_2H_4OCH_3$ | $-C_2H_4OCH_3$ |
| I-23 | $-C_2H_4OC_2H_5$ | $-C_2H_4OC_2H_5$ |
| I-24 | $-C_3H_6OCH_3$ | $-C_3H_6OCH_3$ |
| I-25 | $-C_2H_5$ | $-C_2H_4OC_2H_5$ |
| I-26 | $-C_3H_7$ | $-C_2H_4OCH_3$ |
| I-27 | $-CH_3$ | $-C_2H_4OC_2H_5$ |
| I-28 | $-CH_3$ | $-CH_2OCH_3$ |
| I-29 | $-C_2H_5$ | $-CH_2OC_2H_5$ |
| I-30 | $-CH_2OCH_3$ | $-C_2OCH_3$ |
| I-31 | $-C_2H_5$ | $-C_2H_4OC_3H_7$ |
| I-32 | $-C_3H_6OC_3H_7$ | $-C_3H_6OC_3H_7$ |

I-33

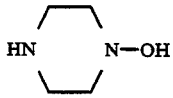

I-34

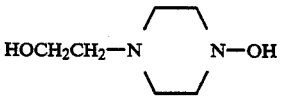

I-35

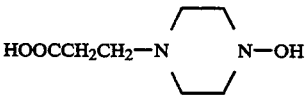

I-36

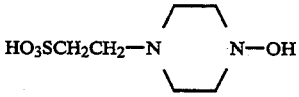

I-37

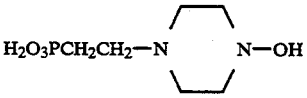

I-38

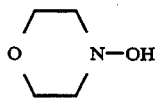

-continued

I-39

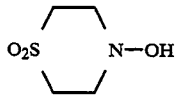

I-40

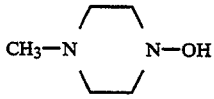

I-41

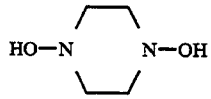

I-42

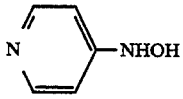

I-43

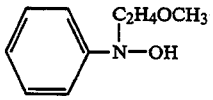

I-44

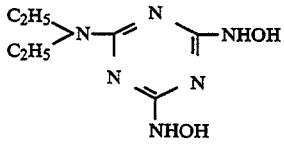

I-45 $CH_3CO-NHOH$

I-46

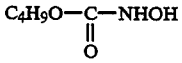

I-43

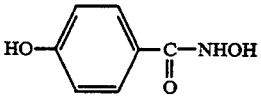

I-48

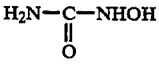

Together with the hydrazine compounds, a compound represented by the following Formula B can be incorporated as a preservative. This is effective for causing less stain after processing.

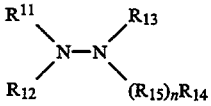

Formula B

In Formula B, $R^{11}$, $R_{12}$ and $R_{13}$ each represent a hydrogen atom, a substituted or unsubstituted alkyl group, aryl group or heterocyclic group; $R_{14}$ represents a hydroxyl group, a hydroxyamino group, a substituted or unsubstituted alkyl group, aryl group, heterocyclic group, alkoxyl group, aryloxy group, carbamoyl group or amino group. The heterocyclic group may be of 5 or 6 members, may be formed of C, H, O, N and a halogen atom, and may be substituted or unsubstituted. $R_{15}$ represents a divalent group selected from —CO—, $SO_2$— or —C(=NH)—, and n is 0 or 1. In particular, when n is 0, $R_{14}$ represents a group selected from an alkyl group, an aryl group and a heterocyclic group, and $R_{13}$ and $R_{14}$ may combine to form a heterocyclic group.

As examples of the compound represented by Formula B, there are compounds B-1 to B-33 disclosed in Japanese Patent Application No. 203169/1990, pages 40 to 43 of its specification; and compounds 1 to 56 disclosed in Japanese Patent O.P.I. Publication No. 33846/1991, pages 4 to 6 of its specification.

The compound represented by Formula B is used usually in the form of a free amine, a hydrochloride, a sulfate, a p-toluene sulfonate, an oxalate, a phosphate or an acetate. In the present invention, the compound may preferably be used so as to be in an amount ranging from 0.5 to 20 g, and more preferably from 3 to 10 g, per liter of developing solution.

In the present invention, when the compound represented by Formula I and the compound (a preservative) represented by Formula B described above are contained in solid color developing chemicals according to the present invention, not only the effect of the present invention can be more exhibited but also an effect of causing less fog occurring in non-image portions can be attained. Hence, this is one of preferred embodiments. Slightly soluble, as used herein, means that not more than 0.1 g of solute can be dissolved in 100 g of water at 25° C. water-soluble organic compound may include the compound represented by the following Formula VI, VII, VIII or S. A thioether compound represented by Formula S, which is an example, has an effect of accelerating development and is used in developers. It, however, is very slightly soluble in water and hence, under existing circumstances, can be added only in a very small amount.

Formula VI

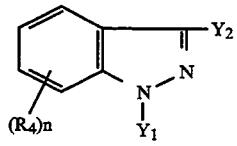

Formula VII

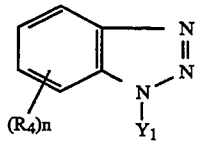

Formula VIII

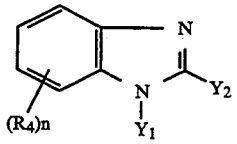

In Formulas VI to VIII, $Y_1$ represents a hydrogen atom, an alkali metal atom or a marcapto group; $R_4$ and $Y_2$ each represent a hydrogen atom, a halogen atom, a nitro group, an amino group, a cyano group, a hydroxyl group, a mercapto group, a sulfo group, a substituted or unsubstituted alkyl group, a substituted or unsubstituted alkenyl group, a substituted or unsubstituted alkynyl group, a substituted or unsubstituted alkoxy group, a hydroxycarbonyl group, an alkylcarbonyl group or an alkoxycarbonyl group; and n represents an integer of 1 to 4.

Typical examples of the compound represented by Formula VI are shown below. Examples are by no means limited to these.

VI-1 5-Nitroindazole
VI-2 6-Nitroindazole
VI-3 5-Sulfoindazole
VI-4 5-Cyanoindazole
VI-5 6-Cyanoindazole
VI-5 2-Mercaptoindazole Typical examples of the compound represented by Formula VII are shown below. Examples are by no means limited to these.

VII-1 Benzotriazole
VII-2 5-Methylbenzotriazole
VII-3 5-Chlorobenzotriazole
VII-4 5-Nitrobenzotriazole
VII-5 5-Ethylbenzotriazole
VII-6 5-Carboxybenzotriazole
VII-7 5-Hydroxybenzotriazole
VII-8 5-Aminobenzotriazole
VII-9 5-Sulfobenzotriazole
VII-10 5-Cyanobenzotriazole
VII-11 5-Methoxybenzotriazole
VII-12 5-Ethoxybenzotriazole
VII-13 5-Mercatobenzotriazole Typical examples of the compound represented by Formula VIII are shown below. Examples are by no means limited to these.

VIII-1 Benzimidazole
VIII-2 5-Sulfobenzimidazole
VIII-3 5-Methoxybenzimidazole
VIII-4 5-Chlorobenzimidazole
VIII-5 5-Nitrobenzimidazole
VIII-6 2-Mercapto-5-sulfobenzimidazole These compounds are compounds known as antifoggants in the photographic industrial field, and can be synthesized by known synthesis methods. Some of the compounds are commercially available as chemical reagents.

When any of the compounds represented by Formulas VI to VIII is added to developing chemicals, it may preferably be added so as to be in an amount of from 0.0001 to 2 g per liter of developing solution. Its addition in an amount smaller than the above may bring about no effect of preventing fog, and on the other hand its use in an amount larger than the above may cause a great decrease in sensitivity.

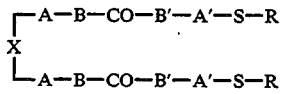

In Formula S, A represents a lower alkylene group having 1 to 3 carbon atoms, or a polyalkylene ether group which is a group represented by $-(CH_2CH_2O)_p-$, $-(CH_2CH_2O)_p-CH_2CH_2-$ or

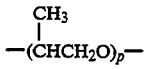

and does not combine with B through O, and A' represents a lower alkylene group having 1 to 3 carbon atoms, or a polyalkylene ether group represented by $-(CH_2CH_2O)_p-CH_2CH_2-$ or $$-(CH(CH_3)CH_2O)_p-CH(CH_3)CH_2-,$$

and does not combine with B through O; provided that A and A' are not polyalkylene ether groups at the same time. Letter symbol p represents an integer of 2 to 30.

B and B' each represents —NH— or —O—, provided that B and B' are not —O— at the same time.

R represents a lower alkyl group having 1 to 3 carbon atoms, a phenyl group, an aralkyl group or $-(CH_2)_q-COOR'$, wherein q represents an integer of 1 to 3.

R' represents a lower alkyl group having 1 to 3 carbon atoms.

X represents a divalent group selected from —S—, —O—, $-CH_2-$,

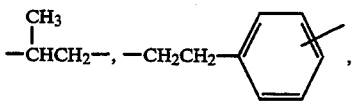

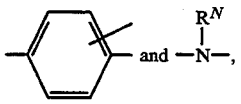

wherein $R^N$ represents a lower alkyl group having 1 to 3 carbon atoms.

Typical examples of the compound represented by Formula S are shown below. Examples are by no means limited to these.

Exemplary Compounds:

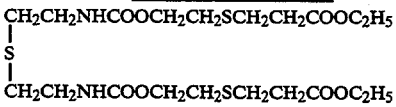

S-1

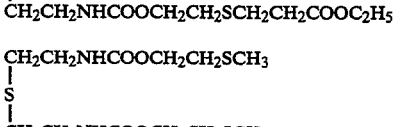

S-2

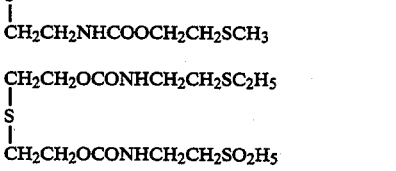

S-3

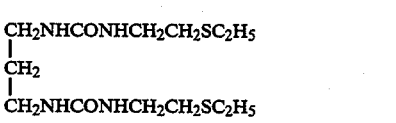

S-4

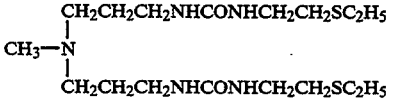

S-5

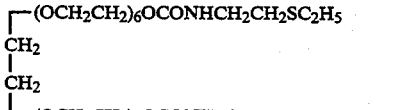

S-6

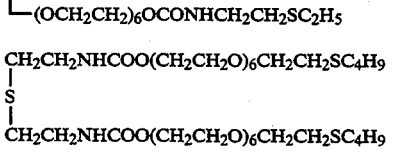

S-7

-continued

Exemplary Compounds:

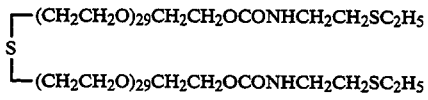

S-8

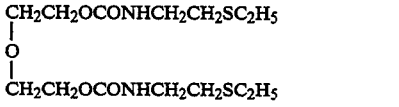

S-9

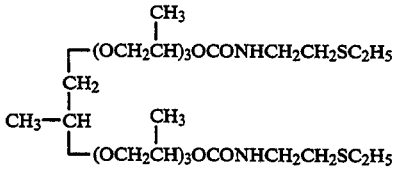

S-10

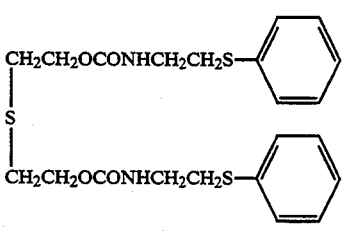

S-11

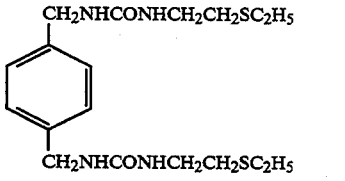

S-12

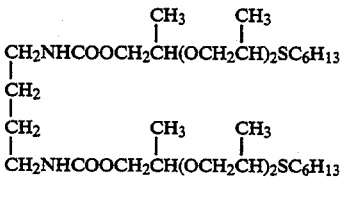

S-13

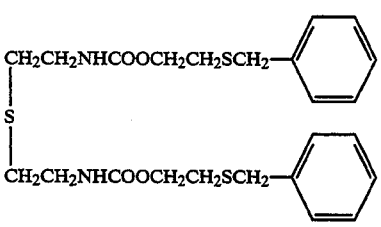

S-14

The addition of the cyclodextrin compound to the solid processing chemicals makes the slightly water-soluble organic compound readily soluble. When, however, speedy dissolving is required, the slightly water-soluble organic compound and the cyclodextrin compound may preferably be granulated together. A most preferable method is to use a powder in which the slightly water-soluble organic compound is enclosed or made clathrate within the cyclodextrin. There are no particular limitations in the amount in which the cyclodextrin compound is added. When dissolved for processing, the compound may preferably be used so as to be in an amount of from 0.1 to 100 g/l, and more preferably from 0.5 to 20 g/l, of the processing solution.

Examples, the following (1) and (2), of the method by which the slightly water-soluble organic compound is enclosed within the cyclodextrin compound are shown below. Examples are by no means limited to these.

(1) The slightly water-soluble organic compound is dissolved using a suitable solvent, and the resulting solution and an aqueous solution of the cyclodextrin compound are put together, followed by stirring to carry out mixing. When formed in one layer, the layer is spray-dried as it is, or when formed in two layers, only the aqueous layer is spray-dried so as to be powdered. Purification is carried out using a suitable solvent.

(2) In respect of a slightly water-soluble organic compound capable of being improved in solubility by changing the pH of an aqueous solution, the cyclodextrin compound is adjusted to the corresponding pH and then the slightly water-soluble organic compound is added, followed by stirring to effect dissolution, and the resulting solution is spray-dried so as to be powdered.

In the present invention, the solid photographic processing chemicals used may be in the form of tablets, granules, powder, a mass or a paste. They may preferably be in the form of tablets. Tableted processing chemicals (processing tablets) can be prepared by any usual methods as disclosed, for example, in Japanese Patent O.P.I. Publications No. 61837/1976, No. 155038/1979 and No. 88025/1977, and British Patent No. 1,213,808. Granulated processing chemicals can also be prepared by any usual methods as disclosed, for example, in Japanese Patent O.P.I. Publications No. 109042/1990, No. 109043/1990, No. 39735/1991 and No. 39739/1991. Powdered photographic processing chemicals can also be prepared by any usual methods as disclosed, for example, in Japanese Patent O.P.I. Publication No. 133332/1979, British Patents No. 725,829 and No. 729,862 and German Patent No. 37 33 861.

The solid photographic processing chemicals of the present invention may preferably have a bulk specific gravity of from 0.5 to 6.0 g/cm$^3$, and particularly preferably from 1.0 to 5.0 g/cm$^3$, in view of the effect as aimed in the present invention. Such processing chemicals can be preferably used.

The solid processing chemicals of the present invention may include color developing chemicals, black and white developing chemicals, bleaching chemicals, fixing chemicals, bleach-fixing chemicals and stabilizing chemicals. Those for which the present invention can be better effective are color developing chemicals and solid developing chemicals incorporated with the slightly water-soluble organic compound.

In the case when the processing chemicals in the present invention are color developing chemicals, the color developing agent used may comprise a p-phenylenediamine compound having a water-soluble group, which is preferably used since it can well bring about the effect as aimed in the present invention and also causes less fogging.

The p-phenylenediamine compound of the present invention is not only advantageous in that it causes no contamination of light-sensitive materials and does not tend to cause the skin to erupt even if it has adhered to the skin, but also effective for more efficiently achieving the objects of the present invention particularly when it is used in the color developing chemical kit according to the present invention.

As to such a water-soluble group, at least one group may be present on the amino group or benzene nucleus of the p-phenylenediamine compound. As specific water-soluble groups, the group may preferably include the following:

$-(CH_2)_n-CH_2OH$;

$-(CH_2)_m-NHSO_2-(CH_2)_n-CH_3$;

$-(CH_2)_m-O-(CH_2)_n-CH_3$;

$-(CH_2CH_2O)_nC_mH_{2m+1}$;

wherein m and n each represent an integer of 0 or more;

a —COOH group, and a $SO_3H$ group.

Specific exemplary compounds of the color developing agent used in the present invention may include compounds C-1 to C-16 disclosed in Japanese Patent Application No. 203169/1990, pages 26 to 31 its specification, and 4-amino-3-methyl-N-(3-hydroxypropyl)aniline.

The color developing agent is used usually in the form of a salt such as hydrochloride, sulfate or p-toluene sulfonate.

The color developing agent may also be used alone or in combination of two or more kinds. If necessary, it may also be used in combination with a black and white developing agent as exemplified by phenidone, 4-hydroxymethyl-4-methyl-1-phenyl-3-pyrazolidone, or methol.

In the color developing chemicals and black and white developing chemicals according to the present invention, a hydrosulfite as typified by those disclosed in Japanese Patent Application No. 122603/1991, page 12, line 15 ff. may be used in a small amount as a preservative.

In the color developing chemicals and black and white developing chemicals according to the present invention, a buffering agent may preferably be used. The buffering agent may include the compounds disclosed in Japanese Patent Application No. 122603/1991, page 12, line 18.

Development accelerators may include thioether compounds as disclosed in Japanese Patent Examined Publications No. 16088/1962, No. 5987/1962, No. 7826/1963, No. 12380/1969 and No. 9019/1970 and U.S. Pat. No. 3,813,247; p-phenylenediamine compounds as disclosed in Japanese Patent O.P.I. Publications No. 49829/1977 and No. 15554/1975; quaternary ammonium salts as disclosed in Japanese Patent Examined Publication No. 30074/1969, Japanese Patent O.P.I. Publications No. 137726/1975, No. 156826/1981 and No. 43429/1977; p-aminophenols as disclosed in U.S. Pat. No. 2,610,122 and No. 4,119,462; amine compounds as disclosed in U.S. Pat. No. 2,494,903, No. 3,128,182, No. 4,230,796 and No. 3,253,919 and Japanese Patent Examined Publication No. 11431/1966, U.S. Pat. No. 2,482,546, No. 2,596,926 and No. 3,582,346; polyalkylene oxides as disclosed in Japanese Patent Examined Publications No. 16088/1962 and No. 25201/1967, U.S. Pat. No. 3,128,183, Japanese Patent Examined Publications No. 11431/1966 and No. 23883/1967 and U.S. Pat. No. 3,532,501; as well as 1-phenyl-3-pyrazolidones, hydrazines, mesoionic compounds, ionic compounds, and imidazoles; any of which may be optionally added.

For the purpose of preventing fog, a chloride ion and a bromide ion may be used in the color developing chemicals. In the present invention, the chloride ion is contained preferably in an amount of from $1.0\times10^{-2}$ to $1.5\times10^{-1}$ mol/liter, and more preferably in an amount of from $3.5\times10^{-2}$ to $1\times10^{-1}$ mol/liter. A chloride ion concentration more than $1.5\times10^{-1}$ mol/liter may cause retardation of development, and is not preferable to rapidly obtain a high maximum density. On the other hand, a chloride ion concentration less than $1.0\times10^{-2}$ mol/liter is not preferable since it may cause stain and make large the variations of photographic performances, in particular, minimum density, which accompany continuous processing.

In the present invention, the color developing chemicals contains the bromide preferably so as to be in an amount of from $3.0\times10^{-3}$ to $1.0\times10^{-3}$ mol/liter, more preferably in an amount of from $5\times10^{-3}$ to $5\times10^{-4}$ mol/liter, and particularly preferably from $1\times10^{-4}$ to $3\times10^{-4}$ mol/liter. A bromide ion concentration more than $1\times10^{-3}$ mol/liter may cause retardation of development, resulting in a decrease in maximum density and sensitivity. On the other hand, a bromide ion concentration less than $3.0\times10^{-3}$ mol/liter is not preferable since it may cause stain and also make cause the variations of photographic performances, in particular, minimum density, which accompany continuous processing.

When chloride ions are directly added to the color developing chemicals, a chloride ion source may include sodium chloride, potassium chloride, ammonium chloride, nickel chloride, magnesium chloride, manganese chloride, calcium chloride and cadmium chloride. Of these, sodium chloride and potassium chloride are preferred.

Bromide ions may be fed in the form of counter salts of an optical brightening agent added in the color developing chemicals and black and white developing chemicals.

A bromide ion source may include sodium bromide, potassium bromide, ammonium bromide, lithium bromide, calcium bromide, magnesium bromide, manganese bromide, nickel bromide, cadmium bromide, cerium bromide and thallium bromide. Of these, sodium bromide and potassium bromide are preferred.

To the color developing chemicals and black and white developing chemicals of the present invention, an antifoggant may be optionally added in addition to the chloride ions and bromide ions. The antifoggant that can be used may include alkali metal halides such as potassium iodide, and an organic antifoggant. The organic antifoggant may include nitrogen-containing heterocyclic compounds as exemplified by benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolydine and adenine.

The color developing chemicals and black and white developing chemicals of the present invention may contain a triazinylstilbene optical brightening agent. This is preferable in view of the effect as aimed in the present invention. Such an optical brightening agent may preferably be a compound represent by the following Formula E.

Formula E

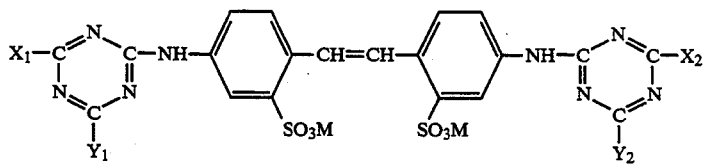

In the above formula, $X_1$, $X_2$, $Y_1$ and $Y_2$ each represent a hydroxyl group, a halogen atom such as chlorine or bromine, an alkyl group, an aryl group, a $-N(R_{21})R_{22}$ group,

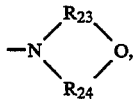

or $-OR_{25}$, wherein $R_{21}$ and $R_{22}$ each represent a hydrogen atom, an alkyl group (including substituted groups) or an aryl group (including substituted groups); $R_{23}$ and $R_{24}$ each represent an alkylene group (including substituted groups); and $R_{25}$ represents a hydrogen atom, an alkyl group (including substituted groups) or an aryl group (including substituted groups); and M represents a cation.

In detail, the groups or substituents thereof in Formula E have the same meaning as what are disclosed in Japanese Patent Application No. 240400/1990, page 63, line 8 from the bottom to page 64, line 3. Specific compounds thereof also may include E-1 to E-45 disclosed in the same application, pages 65–67.

The above compounds can be synthesized by known methods. Typical examples thereof are shown below. Among them, particularly preferably used are E-4, E-24, E-34, E-35, E-36, E-37 and E-41. Any of these compounds may preferably be added so as to be in an amount ranging from 0.2 g to 10 g, and more preferably from 0.4 g to 5 g, per 1,000 ml of color developing solution.

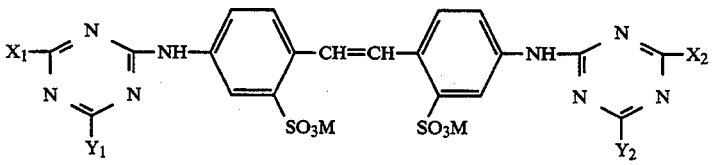

| Compound No. | M | $X_1$ | $Y_1$ | $Y_2$ | $X_2$ |
|---|---|---|---|---|---|
| E-2 | Na | $HOCH_2CH_2NH-$ | $-NHCH_2CH_2OH$ | $-NHCH_2CH_2OH$ | $-NHCH_2CH_2OH$ |
| E-4 | Na | $(HOCH_2CH_2)_2N-$ | $-OCH_3$ | $-OCH_3$ | $-N(CH_2CH_2OH)_2$ |

-continued

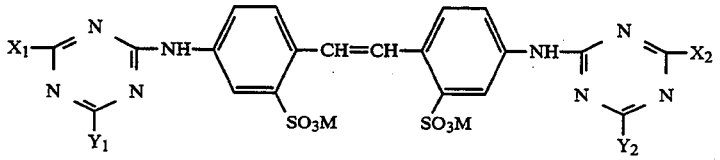

| Compound No. | M | $X_1$ | $Y_1$ | $Y_2$ | $X_2$ |
|---|---|---|---|---|---|
| E-7 | Na | 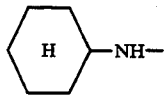 | $-NHCH_2CH_2OH$ | $-NHCH_2CH_2OH$ | 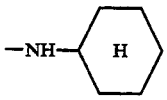 |
| E-10 | Na | $H_2N-$ | 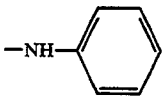 | 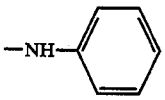 | $-NH_2$ |
| E-17 | Na | 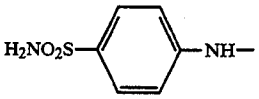 | $-N(CH_2CH_2OH)_2$ | $-N(CH_2CH_2OH)_2$ | 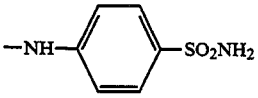 |
| E-24 | Na | 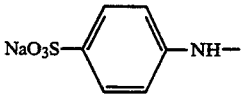 | 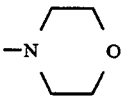 | 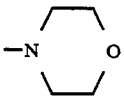 | 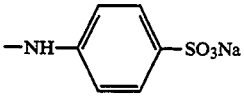 |
| E-34 | Na | $CH_3O-$ | $-NHCH_2CHCH_3$ (OH) | $-NHCH_2CHCH_3$ (OH) | $-OCH_3$ |
| E-35 | Na | 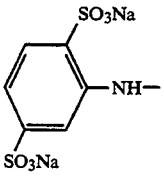 | 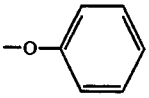 | 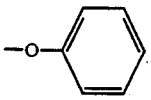 | 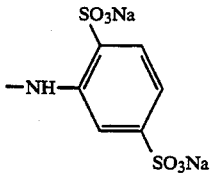 |
| E-36 | Na | 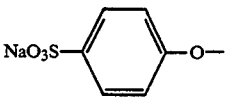 | $-N(CH_2CH_2OH)_2$ | $-N(CH_2CH_2OH)_2$ | 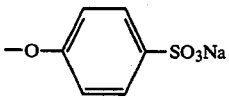 |
| E-37 | Na | 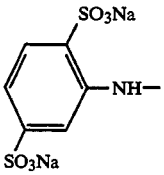 | $-N(C_2H_5)_2$ | $-N(C_2H_5)_2$ | 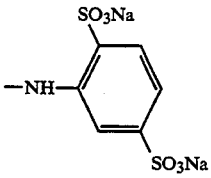 |
| E-40 | Na | $CH_3O-$ | $-N(CH_2CH_2OH)_2$ | $-N(CH_2CH_2OH)_2$ | $-OCH_3$ |
| E-41 | Na | $CH_3O-$ | $-NHCH_2CH_2SO_3Na$ | $-NHCH_2CH_2SO_3Na$ | $-OCH_3$ |
| E-42 | Na | $CH_3O-$ | $-NHCH_2CH_2OH$ | $-NHCH_2CH_2OH$ | $-OCH_3$ |
| E-43 | Na | $CH_3O-$ | 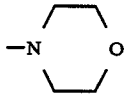 | 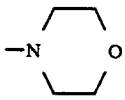 | $-OCH_3$ |
| E-44 | K | $CH_3O-$ | $-NHCH_2CH_2SO_3K$ | $-N(CH_2CH_2OH)_2$ | $-OCH_3$ |

The color developing chemicals and black and white developing chemicals used in the present invention may optionally contain methyl cellosolve, methanol, acetone, dimethylformamide, $\beta$-cyclodextrin or other compounds disclosed in Japanese Patent Examined Publications No. 33378/1972 and No. 9509/1969, which can be used as an organic solvent to improve solubility of the developing agent.

Together with the developing agent, an auxiliary developing agent may also be used. Such an auxiliary developing agent is known to include, for example, N-methyl-p-aminophenol hexasulfate (Methol), phenidone, N,N-diethyl-p-aminophenol hydrochloride and N,N,N',N'-tetramethyl-p-aminophenilenediamine hydrochloride. It may preferably be added so as to be in an amount of usually from 0.01 to 1.0 g/liter.

It is also possible to use various additives such as anti-stain agents, anti-sludge agents and interlayer effect accelerators.

To the color developing chemicals and black and white developing chemicals, the chelating agent represented by the following Formula K as disclosed in Japanese Patent Application No. 240400/1990, page 69, line 9 from the bottom to page 74, line 3 from the bottom, or any of its exemplary compounds K-1 to K-22, may preferably be added from the viewpoint of effective achievement of the objects of the present invention.

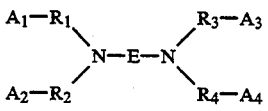

Formula K

Of these chelating agents, K-2, K-9, K-12, K-13, K-17 and K-19 may particularly preferably be used. In particular, the present invention can be well effective when K-2 or K-9 are added to the color developing chemicals.

Any of these chelating agents may preferably be added so as to be in an amount ranging from 0.1 to 20 g, and more preferably from 0.2 to 8 g, per 1,000 ml of a color developing solution or black and white developing solution.

The color developing chemicals and black and white developing chemicals may also contain a surface active agent of various types such as anionic, cationic, amphoteric or nonionic ones. If necessary, a surface active agent such as an alkylsulfonic acid, an aryl sulfonic acid, an aliphatic carboxylic acid or an aromatic carboxylic acid may also be added.

The black and white developing chemicals in the present invention contain a developing agent as described below. The black and white developing agent may include dihydroxybenzenes as exemplified by hdyroquinone, chlorohdyroquinone, bromohdyroquinone, isopropyldyroquinone, methyldyroquinone, 2,3-dichlorohdyroquinone, 2,5-dimethyldyroquinone, potassium hydroquinonemonosulfonate and sodium hydroquinonemonosulfonate, 3-pyrazolidones as exemplified by 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, 1-phenyl-4-methyl-4-hydroxymethyl-3-pyrazolidone and 1-phenyl-4,4-dihydroxymethyl-3-pyrazolidone, aminophenols as exemplified by o-aminophenol, p-aminophenol, N-methyl-o-aminophenol, N-methyl-p-aminophenol and 2,4-diaminophenol, and 1-aryl-3-aminopyrezolidones as exemplified by 1-(p-hydroxyphenyl)-3-aminopyrazolidone, 1-(p-methylaminophenyl)-3-aminopyrazolidone and 1-(p-amino-m-methylphenyl)-3-aminopyrazolidone, or a mixture of any of these.

The developing chemicals may besides optionally contain a preservative as exemplified by sulfurous acid or a bisulfite, a buffer as exemplified by a carbonate, boric acid, a borate or alkanolamine, an alkali agent as exemplified by a hydroxide or a carbonate, a dissolution aid as exemplified by a polyethylene glycol or an ester thereof, a pH adjuster as exemplified by an organic acid such as acetic acid, a sensitizer as exemplified by a quaternary ammonium salt, a development accelerator, a hardening agent as exemplified by a dialdehyde such as glutaldehyde, and a surface active agent. The developing chemicals may further contain an antifoggant as exemplified by a halide such as potassium bromide or sodium bromide, benzotriazole, benzothiazole, tetrazole or thiazole, a chelating agent as exemplified by ethylenediaminetetraacetic acid or an alkali metal salt, polyphosphate or nitrilotriacetate thereof, and the amino compound as disclosed in Japanese Patent O.P.I. Publication No. 106244/1981.

The black and white fixing chemicals in the present invention may preferably contain a thiosulfate. The thiosulfate is fed in the form of a solid, stated specifically, fed in the form of a lithium, potassium, sodium or ammonium salt, which are used by dissolution. In particular, it may preferably be fed in the form of a sodium or ammonium salt and be used by dissolution, so that a fixing solution with a rapid fixing speed can be obtained. The thiosulfate may preferably be in a concentration of from 0.1 to 5 mol/lit. (per liter of a solution to be used; the same applies hereinafter), more preferably in a concentration of from 0.5 to 5 mol/lit., and still more preferably in a concentration of from 0.7 to 1.8 mol/l.

The fixing chemicals contain a sulfite. Such a sulfite may be in a concentration of 0.2 mol/l or less, and preferably 0.1 mol/l, at the time the thiosulfate and a sulfite are mixed by being dissolved in an aqueous medium. The sulfite is used in the form of a solid lithium, potassium, sodium or ammonium salt, and is used by dissolving it together with the solid thiosulfate described above.

The fixing chemicals may preferably contain citric acid, isocitric acid, malic acid, tartaric acid, succinic acid or phenyl acetic acid, or a chemical isomer thereof.

Salts thereof may preferably include lithium, potassium, sodium or ammonium salts, as typified by potassium citrate, lithium citrate, sodium citrate, ammonium citrate, lithium hydrogentartrate, potassium hydrogentartrate, potassium tartrate, sodium hydrogentartrate, sodium tartrate, ammonium hydrogentartrate, ammonium potassium tartrate, sodium potassium tartrate, sodium maleate, ammonium maleate, sodium succinate and ammonium succinate, among which one kind or two or more kinds may be used in combination.

Of the above compounds, more preferred ones are citric acid, isocitric acid, malic acid, phenyl acetic acid and salts of these.

The above citric acid, tartaric acid, malic acid, succinic acid or the like is fed in the form of a solid, and is used by being dissolved in an aqueous medium. In a fixing solution formed after dissolution, the compound may preferably be in a content of not less than 0.05 mol/l, and most preferably in a content of from 0.2 to 0.6 mol/l.

In addition to the compound described above, the fixing chemicals may contain additives such as a variety of acids, salts, a thelate agent, a surface active agent, a wetting agent and a fixing accelerator. The acids may include inorganic acids as exemplified by sulfuric acid, hydrochloric acid, nitric acid and boric acid, and organic acids as exemplified by formic acid, propionic acid, oxalic acid and malic acid.

The salts may include lithium, potassium, sodium or ammonium salts of these.

The chelating agent may include aminopolycarboxylic acids as exemplified by nitrilotriacetic acid and ethylenediaminetetraacetic acid, and salts of these.

The surface active agent may include anionic surface active agents as exemplified by sulfuric acid ester compounds and sulfone compounds, nonionic surface active agents of a polyethylene glycol type or an ester type, and amphoteric surface active agents as disclosed in Japanese Patent O.P.I. Publication No. 6840/1982 (title of the invention: Photographic Fixing Solution).

The wetting agent may include, for example, alkanolamines and alkylene glycols.

The fixing accelerator may include, for example, thiourea derivatives as disclosed in Japanese Patent Examined Publications No. 35754/1970, No. 122535/1983 and No. 122536/1983, alcohols having a triple bond in the molecule, and thioethers as disclosed in U.S. Pat. No. 4,126,459.

Of the above additives, acids such as sulfuric acid, boric acid and aminopolycarboxylic acids, and salts thereof are preferred. These additives may each be used in an amount of from 0.5 to 20.0 g/l.

A bleaching agent preferably used in the bleaching chemicals according to the present invention is a ferric complex salt of an organic acid represented by the following Formula L, M, N or P.

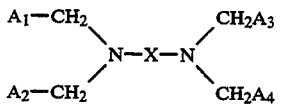

Formula L

In Formula L, $A_1$ or $A_4$ may be the same or different one another and each represent —$CH_2OH$, —COOM or $PO_3M_1M_2$, wherein M, $M_1$ and $M_2$ each represent a hydrogen atom, an alkali metal atom or an ammonium group; and X represents a substituted or unsubstituted alkylene group having 3 to 6 carbon atoms.

The compound represented by Formula L will be detailed below. In the formula, $A_1$ to $A_4$ have the same definition as $A_1$ to $A_4$ described in Japanese Patent Application No. 260628/1989, page 12, line 15 to page 15, line 3, and hence detailed description therefor is omitted.

Preferred examples of the compound represented by Formula L are shown below.

L-1 1,3-Propanediaminetetraacetic acid
L-2 2-Hydroxy-1,3-propanediaminetetraacetic acid
L-3 2,3-Propanediaminetetraacetic acid
L-4 1,4-Butandiaminetetraacetic acid
L-5 2-Methyl-1,3-propanediaminetetraacetic acid
L-6 N-(2-hydroxyethyl)-1,3-propanediaminetetraacetic acid
L-7 1,3-Propanediaminetetrakismethylenephosphonic acid
L-8 2-Hydroxy-1,3-propanediaminetetrakismethylenephosphonic acid
L-9 2,2-Dimethyl-1,3-propanediaminetetraacetic acid
L-10 2,4-Butanediaminetetraacetic acid
L-11 2,4-Pentanediaminetetraacetic acid
L-12 2-Methyl-2,4-pentanediaminetetraacetic acid Ferric complex salts of the compounds L-1 to L-12 may be sodium salts, potassium salts or ammonium salts of ferric complex salts of these compounds, any of which can be arbitrarily used. In view of the effect as aimed in the present invention and the solubility, ammonium salts of ferric complex salts of these compounds may preferably be used.

Of the above exemplary compounds, particularly preferably be used in the present invention are L-1, L-3, L-4, L-5 and L-9, and still particularly preferably L-1.

In the present invention, besides the iron complex salts of the compound represented by Formula L, ferric complex salts of the following compounds may also be used in the bleaching chemicals or bleach-fixing chemicals.

The compound represented by Formula M will be detailed below.

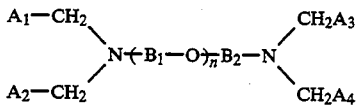

Formula M

In Formula M, $A_1$ to $A_4$ are the same as those defined in Formula L; n represent an integer of 1 to 8; $B_1$ and $B_2$ may be the same or different and each represent a substituted or unsubstituted alkylene group having 2 to 5 carbon atoms, as exemplified by ethylene, propylene, butylene or pentamethylene. The substituent may include a hydroxyl group, and an alkyl group having 1 to 3 carbon atoms as exemplified by a methyl, ethyl or propyl group.

Preferred examples of the compound represented by Formula M are shown below.

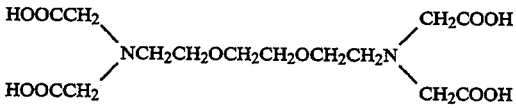

(M-1)

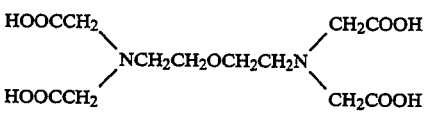

(M-2)

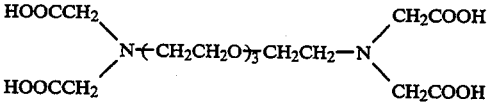

(M-3)

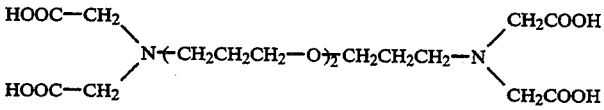

(M-4)

-continued (M-5)

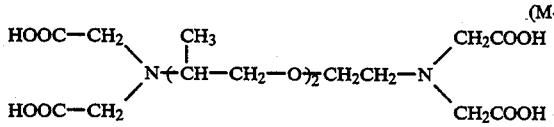

(M-6)

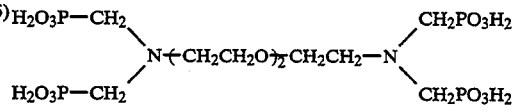

(M-7)

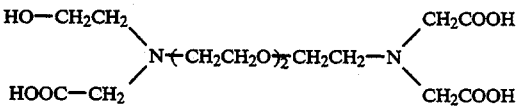

Ferric complex salts of the compounds M-1 to M-7 may be sodium salts, potassium salts or ammonium salts of ferric complex salts of these compounds, any of which can be arbitrarily used.

Of the organic ferric complex salts of the present invention, the ferric complex salts of the organic acid represented by Formula L or M are particularly preferably used in view of the effect as aimed in the present invention. In particular, L-1, L-3, L-4, L-5, L-9, M-1, M-2 and M-7 are preferable, and particularly preferably L-1 or M-1.

The compound represented by Formula N is shown below.

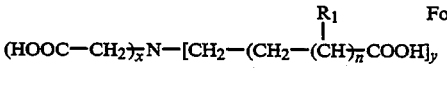

Formula N

In Formula N, $R_1$ represents a hydrogen atom or a hydroxyl group, n is 1 or 2, x is 2 or 3, y is 0 or 1, and the sum of x and y is always 3.

The compound represented by Formula P is shown below.

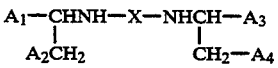

Formula P

In Formula P, $A_1$ to $A_4$ may be the same or different from one another, and each represent —CH2OH, $PO_3M_1M_2$ or —$COOM_3$, wherein $M_1M_2$ and $M_3$ each represent a hydrogen atom, an alkali metal atom as exemplified by sodium and potassium, or other cation as exemplified by ammonium, methylammonium or trimethylammonium; X represents a substituted or unsubstituted alkylene group having 3 to 6 carbon atoms, or —$(B_1O)_n$—$B_2$—. $B_1$ and $B_2$ may be the same or different each other, and each represent a substituted or unsubstituted alkylene group having 1 to 5 carbon atoms.

The alkylene group represented by X may include ethylene, triethylene and tetramethylene. The alkylene group represented by $B_1$ or $B_2$ may include methylene, ethylene and trimethylene. The substitutent on the alkylene group represented by X, $B_1$ or $B_2$ may include a hydroxyl group and an alkyl group having 1 to 3 carbon atoms as exemplified by a methyl group and an ethyl group. The letter symbol n represents an integer of 1 to 8, and preferably 1 to 4.

Preferred examples of the compound represented by P are shown below. Examples are by no means limited to these.

P-1

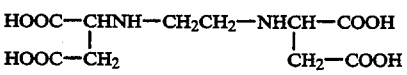

-continued

P-2

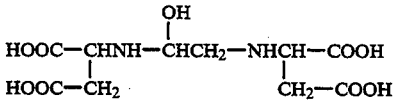

P-3

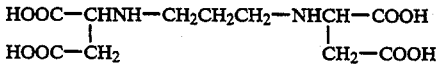

P-4

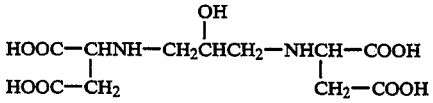

P-5

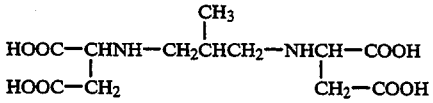

P-6

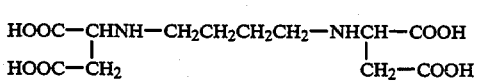

P-7

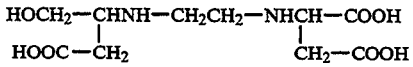

P-8

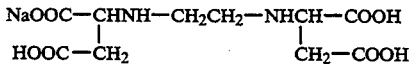

P-9

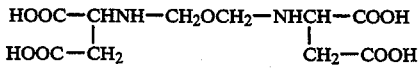

P-10

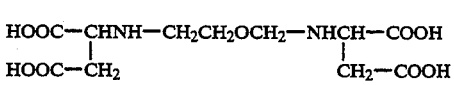

P-11

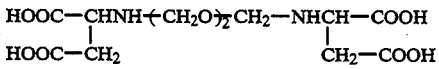

P-12

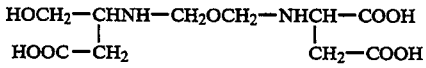

P-13

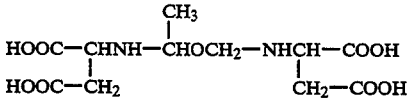

P-14

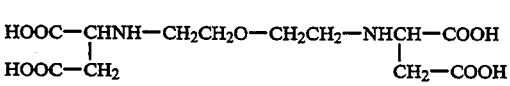

P-15

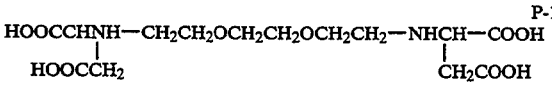

-continued

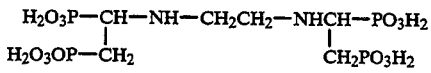

P-16

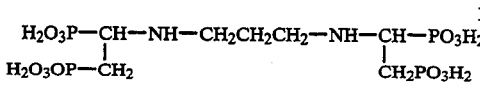

P-17

Besides the iron complex salts of the compound represented by the above Formulas L, M, N and P, ferric complex salts of the following compounds may also be used as the bleaching agent.

[A'-1] Ethylenediaminetetraacetic acid
[A'-2] Trans-1,2-cyclohexanediaminetetraacetic acid
[A'-3] Dihydroxyethylglycidic acid
[A'-4] Ethylenediaminetetrakismethylenephosphonic acid
[A'-5] Nitrilotrismethylenephosphonic acid
[A'-6] Diethylenetriaminepentakismethylenephosphonic acid
[A'-7] Diethylenetriaminepentaacetic acid
[A'-8] Ethylenediaminediorthohydroxyphenylacetic acid
[A'-9] Hydroxyethylenediaminetriacetic acid
[A'-10] Ethylenediaminedipropionic acid
[A'-11] Ethylenediaminediacetic acid
[A'-12] Hydroxyethyliminodiacetic acid
[A'-13] Nitrilotripropionic acid
[A'-14] Triethylenetetraminehexaacetic acid
[A'-16] Ethylenediaminetetrapropionic acid Any of the above ferric salts of organic acids may preferably be contained so as to be in an amount of from 0.1 mol to 2.0 mols, and more preferably from 0.15 mol to 1.5 mols, per 1,000 ml of a bleaching solution or bleach-fixing solution.

The bleaching chemicals, bleach-fixing chemicals and fixing chemicals may contain at least one of the imidazoles and derivatives thereof as disclosed in Japanese Patent O.P.I. Publication No. 295258/1989, compounds represented by Formulas I to IX and exemplary compounds thereof as also disclosed therein, which can be effective for rapid processability.

Besides the above accelerators, it is also possible to similarly use the exemplary compounds as disclosed in Japanese Patent O.P.I. Publication 123459/1987, pages 51 to 115 of its specification, the exemplary compounds as disclosed in Japanese Patent O.P.I. Publication 17445/1985, pages 22 to 25 of its specification, and the compounds as disclosed in Japanese Patent O.P.I. Publications No. 95630/1978 and No. 28426/1978.

Besides the foregoing, the bleaching chemicals or bleach-fixing chemicals may also contain a halide such as ammonium bromide, potassium bromide or sodium bromide, every sort of optical brightening agent, a defoaming agent or a surface active agent.

As a fixing agent used in the fixing chemicals or bleach-fixing chemicals according to the present invention, a thiocyanate and a thiosulfate may preferably be used. The thiocyanate may preferably be contained so as to be in an amount of not less than 0.1 mol/l. In the case when color negative films are processed, it may more preferably be in an amount of not less than 0.5 mol/l, and particularly preferably be not less than 1.0 mol/l. The thiosulfate may preferably be contained so as to be in an amount of not less than 1.0 mol/l. In the case when color negative films are processed, it may more preferably be in an amount of not less than 0.2 mol/l, and particularly preferably be not less than 0.5 mol/l. In the present invention, the objects of the present invention can be more effectively achieved when the thiocyanate and thiosulfate are used in combination.

In addition to such a fixing agent, the fixing chemicals or bleach-fixing chemicals according to the present invention may also contain a buffering agent comprised of every sort of salt, which may be used alone or in combination of two or more kinds. The fixing chemicals or bleach-fixing chemicals may further contain a large quantity of a re-halogenating agent such as an alkali halide or ammonium halide, as exemplified by potassium bromide, sodium bromide, sodium chloride or ammonium bromide. It is also possible to appropriately add compounds which are known to be usually added to fixing chemicals or bleach-fixing chemicals, as exemplified by alkylamines and polyethylene oxides.

The compound represented by the following Formula FA, disclosed in Japanese Patent O.P.I. Publication No. 295258/1989, page 56 of its specification, together with its exemplary compounds, may preferably be added to the fixing chemicals or bleach-fixing chemicals, whereby not only the effect of the present invention can be well obtained but also an additional effect can be obtained such that sludge may much less occur in a processing solution having a fixing ability, when light-sensitive materials are processed in a small quantity over a long period of time.

Formula FA:

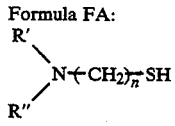

The compounds represented by Formula FA as described in that specification can be synthesized by usual methods as disclosed in U.S. Pat. No. 3,335,161 and No. 3,260,718. The compounds represented by Formula FA may each be used alone or in combination of two or more kinds. Any of these compounds may be added so as to be in an amount of from 0.1 g to 200 g per 1,000 ml of a processing solution, within the range of which good results can be obtained.

In the present invention, the stabilizing chemicals may preferably contain a chelating agent having a chelate stability constant with respect to iron ions, of not less than 8. Here, the chelate stability constant refers to the constant commonly known from L. G. Sillen and A. E. Martell, "Stability Constants of Metal-ion Complexes", The Chemical Society, London (1964), and S. Chaberek and A. E. Martell, "Organic Seqestering Agents", Wiley (1959). The chelating agent having a chelate stability constant with respect to iron ions, of not less than 8 may include those disclosed in Japanese Patent Applications No. 234776/1990 and No. 324507/1989. Any of these chelating agents may preferably be used so as to be in an amount of from 0.01 to 50 g, and more preferably from 0.05 to 20 g, per 1,000 ml of a stabilizing chemicals, within the ranges of which good results can be obtained.

Preferred compounds that can be added to the stabilizing solution may include ammonium compounds. These are fed by ammonium salts of various inorganic compounds. The ammonium compound may be added so as to be in an amount preferably ranging from 0.001 mol to 2.0 mol, and more preferably ranging from 0.002 mol to 1.0 mols, per 1,000 ml of a stabilizing solution.

The stabilizing chemicals may preferably also contain a sulfite.

The stabilizing chemicals may preferably also contain a metal salt used in combination with the above chelating agent. Such a metal salt may include salts of metals such as Ba, Ca, Ce, Co, In, La, Mn, Ni, Bi, Pb, Sn, Zn, Ti, Zr, Mg, Al and Sr. It can be fed in the form of an inorganic salt such as a halide, a hydroxide, a sulfate, a carbonate, a phosphate and an acetate, or in the form of water-soluble chelating agents. The metal salt may preferably be used in an amount ranging from $1\times10^{-4}$ to $1\times10^{-1}$ mol, and more preferably ranging from $4\times10^{-4}$ to $2\times10^{-2}$ mol, per 1,000 ml of the stabilizing solution.

To the stabilizing chemicals, it is also possible to add a salt of an organic acid such as citric acid, acetic acid, succinic acid, oxalic acid or benzoic acid, a pH adjuster such as phosphate, borate, hydrochloric acid or sulfate, and so forth.

In the present invention, a known antifungal agent may also be used alone or in combination, so long as the effect of the present invention is not lost.

The light-sensitive silver halide photographic material to which the solid processing chemicals of the present invention are applied will be described below.

In the case when the light-sensitive materials are light-sensitive material for photographing, silver halide grains used may comprise silver iodobromide or silver iodochloride with an average silver iodide content of not less than 3 mol %, and particularly preferably silver iodobromide with a silver iodide content of from 4 mol % to 15 mol %. In particular, an average silver iodide content preferable for the present invention is in the range of from 5 mol % to 12 mol %, and most preferably from 8 mol % to 11 mol %.

As silver halide emulsions used in the light-sensitive material to be processed using the photographic processing chemicals of the present invention, those disclosed in Research Disclosure No. 308119 (hereinafter "RD308119") can be used. Items described and paragraphs thereof are shown in the following table.

| Items | Page of RD308119 | |
|---|---|---|
| Iodine formation | 993 | Par. I-A |
| Preparation method | 993<br>994 | Par. I-A and<br>Par. E |
| Crystal habit: | | |
| Normal crystal | 993 | Par. I-A |
| Twinned crystal | " | " |
| Epitaxial growth | " | " |
| Halogen composition: | | |
| Uniform | 993 | Par. I-B |
| Not uniform | " | " |
| Halogen conversion | 994 | Par. I-C |
| Halogen substitution | " | " |
| Metal content | 994 | Par. I-D |
| Monodispersion | 995 | Par. I-F |
| Addition of solvent | " | " |
| Latent image forming position: | | |
| Surface | 995 | Par. I-G |
| Interior | " | " |
| Light-sensitive material: | | |
| Negative | 995 | Par. I-H |
| Positive (containing internal fog grains) | " | " |
| Use of emulsion by mixture | 995 | Par. I-J |
| Desalting | 995 | Par. II-A |

Silver halide emulsions having been subjected physical ripening, chemical ripening and spectral sensitization are used. Additives used in such steps are described in Research Disclosures No. 17643, No. 18716 and No. 308119 (hereinafter "RD17643", "RD18716" and "RD308119", respectively).

Items described and paragraphs thereof are shown in the following table.

| Items | Page of RD308119, RD17643, RD18716 | | | |
|---|---|---|---|---|
| Chemical sensitizer | 996 | Par. III-A | 23 | 648 |
| Spectral sensitizer | 996 | Par. IV-A-A,B,C,D,E,H,I,J | 23–24 | 648–649 |
| Supersensitizer | 996 | Par. IV-A-E,J | 23–24 | 648–649 |
| Antifoggant | 998 | Par. VI | 24–25 | 649 |
| Stabilizer | 998 | Par. VI | 24–25 | 649 |

Photographic additives are also described in the above Research Disclosures. Items described and paragraphs thereof are shown in the following table.

| Items | Page of RD308119, RD17643, RD18716 | | | |
|---|---|---|---|---|
| Color contamination preventive agent | 1002 | Par. VII-I | 25 | 650 |
| Color image stabilizer | 1001 | Par. VII-J | 25 | |
| Brightening agent | 998 | V | 24 | |
| Ultraviolet absorbent | 1003 | Par. VIIIC XIIIC | 25–26 | |
| Light absorbing agent | 1003 | Par. VIII | 25–26 | |
| Light scattering agent | 1003 | Par. VIII | | |
| Filter dye | 1003 | Par. VIII | 25–26 | |
| Binder | 1003 | Par. IX | 26 | 651 |
| Antistatic agent | 1006 | Par. XIII | 27 | 650 |
| Hardening agent | 1004 | Par. X | 26 | 651 |
| Plasticizer | 1006 | Par. XII | 27 | 650 |
| Lubricant | 1006 | Par. XII | 27 | 650 |
| Surfactant, coating aid | 1005 | Par. XI | 26–27 | 650 |
| Matting agent | 1007 | Par. VI | | |
| Developing agent (contained in light-sensitive materials) | 1011 | Par. XX-B | | |

Various couplers can be used in the light-sensitive material to be processed using the photographic processing chemicals of the present invention. Examples thereof are described in the above Research Disclosures. Related items described and paragraphs thereof are shown in the following table.

| Items | Page of RD308119, RD17643 | | |
|---|---|---|---|
| Yellow coupler | 1001 | Par. VII-D | Par. VII-C-G |
| Magenta coupler | 1001 | Par. VII-D | Par. VII-C-G |
| Cyan coupler | 1001 | Par. VII-D | Par. VII-C-G |
| DIR coupler | 1001 | Par. VII-F | Par. VII-F |
| BAR coupler | 1002 | Par. VII-F | |
| Other useful residual group releasing coupler | 1001 | Par. VII-F | |
| Alkali-soluble coupler | 1001 | Par. VII-E | |

The additives can be added by the dispersion method as described in RD308119, Paragraph XIV.

In the present invention, the supports as described in the aforesaid RD17643, page 28, RD18716, pages 647 to 648 and RD308119, Paragraph XIX can be used.

The light-sensitive material may also be provided with the auxiliary layers such as filter layers and intermediate layers as described in RD308119, Paragraph VII-K. The light-sensitive material used in the present invention may be comprised of various layers of conventional layer order, inverse layer order or unit structure as described in the aforesaid RD308119, Paragraph VII-K.

A preferred color light-sensitive material to which the photographic processing chemicals of the present invention are applied will be described below.

Silver halide grains used in the light-sensitive material may be silver halide grains mainly composed of silver chloride with a sliver chloride content of not less than 80 mol %, preferably not less than 90 mol %, particularly preferably not less than 95 mol %, and most preferably not less than 99 mol %.

The above silver halide grains mainly composed of silver chloride may contain, in addition to silver chloride, silver bromide and/or silver iodide as silver halide composition. In this instance, silver bromide may preferably in a content of not more than 20 mol %, more preferably not more than 10 mol %, and still more preferably not more than 3 mol %. In the case when silver iodide is present, it may preferably be in a content of not more than 1 mol %, more preferably 0.5 mol %, and most preferably 0 mol %. The silver halide grains mainly composed of silver chloride, comprising 50 mol % or more of silver chloride may be applied to at least one silver halide emulsion layer, and preferably applied to all the light-sensitive silver halide emulsion layers.

The crystals of the silver halide grains described above may be regular crystals or twinned crystals, or may be of any other form. Those having any ratio of [1.0.0]face to [1.1.1] face can be used. With regard to the crystal structure, these silver halide grains may have a structure which is uniform from the interior to the outer surface, or a layer structure wherein the inside and the outer surface are of different nature, i.e., a core/shell type. These silver halide grains may be of the type wherein a latent image is mainly formed on the surface, or the type wherein it is formed in the interior of grains. Tabular silver halide grains (see Japanese Patent O.P.I. Publications No. 113934/1983 and No. 47959/1986) may also be used. It is also possible to use the silver halides as disclosed in Japanese Patent O.P.I. Publications No. 26837/1989, No. 26838/1989 and No. 77047/1989.

The silver halide grains may be those obtained by any preparation method such as the acid method, the neutral method or the ammonia method. They may also be those prepared, for example, by a method in which seed grains are formed by the acid method, which are then made to grow by the ammonia method capable of achieving a higher grow rate, until they come to have a given size. When the silver halide grains are grown, it is preferred to control the pH, pAg, etc. in a reaction vessel and to successively and simultaneously add and mix silver ions and halide ions in the amounts corresponding to the rate of growth of silver halide grains, as in the manner disclosed, for example, in Japanese Patent O.P.I. Publication No. 48521/1979.

A preferred embodiment for applying the photographic processing chemicals of the present invention may include an embodiment in which the processing chemicals are applied to photographic processing of a light-sensitive silver halide photographic material containing at least one of compounds represented by Formula T or H.

Formula T

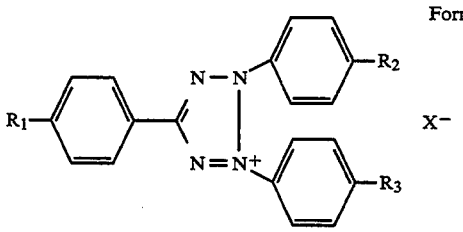

In the formula, $R_1$, $R_2$ and $R_3$ each represent a hydrogen atom or a substituent, and $X^-$ represents an anion.

In the above Formula T, preferable examples of the substituent represented by $R_1$ to $R_3$ are groups such as an alkyl group as exemplified by methyl, ethyl, cyclopropyl, propyl, isopropyl, cyclopropyl, butyl, isobutyl, pentyl or cyclohexyl, an amino group, an acylamino group as exemplified by acetylamino, a hydroxyl group, an alkoxyl group as exemplified by methoxy, ethoxy, propoxy, butoxy or pentoxy, an acyloxy group as exemplified by acetyloxy, a halogen atom as exemplified by fluorine, chlorine or bromine, a carbamoyl group, an acylthio group as exemplified by acetylthio, an alkoxycarbonyl group as exemplified by ethoxycarbonyl, a carboxyl group, an acyl group as exemplified by acetyl, a cyano group, a nitro group, a mercapto group, a sulfoxy group and an aminosulfoxy group. The anion represented by $X^-$ may include, for example, halogen ions such as a chloride ion, a bromide ion and an iodide ion, acid radicals of inorganic acids such as nitric acid, sulfuric acid and perchloric acid, acid radicals of organic acids such as sulfonic acid and carboxylic acid, and anion type activators, specifically including those comprising a lower alkylbenzenesulfonate anion such as p-toluenesulfonate anion, a higher alkylbenzenesulfonate anion such as p-dodecybenzenesulfonate anion, a higher alkylsulfuric acid ester anion such as laurylsulfate anion, a borate type anion such as tetraphenyl borate, a dialkylsulfosuccinate anion such as di-2-ethylhexylsulfosuccinate anion, a polyether alcohol sulfuric acid ester anion such as cetylpolyethenoxysulfate anion, a higher fatty acid ester anion such as stearate anion or a polymer such as polyacrylate anion to which an acid radical is attached.

Examples of the compound represented by Formula T are shown below, which are by no means limited to these.

| Exemplary Compound No. | $R_1$ | $R_2$ | $R_3$ | $X^-$ |
|---|---|---|---|---|
| T-1 | H | H | H | $Cl^-$ |
| T-2 | H | p-$CH_3$ | p-$CH_3$ | $Cl^-$ |
| T-3 | H | m-$CH_3$ | m-$CH_3$ | $Cl^-$ |
| T-4 | H | o-$CH_3$ | o-$CH_3$ | $Cl^-$ |
| T-5 | p-$CH_3$ | p-$CH_3$ | p-$CH_3$ | $Cl^-$ |
| T-6 | H | p-$OCH_3$ | p-$OCH_3$ | $Cl^-$ |
| T-7 | H | m-$OCH_3$ | m-$OCH_3$ | $Cl^-$ |
| T-8 | H | o-$OCH_3$ | o-$OCH_3$ | $Cl^-$ |
| T-9 | p-$OCH_3$ | p-$OCH_3$ | p-$OCH_3$ | $Cl^-$ |

-continued

| | | | | |
|---|---|---|---|---|
| T-10 | H | p-$C_2H_5$ | p-$C_2H_5$ | $Cl^-$ |
| T-11 | H | m-$C_2H_5$ | m-$C_2H_5$ | $Cl^-$ |
| T-12 | H | p-$C_3H_7$ | p-$C_3H_7$ | $Cl^-$ |
| T-13 | H | p-$OC_2H_5$ | p-$OC_2H_5$ | $Cl^-$ |
| T-14 | H | p-$OCH_3$ | p-$OCH_3$ | $Cl^-$ |
| T-15 | H | p-$OCH_3$ | p-$OC_2H_5$ | $Cl^-$ |
| T-16 | H | p-$OC_5H_{11}$ | p-$OCH_3$ | $Cl^-$ |
| T-17 | H | p-$OC_8H_{17}$-n | p-$OC_8H_{17}$-n | $Cl^-$ |
| T-18 | H | p-$C_{12}H_{25}$-n | p-$C_{12}H_{25}$-n | $Cl^-$ |
| T-19 | H | p-$N(CH_3)_2$ | p-$N(CH_3)_2$ | $Cl^-$ |
| T-20 | H | p-$NH_2$ | p-$NH_2$ | $Cl^-$ |
| T-21 | H | p-OH | p-OH | $Cl^-$ |
| T-22 | H | m-OH | m-OH | $Cl^-$ |
| T-23 | H | p-Cl | p-Cl | $Cl^-$ |
| T-24 | H | m-Cl | m-Cl | $Cl^-$ |
| T-25 | p-CN | p-$CH_3$ | p-$CH_3$ | $Cl^-$ |
| T-26 | p-SH | p-$OCH_3$ | p-$OCH_3$ | $Cl^-$ |
| T-27 | H | p-$OCH_3$ | p-$OCH_3$ | n-$C_{12}H_{25}$—⟨benzene⟩—$SO_3^-$ |

Formula H

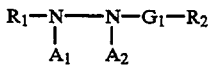

In Formula H, $R_1$ represents an aliphatic group or an aromatic group; $R_2$ represents a hydrogen atom, an alkyl group, an aryl group, an alkoxyl group, an aryloxy group, an amino group, a hydrazino group, a carbamoyl group or an oxycarbonyl group; $G_1$ represents a carbonyl group, a sulfonyl group, a sulfoxy group, a

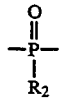

group, a —CO—CO— group, a thiocarbonyl group or an iminomethylene group; both $A_1$ and $A_2$ represent hydrogen atoms, or one of them represents a hydrogen atom and the other represents a substituted or unsubstituted alkylphosphonyl group, a substituted or unsubstituted arylsulfonyl group or a substituted or unsubstituted acyl group.

In Formula H, the aliphatic group represented by $R_1$ may preferably be an aliphatic group having 1 to 30 carbon atoms, in particular, a straight-chain, branched or cyclic alkyl group having 1 to 20 carbon atoms. Here, the branched alkyl group may be so cyclized as to form a saturated heterocyclic group containing one or more of hereto atoms therein. This alkyl group may also have a substituent such as an aryl group, an alkoxyl group, a sulfoxy group, a sulfonamido group or a carbonamido group.

In Formula H, the aromatic group represented by $R_1$ is a moncyclic or bicyclic aryl group or an unsaturated heterocyclic group. Here, the unsaturated heterocyclic group may condense the monocyclic or bicyclic aryl group to form a heteroaryl group.

It includes, for example, a benzene ring, a naphthalene ring, a pyridine ring, a pyrimidine ring, an imidazole ring, a pyrazole ring, a quinoline ring, an isoquinoline ring, a benzimidazole ring, a thiazole ring and a benzothiazole ring. In particular, those containing a benzene ring are preferred.

What is particularly preferred as $R_1$ is an aryl group.

The aryl group or unsaturated heterocyclic group represented by $R_1$ may be substituted. Typical substituents are exemplified by an alkyl group, an aralkyl group, an alkenyl group, an alkynyl group, an alkoxyl group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxyl group, a phosphoric acid amido group, a diacylamino group, an imido group and an $R_2$—$NHCONR_2$—CO— group. Preferred substituents are a straight-chain, branched or cyclic alkyl group, preferably those having 1 to 20 carbon atoms; an aralkyl group, preferably monocyclic or bicyclic one whose alkyl moiety has 1 to 3 carbon atoms; an alkoxyl group, preferably those having 1 to 20 carbon atoms; a substituted amino group, preferably an amino group substituted with an alkyl group having 1 to 20 carbon atoms; an acylamino group, preferably those having 2 to 30 carbon atoms; a sulfonamido group, preferably those having 1 to 30 carbon atoms; a ureido group, preferably those having 1 to 30 carbon atoms; and a phosphoric acid amido group, preferably those having 1 to 30 carbon atoms.

In Formula H, the alkyl group represented by $R_2$ may preferably be an alkyl group having 1 to 4 carbon atoms, and may have a substituent as exemplified by a halogen atom, a cyano group, a carboxyl group, a sulfo group, an alkoxyl group, a phenyl group, an acyl group, an alkoxycarbonyl group, an aryloxycarbonyl group, a carbamoyl group, an alkylsulfo group, an arylsulfo group, a sulfamoyl group, a nitro group, a heterocyclic aromatic ring group, and a

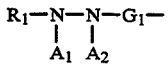

group.

These substituents may be further substituted.

The aryl group may preferably be a monocyclic or bicyclic aryl group, including, for example, a benzene ring. This aryl group may be substituted. Examples of the substituent are the same as those in the case of the alkyl group.

The alkoxyl group may preferably an alkoxyl group having 1 to 8 carbon atoms, and may be substituted with a halogen atom or an aryl group.

The aryloxy group may preferably be a monocyclic aryloxy group, and may have a substituent including a halogen atom.

The amino group may preferably be an unsubstituted amino group, an alkylamino group having 1 to 10 carbon atoms or an arylamino group, and may be substituted with an alkyl group, a halogen atom, a cyano group, a nitro group or a carboxyl group.

The carbamoyl group may preferably be an unsubstituted carbamoyl group, an alkylcarbamoyl group having 1 to 10 carbon atoms or an arylcarbamoyl group, and may be substituted with an alkyl group, a halogen atom, a cyano group or a carboxyl group.

The oxycarbonyl group may preferably be an alkoxycarbonyl group having 1 to 10 carbon atoms or an aryl oxycarbonyl group, and may be substituted with an alkyl group, a halogen atom, a cyano group or a nitro group.

Of the groups represented by $R_2$, preferred ones are a hydrogen atom, an alkyl group as exemplified by a methyl group, a trifluoromethyl group, a 3-hydroxypropyl group, a 3-methanesulfonamidopropyl group or a phenylsulfonylmethyl group, an aralkyl group as exemplified by an o-hydroxybenzyl group, an aryl group as exemplified by a phenyl group, a 3,5-dichlorophenyl group, an o-methanesulfonamidophenyl group or a 4-methanesulfonylphenyl group, when $G_1$ is a carbonyl group. The hydrogen atom is particularly preferred.

When $G_1$ is a sulfonyl group, $R_2$ may preferably be an alkyl group as exemplified by a methyl group, an aralkyl group as exemplified by an o-hydroxyphenylmethyl group, an aryl group as exemplified by a phenyl group, or a substituted amino group as exemplified by a dimethylamino group.

When $G_1$ is a sulfoxy group, $R_2$ may preferably be a cyanobenzyl group or a methylthiobenzyl group. When $G_1$ is a

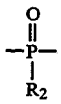

group, $R_2$ may preferably be a methoxy group, an ethoxy group, a butoxy group, a phenoxy group or a phenyl group. The phenoxy group is particularly preferred.

When $G_1$ is a N-substituted or unsubstituted iminomethylene group, $R_2$ may preferably be a methyl group, an ethyl groupor a substituted or unsubstituted phenyl group.

As the substituent of $R_2$, the substituents listed for $R_1$ can be applied.

G in Formula H, a carbonyl group is most preferred.

$R_2$ may be a group capable of splitting the moiety of $G_1$—$R_2$ from the remaining molecule to cause cyclization reaction that produces a cyclic structure containing an atom present in the moiety of —$G_1$—$R_2$. Stated specifically, it is a group that can be represented by the following Formula a.

Formula a $$-R_3-Z_1$$

In the formula, $Z_1$ is a group capable of nucleophilically attacking $G_1$ to split the moiety $G_1$—$R_3$—$Z_1$ from the remaining molecule. $R_3$ represents a group formed by removing one hydrogen atom from $R_2$ and capable of allowing $Z_1$ to nucleophilically attack $G_1$ to produce a cyclic structure with $G_1$, $R_3$ and $Z_1$.

More particularly, $Z_1$ is a group capable of readily nucleophilically reacting with $G_1$ when the hydrazine compound of Formula H has undergone oxidation or the like to produce the following reaction intermediate:

$$R_1-N=N-G_1-R_3-Z_1,$$

and splitting the $R_1$—N=N group from $G_1$. Stated specifically, it may be a functional group capable of directly reacting with $G_1$, such as —OH, —SH, —$NHR_4$ ($R_4$ represents a hydrogen atom, an alkyl group, an aryl group, —$COR_5$ or —$SO_2R_5$, wherein $R_5$ represents a hydrogen atom, an alkyl group, an aryl group or a heterocyclic group) or —COOH (here the —OH, —SH, —$NHR_4$ and —COOH may be temporarily protected so that any of these groups can be produced by hydrolysis of an alkali or the like), or a functional group that becomes capable of reacting with $G_1$ as a result of the reaction of a nucleophilic reagent such as hydroxyl ions or sulfite ions, as exemplified by the following:

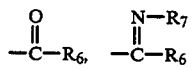

wherein $R_7$ and $R_8$ each represents a hydrogen atom, an alkyl group, an alkenyl group, an aryl group or a heterocyclic group.

The ring formed by $G_1$, $R_3$ and $Z_1$ may preferably be a ring of 5 members or 6 members.

Of the groups represented by Formula a, preferred groups may include those represented by Formulas b and c.

Formula b

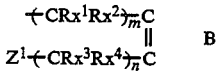

In the formula, $RX^1$ to $RX^4$ each represent a hydrogen atom, an alkyl group, preferably an alkyl group having 1 to 12 carbon atoms, an alkenyl group, preferably an alkenyl group having 2 to 12 carbon atoms, an aryl group, preferably an aryl group having 6 to 12 carbon atoms, and may be the same or different. B represents an atom necessary to complete a 5-membered ring or 6-membered ring which may have a substituent, and m and n are each 0 or 1 and (n+m) is 1 or 2.

The 5-membered ring or 6-membered ring completed by B is exemplified by a cyclohexene ring, a cycloheptene ring, a benzene ring, a naphthalene ring, a pyridine ring and a quinoline ring.

$Z_1$ has the same definition as $Z_1$ in Formula a.

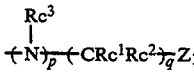

Formula c

In the formula, $Rc^1$ and $Rc^2$ each represent a hydrogen atom, an alkyl group, an alkenyl group, an aryl group or a halogen atom, and may be the same or different. $Rc^3$ represents a hydrogen atom, an alkyl group, an alkenyl group or an aryl group. Letter symbol p represents 0 or 1, and q represents 1 to 4. $Rc^1$, $Rc^2$ and $Rc^3$ may combine each other to form a ring, so long as the structure that can allow $Z_1$ to nucleophilically attack $G_1$ is retained.

$Rc^1$ and $Rc^2$ may preferably be a hydrogen atom, a halogen atom or an alkyl group. $Rc^3$ may preferably be an alkyl group or an aryl group. Letter symbol q may preferably represent 1 to 3, and p is 0 or 1 when q is 1, p is o0 or 1 when q is 2 and p is 0 or 1 when q is 3. When q is 2 or 3, $Rc^1$ and $Rc^2$ may be the same or different. $Z_1$ has the same definition as $Z_1$ in Formula a.

In Formula H, $A_1$ and $A_2$ each represent a hydrogen atom, an alkylsulfonyl group or arylsulfonyl group having 20 or less carbon atoms, preferably a phenylsulfonyl group or a phenylsulfonyl group so substituted that the sum of the Hammatt's substituent constants comes to be −0.5 or more; an acyl group having 20 or less carbon atoms, preferably a benzoyl group or a benzoyl group so substituted that the sum of the Hammett's substituent constants comes to be −0.5 or more; or a straight-chain, branched or cyclic substituted or unsubstituted aliphatic acyl group, whose substituent may include, for example, a halogen atom, an ether group, a sulfonamido group, a carbonamido group, a hydroxyl group, a carboxyl group and a sulfonic acid group. As the $A_1$ and $A_2$, hydrogen atoms are most preferred.

$R_1$ or $R_2$ in Formula H may be a group incorporated therein with a ballast group or polymer usually used in photographic additives. The ballast group is a group having 8 or more carbon atoms and relatively inert to photographic performance, and can be selected from, for example, an alkyl group, an alkoxyl group, a phenyl group, an alkylphenyl group, a phenoxy group and an alkylphenoxy group. The polymer may include, for example, those disclosed in Japanese Patent O.P.I. Publication No. 100530/1989.

$R_1$ or $R_2$ in Formula H may be a group incorporated therein with a group capable of strengthening adsorption to the surfaces of silver halide grains. Such an adsorptive group may include groups such as a thiourea group, a heterocyclic thioamido group, a mercapto heterocyclic group and a triazole group which are disclosed in U.S. Pat. No. 4,385,108 and No. 4,459,347, Japanese Patent O.P.I. Publications No. 195233/1984, No. 200231/1984, No. 201045/1984, No. 201046/1984, No. 201047/1984, No. 201048/1984, No. 201049/1984, No. 170733/1986, No. 270744/1986 and No. 948/1987, and Japanese Patent Applications No. 67508/1987, No. 67501/1987 and No. 67510/1987.

In the present invention, among these, a compound represented by the following Formula H-a, H-b, H-c or H-d is preferred.

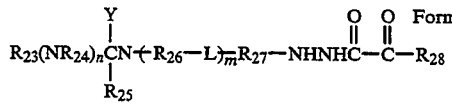

Formula H-a

In the above Formula H-a, $R_{23}$ and $R_{24}$ each represent a hydrogen atom, a substituted or unsubstituted alkyl group as exemplified by a methyl group, an ethyl group, a butyl group, a dodecyl group, a 2-hydroxypropyl group, a 2-cyanoethyl group or a 2-chloroethyl group, a substituted or unsubstituted phenyl group, naphthyl group, cyclohexyl group, pyridyl group or pyrrolidyl group as exemplified by a phenyl group, a p-methylphenyl group, a naphthyl group, an α-hydroxynaphthyl group, a cyclohexyl group, a p-methylcyclocyclohexyl group, a pyridyl group, a 4-propyl-2-pyridyl group, a pyrrolidyl group or a 4-methyl-2-pyrrolidyl group. $R_{25}$ represents a hydrogen atom, a substituted or unsubstituted benzyl group, alkoxyl group or alkyl group as exemplified by a benzyl group, a p-methylbenzyl group, a methoxy group, an ethoxy group, an ethyl group or a butyl group. $R_{26}$ and $R_{27}$ each represent a divalent aromatic group as exemplified by a phenylene group or a naphthylene group. Y represents a sulfur atom or an oxygen atom. L represents a divalent linking group as exemplified by $—SO_2CH_2CH_2NH—$, $—SO_2NH—$, $—OCH_2SO_2NH—$ or $—O—CH{=}N—$. $R_{28}$ represents $—NR'R''$ or $—OR_{29}$, wherein R', R'' and $R_{29}$ each represent a hydrogen atom, a substituted or unsubstituted alkyl group as exemplified by a methyl group, an ethyl group or a dodecyl group, a phenyl group as exemplified by a phenyl group, a p-methylphenyl group, or a p-methoxyphenyl group, a naphthyl group as exemplified by an α-naphthyl group or a β-naphthyl group, or a heterocyclic group as exemplified by unsaturated heterocyclic residual group such as pyridine, thiophene or furan or saturated heterocyclic residual group such as tetrahydrofuran or sulfolane, and R' and R'' may form a ring together with a nitrogen atom, as exemplified by piperidine, piperazine or morpholine.

Letter symbols m and n each represent 0 or 1. When $R_{28}$ represents $—OR_{29}$, Y may preferably represent an ionic atom.

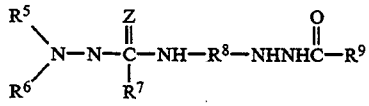

Formula H-b

In Formula H-b, $R^5$, $R^6$ and $R^7$ each represent a hydrogen atom, an alkyl group as exemplified by a methyl group, an ethyl group, a butyl group or a 3-aryloxypropyl group, a substituted or unsubstituted phenyl group, a naphthyl group, a cyclohexyl group, a pyridyl group, a pyrolidyl group, a substituted or unsubstituted alkoxyl group as exemplified by a methoxy group, an ethoxy group a butoxy group, or a substituted or unsubstituted aryloxy group as exemplified by a phenoxy group or a 4-methylphenoxy group.

In the present invention, $R^5$ and $R^6$ may each preferably be a substituted alkyl group, the substituent including an alkoxyl group or an aryl group, and $R^7$ may preferably be a hydrogen atom or an alkyl group. $R^8$ represents a divalent aromatic group as exemplified by a phenylene group or a naphthylene group, and Z represents a sulfur atom or an oxygen atom. $R^9$ represents a substituted or unsubstituted alkyl group, alkoxyl group or amino group, where the substituent may include an alkoxyl group, a cyano group or an aryl group.

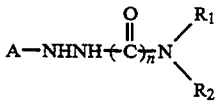

Formula H-c

Formula H-d

A—NHNH—CO—CO—$R_3$

In Formulas H-c and H-d, A represents an aryl group or a heterocyclic group containing at least one sulfur atom or an oxygen atom, and n represents an integer of 1 or 2. When n is 1, $R_1$ and $R_2$ each represent a hydrogen atom, an alkyl group, an alkenyl group, an alkynyl group, an aryl group, a heterocyclic group, a hydroxyl group, an alkoxyl group, an alkenyloxy group, an alkynyloxy group, an aryloxy group or a heterocyclic oxy group. $R_1$ and $R_2$ may form a ring together with a nitrogen atom. When n is 2, $R_1$ and $R_2$ each represent a hydrogen atom, an alkyl group, an alkenyl group, an alkynyl group, an aryl group, a saturated or unsaturated heterocyclic group, a hydroxyl group, an alkoxyl group, an alkenyloxy group, an alkynyloxy group, an aryloxy group or a heterocyclic oxy group; provided that when n is 2 at least one of $R_1$ and $R_2$ represents an alkenyl group, an alkynyl group, a saturated heterocyclic group, a hydroxyl group, an alkoxyl group, an alkenyloxy group, an alkynyloxy group, an aryloxy group or a heterocyclic oxy group. $R_3$ represents an alkynyl group or a saturated heterocyclic group. The compound represented by Formula H-c or H-d includes those in which at least one of H's in the —NHNH— in the formulas has been replaced by a substituent.

Stated more particularly, A represents an aryl group as exemplified by phenyl or naphthyl, or a heterocyclic group containing at least one of a sulfur atom or an oxygen atom as exemplified by thiophene, furan, benzothiophene or pyran. $R_1$ and $R_2$ each represent a hydrogen atom, an alkyl group as exemplified by methyl, ethyl, methoxyethyl, cyanoethyl, hydroxyethyl, benzyl or trifluoroethyl, an alkenyl group as exemplified by allyl, butenyl, pentenyl or pentadienyl, an alkynyl group as exemplified by propaginyl, butynyl or pentynyl, an aryl group as exemplified by phenyl, naphthyl, cyanophenyl or methoxyphenyl, a heterocyclic group as exemplified by unsaturated heterocyclic residual group such as pyridine, thiophene or furan or a saturated heterocyclic residual group such as tetrahydrofuran or sulfolane, a hydroxyl group, an alkoxyl group as exemplified by methoxy, ethoxy, benzyloxy or cyanomethoxy, an alkenyloxy group as exemplified by allyloxy or butenyloxy, an alkynyloxy group as exemplified by propagyloxy or butynyloxy, an aryloxy group as exemplified by phenoxy or naphthyloxy, or a heterocyclic oxy group as exemplified by pyridyloxy or pyrimidyloxy, and, when n is 1, $R_1$ and $R_2$ may form a ring together with a nitrogen atom, as exemplified by piperidine, piperazine or morpholine; provided that when n is 2 at least one of $R_1$ and $R_2$ represents an alkenyl group, an alkynyl group, a saturated heterocyclic group, a hydroxyl group, an alkoxyl group, an alkenyloxy group, an alkynyloxy group, an aryloxy group or a heterocyclic group.

Examples of the alkynyl group and saturated heterocyclic group represented by $R_3$ may include those described above.

Various kinds of substituents can be introduced into the aryl group or heterocyclic group containing at least one of a sulfur atom or an oxygen atom represented by A. The substituents that can be introduced may include, for example, a halogen atom, an alkyl group, an aryl group, an alkoxyl group, an aryloxy group, an acyloxy group, an alkylthio group, an arylthio group, a sulfionyl group, an alkoxycarbonyl group, an aryloxycarbonyl group, a carbamoyl group, a sulfamoyl group, an acyl group, an amino group, an alkylamino group, an arylamino group, an acylamino group, a sulfonamido group, an arylaminothiocarbonylamino group, a hydroxyl group, a carboxyl group, a sulfo group, a nitro group and a cyano group. Of these substituents, the sulfonamido group is preferred.

In Formulas H-c and H-d, A may preferably contain at least one diffusion-proof group or silver halide adsorption accelerating group. The diffusion-proof group may preferably be a ballast group usually used in immobilizable photographic additives such as couplers. The ballast group is a group having 8 or more carbon atoms and relatively inert to photographic performance, and can be selected from, for example, an alkyl group, an alkoxyl group, a phenyl group, an alkylphenyl group, a phenoxy group and an alkylphenoxy group.

The silver halide adsorption accelerating group may include groups such as a thiourea group, a thiourethane group, a heterocyclic thioamido group, a mercapto heterocyclic group and a triazole group which are disclosed in U.S. Pat. No. 4,385,108.

The H in —NHNH— in Formulas H-c and H-d, that is, the hydrogen atom of the hydrazine may have been substituted with a substituent such as a sulfonyl group as exemplified by methanesulfonyl or toluenesulfonyl, an acyl group as exemplified by acetyl, trifluoroacetyl or ethoxylcarbonyl, an oxalyl group as exemplified by ethoxalyl or pyruvoyl, and the compounds represented by Formula H-c and H-d include such substituted ones.

In the present invention, more preferred compounds are the compound of Formula H-c wherein n is 2 and the compound of Formula H-d.

In the compound of Formula H-c wherein n is 2, preferred is a compound in which $R_1$ and $R_2$ are each a hydrogen atom, an alkyl group, an alkenyl group, an alkynyl group, an aryl group, a saturated or unsaturated heterocyclic group, a hydroxyl group or an alkoxyl group and at least one of $R_1$ and $R_2$ represents an alkenyl group, an alkynyl group, a saturated heterocyclic group, a hydroxyl group or an alkoxyl group.

Typical examples of the compound represented by Formula H are shown below.

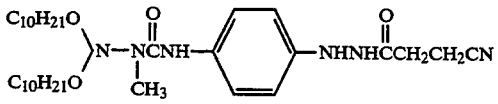

H-1

-continued
H-2
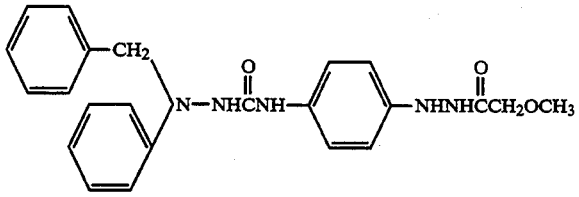
H-3
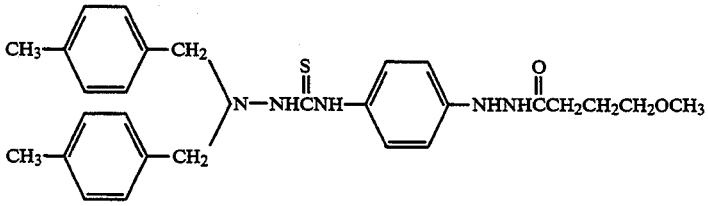
H-4
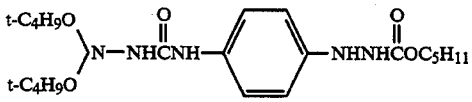
H-5
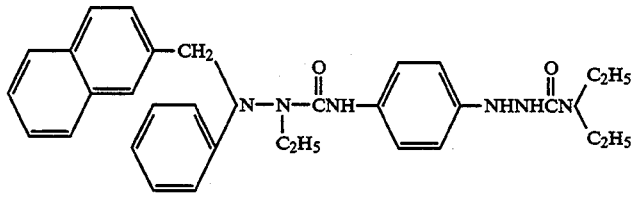
H-6
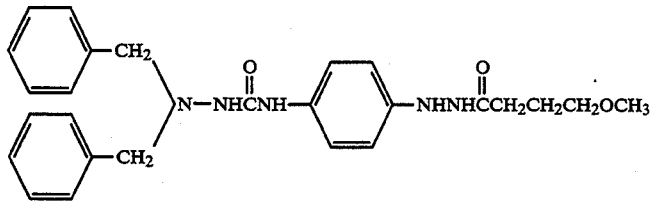
H-7
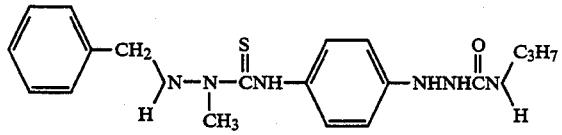
H-8
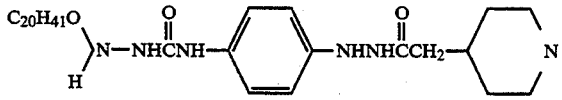
H-9
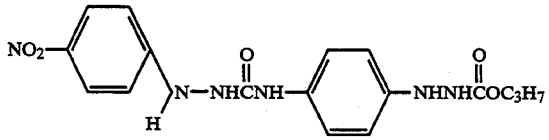
H-10
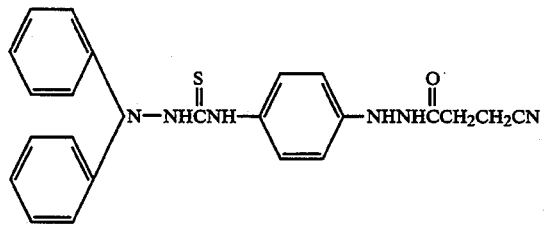

-continued
H-11
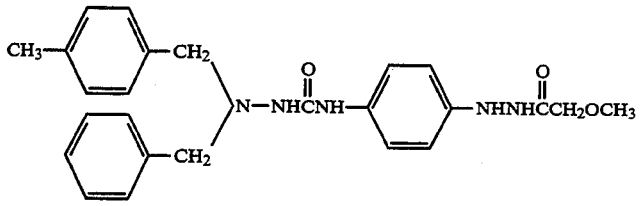
H-12
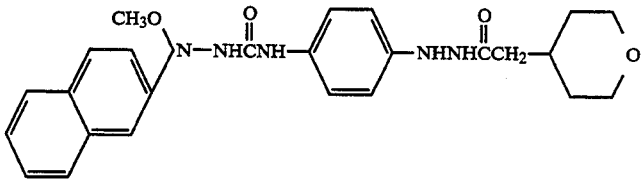
H-13
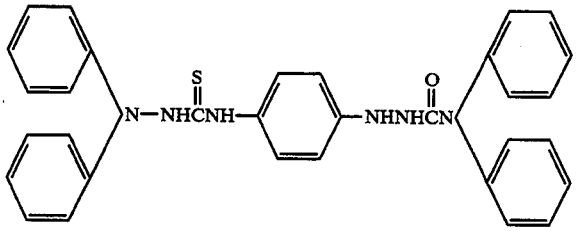
H-14
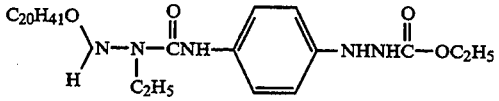
H-15
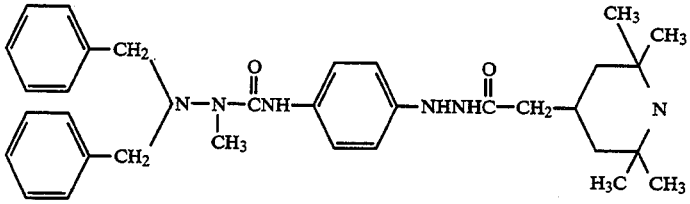
H-16
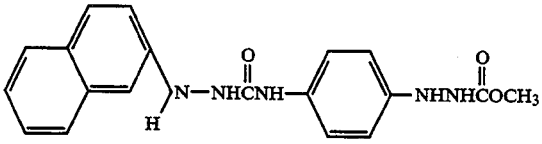
H-17
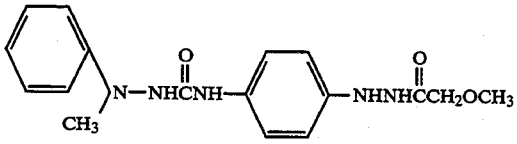
H-18
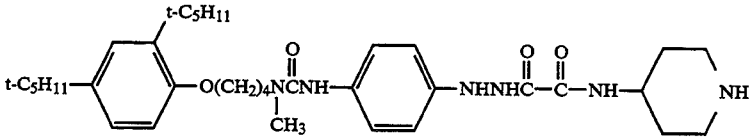
H-19
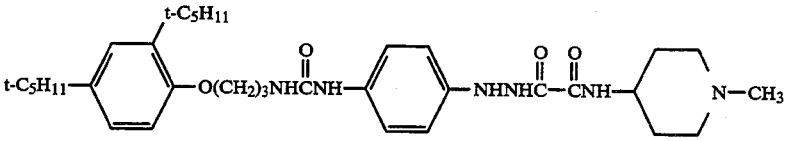

-continued
H-20
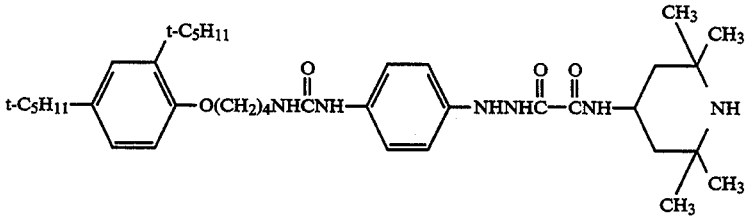
H-21
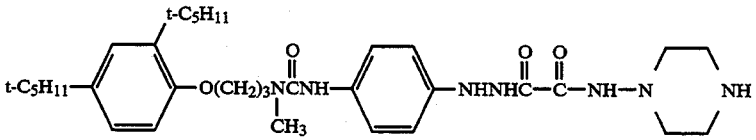
H-22
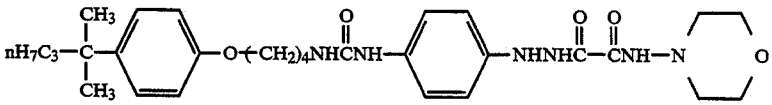
H-23
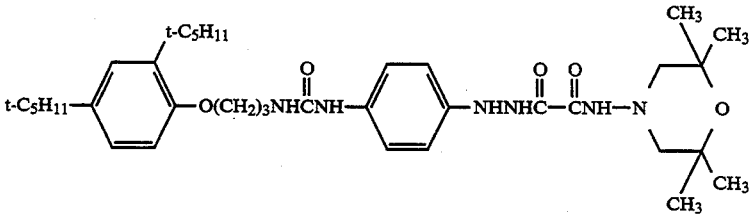
H-24
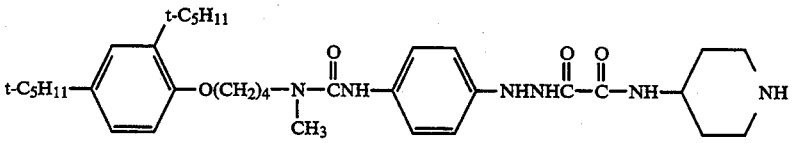
H-25
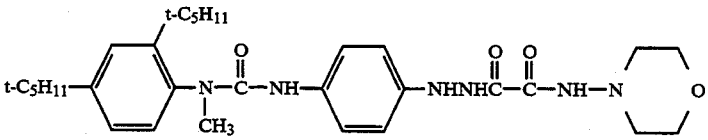
H-26
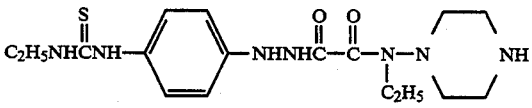
H-27
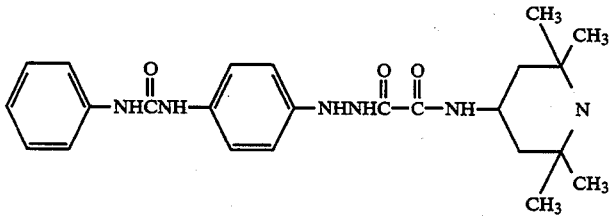
H-28
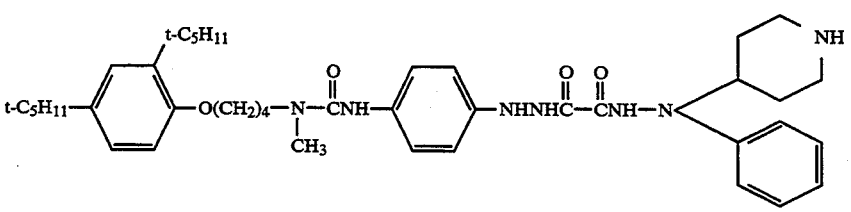

-continued
H-29
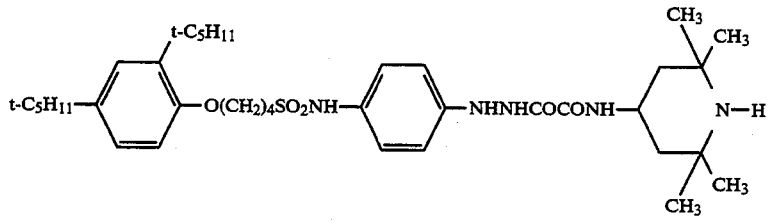
H-30
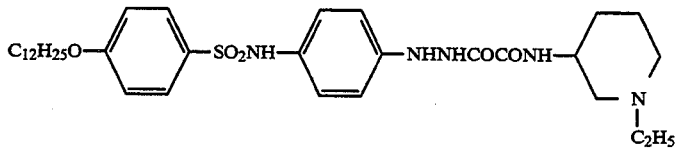
H-31
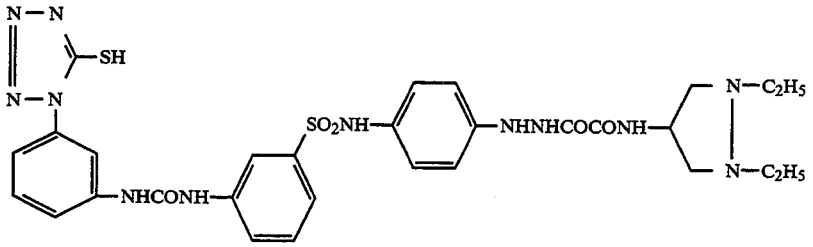
H-32
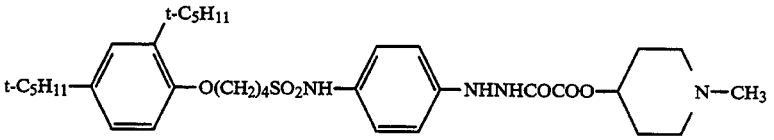
H-33
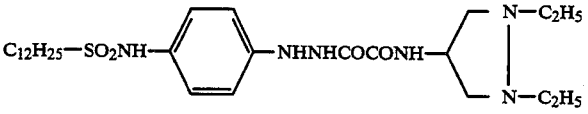
H-34
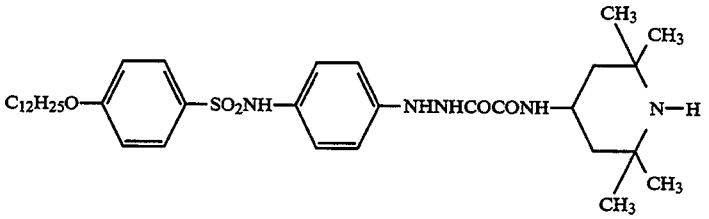
H-35
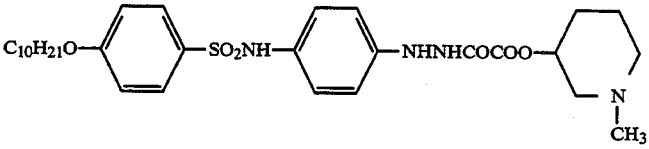
H-36
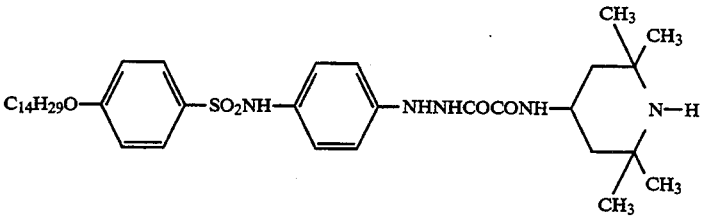

-continued

H-37

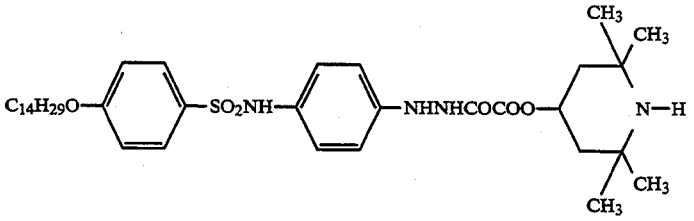

H-38

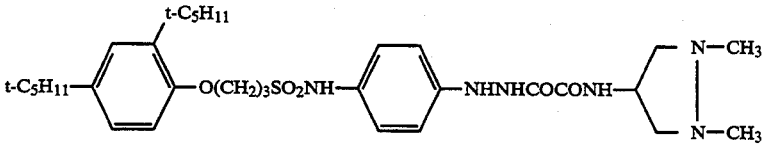

H-39

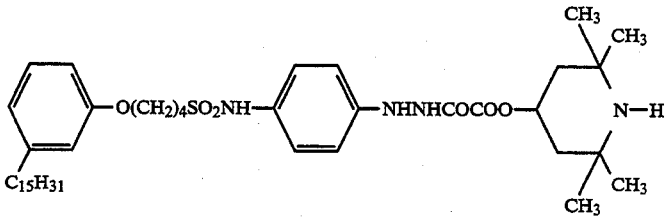

H-40

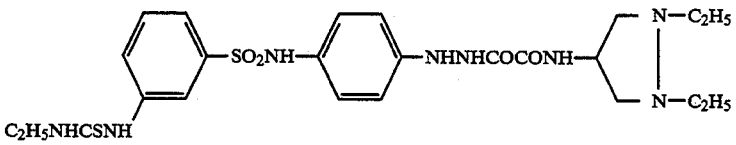

H-41

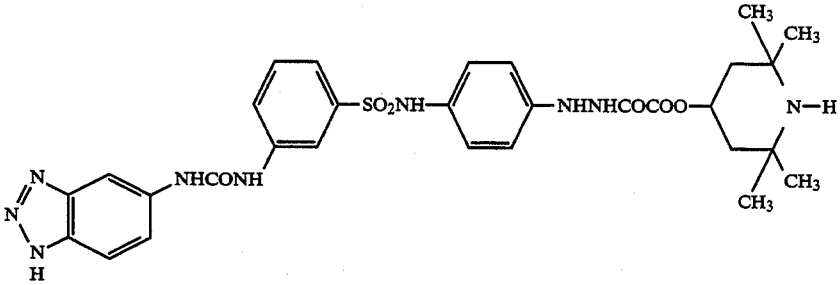

In instances in which the compound of Formula H-c or H-d is contained as a hydrazine derivative, at least one of nucleation accelerating compounds disclosed in Japanese Patent Application No. 234203/1990, page 69, line 1 to page 144, line 12 may preferably be contained in a silver halide emulsion layer and/or a non-sensitive layer provided on the silver halide emulsion layer side of a support.

Typical examples of the nucleation accelerating compounds are shown below.

N-1

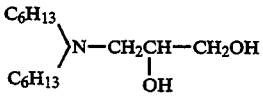

N-2

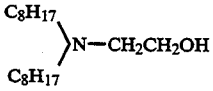

-continued

N-3

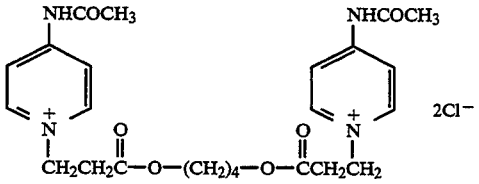

N-4

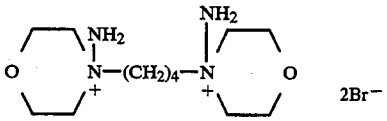

N-5

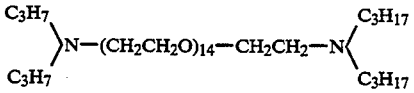

N-6

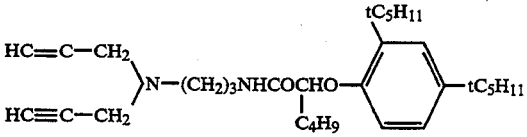

-continued

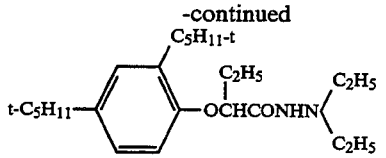

N-7

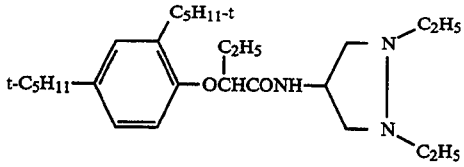

N-8

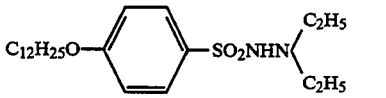

N-9

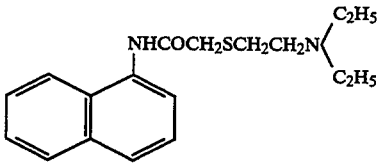

N-10

Other examples besides the foregoing are compounds other than the foregoing typical examples, among compounds I-1 to I-26 disclosed in Japanese Patent Application No. 23420303/1990 at pages 69–72, compounds II-1 to II-29 disclosed therein at pages 73–78, compounds III-1 to III-25 disclosed therein at pages 80–83, compounds IV-1 to IV-41 disclosed therein at pages 84–90, compounds V-I-1 to V-I-27 disclosed therein at pages 92–96, compounds V-II-1 to V-II-30 disclosed therein at pages 98–103, compounds V-III-1 to V-III-35 disclosed therein at pages 105–111, compounds IV-1 to IV-I-44 disclosed therein at pages 113–121, compounds VI-II-1 to VI-II-68 disclosed therein at pages 123–135 and compounds VI-III-1 to VI-III-35 disclosed therein at pages 137–143.

Still other examples are compounds 1 to 61 and 65 to 75 disclosed in Japanese Patent O.P.I. Publication No. 841/1990 at pages 542(4)-546(8).

The hydrazine compound represented by Formula H can be synthesized by the method disclosed in Japanese Patent O.P.I. Publication No. 841/1990 at pages 546(8)-550(12).

The hydrazine compound is added at a position or positions corresponding to a silver halide emulsion layer and/or a layer adjoining thereto. It may preferably be added in an amount of from $1\times10^{-6}$ to $1\times10^{-1}$ per mol of silver, and more preferably from $1\times10^{-5}$ to $1\times10^{-2}$ per mol of silver.

A preferred embodiment of the light-sensitive silver halide photographic material containing the compound represented by Formula T or H and to which the solid processing chemicals of the present invention are applied will be described below.

In the light-sensitive material, light-sensitive silver halide grains with an average grain size of from 0.05 to 0.3 μm are used. Herein the average grain size indicates diameters of the grains when they are spherical, and, when the grains are in the shape other than the spherical, diameters obtained by calculating projected areas thereof as circular images. The grain size distribution of the silver halide grains may preferably be such that 60% or more grains in the whole grain number have a grain size coming within the range of ±10% of their average grain size.

In the silver halide emulsion(s) used in the light-sensitive silver halide photographic material (hereinafter "the silver halide emulsion(s)" or often simply "the emulsion(s)", any of silver bromide, silver iodobromide, silver iodochloride, silver chlorobromide and silver chloride used in conventional silver halide emulsions can be used as silver halides. It is preferable to use silver chlorobromide containing 60 mol % or more of silver chloride as a negative type silver halide emulsion, and silver chloride, silver chlorobromide containing 10 mol % or more of silver bromide, silver bromide, or silver iodobromide as a positive type silver halide emulsion.

The silver halide grains used in the silver halide emulsions may be those obtained by any of the acid method, the neutral method and the ammonia method. The grains may be made to grow at one time, or seed grains may be formed which are thereafter made to grow. The method of forming the seed grains and the method of growing them may be the same or different.

The silver halide emulsions may be prepared by simultaneously mixing halide ions and silver ions, or by mixing one of them into a solution in which the other is present. Alternatively, halide ions and silver ions may be successively simultaneously added while controlling the pH and pAg in the mixed solution, taking account of the critical growth rate of silver halide crystals. This method enables formation of silver halide grains with a regular crystal form end a substantially uniform grain size. After growth, the halogen composition of the grains may be changed by the conversion method.

During the preparation of the silver halide emulsions, if necessary, the grain size, shape of grains, grain size distribution and growth rate of grains can be controlled using a silver halide solvent.

The silver halide solvent may include ammonia, thioether, thiourea, thiourea derivatives such as four-substituted thiourea, and imidazole derivatives. With regard to the thioether, reference may be made to U.S. Pat. No. 3,271,157, No. 3,790,387 and No. 3,574,628.

The silver halide solvent, when comprising a compound other than ammonia, may preferably be used in an amount of from $10^{-3}$ to 1.0% by weight, and preferably from $10^{-2}$ to 10−1% by weight. In the case of ammonia, its amount can be selected arbitrarily.

To the silver halide grains used in the silver halide emulsions, silver ions can be added using at least one selected from a cadmium salt, a sulfite, a lead salt, a thallium salt, an iridium salt (including its complex salt), a rhodium salt (including its complex salt) and an iron salt (including its complex salt), in the course of the formation and/or in the course of the growth of grains. In particular, it is preferable to use a water-soluble rhodium salt. The grains may also be placed in a suitable reducing atmosphere to thereby make it possible to impart reduction sensitizing nuclei to the insides of grains and/or surfaces of grains. In the case when the water-soluble rhodium salt is added, it may preferably be added in an amount of from $1\times10^{-7}$ to $1\times10^{-4}$ mol/mol.AgX.

After the growth of the silver halide emulsions has been completed, unnecessary soluble salts may be removed form the silver halide emulsions, or they may be remain unremoved. When the salts are removed, they can be done according to the method described in Research Disclosure No. 17643.

The silver halide grains used in the silver halide emulsions may be those having a uniform distribution of silver halide composition inside a grain, or may be core/shell grains having a difference in silver halide composition between the interior of a grain and the surface layer thereof.

The silver halide grains used in the silver halide emulsions may be grains in which a latent image is mainly formed on the surface, or grains in which it is mainly formed in the interior of a grain.

The silver halide grains used in the silver halide emulsions may have a regular crystal form as of cubes, octahedrons or tetradecahedrons, or may have an irregular crystal form as of spheres or plates. In these grains, grains having any proportion of {100} plane to {111} plane can be used. The grains may also be those having a composite form of these crystal forms, or those comprised of a mixture of grains with various crystal forms.

As the silver halide emulsions may each be comprised of a mixture of two or more kinds of silver halide emulsions separately formed.

The silver halide emulsions can be chemically sensitized by conventional methods. More specifically, sulfur sensitization, selenium sensitization, reduction sensitizerion, and noble metal sensitizerion making use of gold or other noble metal compound can be used alone or in combination.

The silver halide emulsions may preferably be sensitized using the chemical sensitizers or sensitizing methods as disclosed, for example, in British Patents No. 618,061, No. 1,315,755 and No. 1,396,696, Japanese Patent Examined Publication No.15748/1969, U.S. Pat. No. 1,574,944, No. 1,623,499, No. 1,673,522, No. 2,278,947, No. 2,399,083, No. 2,410,689, No. 2,419,974, No. 2,448,060, No. 2,487,850, No. 2,518,698, No. 2,521,926, No. 2,642,361, No. 2,694,637, No. 2,728,668, No. 2,743,182, No. 2,743,183, No. 2,983,609, No. 2,983,610, No. 3,021,215, No. 3,026,203, No. 3,297,446, No. 3,297,447, No. 3,361,564, No. 3,411,914, No. 3,554,757, No. 3,565,631, No. 3,565,633, No. 3,591,385, No. 3,656,955, No. 3,761,267, No. 3,772,031, No. 3,857,711, No. 3,891,446, No. 3,901,714, No. 3,904,415, No. 3,930,867, No. 3,984,249, No. 4,054,457 and No. 4,067,740, Research Disclosures No. 12008, No. 13452 and No. 13654, and T. H. James, The Theory of the Photographic Process, 4th Ed., Macmillan, 1977, pp.67–76.

The silver halide emulsions used in the light-sensitive material according to the present invention can be spectrally sensitized to the desired wavelength region, using dyes known as spectral sensitizers in the photographic industrial field. The spectral sensitizer may be used alone or in combination of two or more kinds. Together with the spectral sensitizer, a dye having no spectrally sensitizing action in itself or a supersensitizer which is a compound capable of absorbing substantially no visible light and increases the sensitizing action of the spectral sensitizer may be contained in the emulsions.

The spectral sensitizer that can be used may include cyanine dyes, merocyanine dyes, complex cyanine dyes, complex merocyanine dyes, holopolar cyanine dyes, hemicyanine dyes, styryl dyes and hemioxanol dyes.

Particularly useful dyes are cyanine dyes, merocyanine dyes and complex merocyanine dyes. In these dyes, it is possible to apply any nuclei usually used in cyanine dyes as basic heterocyclic nuclei. More specifically, the nuclei include pyrophosphorus nuclei, oxazoline nuclei, pyrrole nuclei, oxazole nuclei, thiazole nuclei, selenazole nuclei, imidazole nuclei, tetrazole nuclei, pyridine nuclei, and nuclei comprising any of these nuclei to which an alicyclic hydrocarbon ring has been fused, as well as nuclei comprising any of these nuclei to which an aromatic hydrocarbon ring has been fused, i.e., indolenine nuclei, benzindolenine nuclei, indole nuclei, benzoxazole nuclei, naphthoxazole nuclei, benzothiazole nuclei, naphtothiazole nuclei, benzoselenazole nuclei, benzimidazole nuclei and quinoline nuclei. These nuclei may be substituted with a carbon atom.

In the merocyanine dyes or complex merocyanine dyes, it is possible to apply as nuclei having a ketomethylene structure, 5- or 6-membered heterocyclic nuclei such as pyrazolin-5-one nuclei, thiohydantoin nuclei, 2-thiooxazolidin-2,4-dione nuclei, thiazolidin-2,4-dione nuclei, rhodanine nuclei and thiobarbituric acid nuclei.

Useful spectral sensitizers used in blue-sensitive silver halide emulsions can be exemplified by those disclosed in German Patent 929,080, U.S. Pat. No. 2,231,658, No. 2,493,748, No. 2,503,776, No. 2,519,001, No. 2,912,329, No. 3,656,959, No. 3,672,897, No. 3,694,217, No. 4,025,349 and No. 4,046,572, British Patent No. 1,242,588, and Japanese Patent Examined Publications No. 14030/1969 and No. 24844/1977. Useful spectral sensitizers used in green-sensitive silver halide emulsions can be typically exemplified by cyanine dyes, merocyanine dyes or complex cyanine dyes as disclosed in U.S. Pat. No. 1,939,201, No. 2,072,908, No. 2,739,149 and No. 2,945,763, and British Patent No. 505,979. Useful spectral sensitizers used in red-sensitive silver halide emulsions can be typically exemplified by cyanine dyes, merocyanine dyes or complex cyanine dyes as disclosed in U.S. Pat. No. 2,269,234, No. 2,270,378, No. 2,442,710, No. 2,454,629 and No. 2,776,280. Besides, cyanine dyes, merocyanine dyes or complex cyanine dyes as disclosed in U.S. Pat. No. 2,213,995, No. 2,493,748 and No. 2,519,001 and German Patent No. 929,080 are also advantageously usable in green-sensitive silver halide emulsions or red-sensitive silver halide emulsions.

Any of these spectral sensitizers may be used alone, or may be used in combination. Spectral sensitizers are often used in combination particularly for the purpose of supersensitization. Typical examples of such combination are disclosed in Japanese Patent Examined Publications No. 4932/1968, No. 4933/1968, No. 4936/1968, No. 32753/1969, No. 25831/1970, No. 26474/1970, No. 11627/1971, No. 18107/1971, No. 8741/1972, No. 11114/1972, No. 25379/1972, No. 37443/1972, No. 28293/1973, No. 38406/1973, No. 38407/1973, No. 38408/1973, No. 41203/1973, No. 41204/1973, No. 6207/1974, No. 40662/1975, No. 12375/1978, No. 34535/1979 and No. 1569/1980, Japanese Patent O.P.I. Publications No. 33220/1975, No. 33828/1975, No. 38526/1975, No. 107127/1976, No. 115820/1976, No. 135528/1976, No. 151527/1976, No. 23931/1977, No. 51932/1977, No. 104916/1977, No. 104917/1977, No. 109925/1977, No. 110618/1977, No. 80118/1979, No. 25728/1981, No. 1483/1982, No. 10753/1983, No. 91445/1983, No. 153926/1983, No. 114533/1984, No. 116645/1984 and No. 116647/1984, and U.S. Pat. No. 2,688,545, No. 2,977,229, No. 3,397,060, No. 3,506,443, No. 3,578,447, No. 3,672,989, No. 3,679,428, No. 3,769,301, No. 3,814,609 and No. 3,837,862.

The dye having no spectrally sensitizing action in itself or compound capable of absorbing substantially no visible light and exhibiting supersensitization, which are used together with the spectral sensitizer include, for example, aromatic organic acid formaldehyde condensates as exemplified by those disclosed in U.S. Pat. No. 3,473,510, cadmium salts, azaindene compounds, and aminostilbene compounds substituted with a nitrogen-containing heterocyclic group as exemplified by those disclosed in U.S. Pat. No. 2,933,390 and No. 3,635,721. Combinations disclosed in U.S. Patents No. 3,615,613, No. 3,615,641, No. 3,617,295 and No. 3,635,721 are particularly useful.

For the purpose of preventing fog in the course of the preparation, storage or photographic processing of light-sensitive materials, a compound known as an antifoggant or stabilizer in the photographic industrial field may be added to the silver halide emulsions during chemical ripening, at the completion of chemical ripening and/or after completion of chemical ripening and before coating of the silver halide emulsions.

The antifoggant or stabilizer includes azaindenes such as pentazaindene as disclosed in U.S. Pat. No. 2,713,541, No. 2,743,180 and No. 2,743,181, tetrazaindenes as disclosed in U.S. Pat. No. 2,716,062, No. 2,444,607, No. 2,444,605, No. 2,756,147, No. 2,835,581 and No. 2,852,375 and Research Disclosure No. 14851, triazaindenes as disclosed in U.S. Pat. No. 2,772,164, and polymerized azaindenes as disclosed in Japanese Patent O.P.I. Publication No. 211142/1982; quaternary onium salts such as thiazoliums as disclosed in U.S. Pat. No. 2,131,038, No. 3,342,596 and No. 3,954,478, pyrylium salts as disclosed in U.S. Pat. No. 3,148,067, and phosphonium salts as disclosed in Japanese Patent Examined Publication No. 40665/1975; mercapto substituted heterocyclic compounds such as mercaptotetrazoles as disclosed in U.S. Pat. No. 2,403,927, No. 3,266,897 and No. 3,708,303 and Japanese Patent O.P.I. Publications No. 135835/1980 and No. 71047/1984, mercaptotriazoles, mercaptodiazoles, mercaptothiazoles as disclosed in U.S. Pat. No. 2,824,001, mercaptobenzthiazoles as disclosed in U.S. Pat. No. 3,937,987, mercaptobenzimidazoles, mercaptooxadiazoles as disclosed in U.S. Pat. No. 2,843,491, and mercaptothiazoles as disclosed in U.S. Pat. No. 3,364,028; hydroxybenzenes such as catechols as disclosed in U.S. Pat. No. 3,236,652 and Japanese Patent Examined Publication No. 10256/1968, resorcins as disclosed in Japanese Patent Examined Publication No. 44413/1981, and gallic esters as disclosed in Japanese Patent Examined Publication No. 4133/1968; azoles such as tetrazoles as disclosed in West German Patent No. 1,189,380, triazoles as disclosed in U.S. Pat. No. 3,157,509, benzotriazoles as disclosed in U.S. Pat. No. 2,704,721, urazoles as disclosed in U.S. Pat. No. 3,287,135, pyrazoles es disclosed in U.S. Pat. No. 3,106,467, indazoles as disclosed in U.S. Pat. No. 2,271,229, and polymerized benzotriazoles as disclosed in Japanese Patent O.P.I. Publication No. 90844/1984; heterocyclic compounds such as pyrimidines as disclosed in U.S. Pat. No. 3,161,515, 3-pyrazolidones as disclosed in U.S. Pat. No. 2,751,297, and polymerized pyrrolidones, i.e., polyvinyl pyrrolidones as disclosed in U.S. Pat. No. 3,021,213; various types of restrainer precursors as disclosed in Japanese Patent O.P.I. Publications No. 30929/1979, No. 137945/1984 and No. 140445/1984, British Patent No. 1,356,142 and U.S. Pat. No. 3,575,699 and No. 3,649,267; sulfinic acids as disclosed in U.S. Pat. No. 3,047,939, and sulfonic derivatives; and inorganic salts as disclosed in U.S. Pat. No. 2,566,263, No. 2,839,405, No. 2,488,709 and No. 2,728,663.

In all hydrophilic colloid layers of the light-sensitive material, various types of photographic additives as exemplified by a gelatin plasticizer, a hardening agent, a surface active agent, an image stabilizer, an ultraviolet absorbent, an antistain agent, a pH adjuster, an antioxidant, an antistatic agent, a thickening agent, a graininess improver, a dye, a mordant, a brightening agent, a development speed regulator and a matting agent may also be optionally added so long as the effect of the present invention is not lost. Of these various additives, what can be preferably used in the present invention are as follows: As the plasticizer, it is possible to preferably use those disclosed, for example, in Japanese Patent O.P.I. Publication No. 63715/1973, British Patent No. 1,239,337 and U.S. Pat. No. 306,470, No. 2,327,808 No. 2,759,821, No. 2,772,166, No. 2,835,582, No.2,860,980, No. 2,865,792, No. 2,904,434, No. 2,960,404, No. 3,003,878, No. 3,033,680, No. 3,173,790, No. 3,287,289, No. 3,361,565, No. 3,397,988, No. 3,412,159, No. 3,520,694, No. 3,520,758, No. 3,615,624, No. 3,635,853, No. 3,640,721, No. 3,656,956, No. 3,692,753 and No. 3,791,857.

As the hardening agent, it is possible to use alone or in combination, hardening agents of an aldehyde type, an azilidine type as exemplified by those disclosed in PB Report 19,921, U.S. Pat. No. 2,950,197, No. 2,964,404, No. 2,983,611 and No. 3,271,175, Japanese Patent Examined Publication No. 40898/1971 and Japanese Patent O.P.I. Publication No. 5071315, an isoxazole type as exemplified by those disclosed in U.S. Pat. No. 331,609, an epoxy type as exemplified by those disclosed in U.S. Pat. No. 3,047,394, West German Patent No. 1,085,663, British Patent No. 1,033,518 and Japanese Patent Examined Publication No. 35495/1973, a vinylsulfone type as exemplified by those disclosed in PB Report 19,920, West German Patents No. 1,100,942, No. 2,337,412, No. 2,545,722, No. 2,635,518, No. 2,742,308 and No. 2,749,260, British Patent No. 1,251,091, Japanese Patent Applications No. 54236/1970 and No. 110996/1973, U.S. Pat. No. 3,539,644 and No. 3,490,911, an acryloyl type as exemplified by those disclosed in Japanese Patent Application No. 27949/1973 and U.S. Pat. No. 3,640,720, a carbodimide type as exemplified by those disclosed in U.S. Pat. No. 2,938,892, No. 4,043,818 and No. 4,061,499, Japanese Patent Examined Publication No. 38715/1971 and Japanese Patent Application No. 15095/1974, a triazine type as exemplified by those disclosed in West German Patents No. 2,410,973 and No. 2,553,915, U.S. Pat. No. 3,325,287 and Japanese Patent O.P.I. Publication No. 12722/1977, and a polymer type as exemplified by those disclosed in British Patent No. 822,061, U.S. Pat. No. 3,623,878, No. 3,396,029 and No. 3,226,234, and Japanese Patent Examined Publications No. 18578/1972, No. 18579/1972 and No. 48896/1972, as well as an maleimide type, an acetylene type, a methanesulfonic ester type and an N-methylol type. Useful combination techniques may include the combinations as disclosed, for example, in West German Patents No. 2,447,587, No. 2,505,746 and No. 2,514,245, U.S. Pat. No. 4,047,957, No. 3,832,182 and No. 3,840,370, Japanese Patent O.P.I. Publications No. 43319/1973, No. 63062/1975 and No. 127329/1977 and Japanese Patent Examined Publication No. 32364/1977.

The ultraviolet absorbent that can be used includes benzophenone compounds as exemplified by those disclosed in Japanese Patent O.P.I. Publication No. 2784/1971 and U.S. Pat. No. 3,215,530 and No. 3,698,907, butadiene compounds as disclosed in U.S.

Pat. No. 4,045,229, and cinnamic ester compounds as disclosed in U.S. Pat. No. 3,705,805 and No. 3,707,375 and Japanese Patent O.P.I. Publication No. 49029/1977. Those disclosed in U.S. Pat. No. 3,499,762 and Japanese Patent O.P.I. Publication No. 48535/1979 can also be used. Ultraviolet absorptive couplers as exemplified by α-naphthol type cyan dye forming couplers or ultraviolet absorptive polymers as exemplified by those disclosed in Japanese Patent O.P.I. Publications No. 111942/1983, No. 178351/1983, No. 181041/1983, No. 19945/1984 and No. 23344/1984 can be used. These ultraviolet absorbents may be mordanted for specific layers.

The optical brightening agent includes optical brightening agents of a stilbene type, a tirazine type, a pyrazoline type, a cumarine type or an acetylene type, which can be preferably used.

These compounds may be water-soluble, or water-insoluble compounds may be used in the form of dispersants.

As anionic surface active agents, preferable agents are those containing an acidic group such as a carboxyl group, a sulfo group, a phospho group, a sulfuric ester group or a phosphoric ester group, as exemplified by alkylcarboxylates, alkylsulfonates, alkylbenzene-sulfonates, alkylnaphthalenesenesulfonates, alkylsulfuric esters, alkylphosphoric esters, N-acyl-alkyltaurines, sulfosuccinic esters, sulfoalkylpolyoxyethylene alkyl phenyl esters and polyoxyethylene alkylphosphoric esters.

As amphoteric surface active agents, preferable agents include, for example, amino acids, aminoalkylsulfonic acids, aminoalkylsulfuric or phosphoric esters, alkylbetaines and amine oxides.

As cationic surface active agents, preferable agents include, for example, alkylamine salts, aliphatic or aromatic quaternary ammonium salts, heterocyclic quaternary ammonium salts such as pyridinium or imidazolium compounds, and phosphonium or sulfonium salts containing an aromatic or heterocyclic ring.

As nonionic surface active agents, preferable agents include, for example, saponin (asteroid type), alkylene oxide derivatives as exemplified by polyethylene glycol, a polyethylene glycol-polypropylene glycol condensate, polyethylene glycol alkyl ethers or polyethylene glycol alkylaryl ethers, polyethylene glycol esters, polyethylene glycol sorbitan esters, polyalkylene glycol alkylamines or -amides and polyethylene oxide addition products of silicone, glycidol derivatives as exemplified by alkenylsuccinic acid polyglyceride and alkylphenol polyglyceride, fatty acid esters of polyhydric alcohols, and alkyl esters of saccharides.

The matting agent includes organic matting agents as disclosed in British Patent No. 1,055,713 and U.S. Pat. No. 1,939,213, No. 2,221,873, No. 2,268,662, No. 2,332,037, No. 2,376,005, No. 2,391,181, No. 2,701,245, No. 2,922,101, No. 3,079,257, No. 3,262,782, No. 3,516,832, No. 3,539,344, No. 3,591,379, No. 3,754,924 and No. 3,767,448, and inorganic matting agents as disclosed in West German Patent No. 2,592,321, British Patents No. 760,775, U.S. Pat. No. 1,260,772, No. 1,201,905, No. 2,192,241, No.3,053,662, No. 3,257,206, No. 3,322,555, No. 3,353,958, No. 3,370,951, No. 3,411,907, No. 3,437,484, No. 3,523,022, No. 3,615,554, No. 3,635,714, No. 3,769,020, No. 4,021,245 and No. 4,029,504, which can be preferably used.

The antistatic agent includes the compounds as disclosed in British Patent No. 1,466,600, Research Disclosures No. 15840, No. 16258 and No. 16630 and U.S. Pat. No. 2,327,828, No. 2,861,056, No. 3,206,312, No. 3,245,833, No. 3,428,451, No. 3,775,126, No. 3,963,498, No. 4,025,342, No. 4,025,463, No. 4,025,691 and No. 4,025,704.

What is particularly preferred as an embodiment of the present invention is to use a tetrazolium compound, polyethylene oxide derivative, a phosphorus quaternary salt compound or a hydrazine compound as a tone control agent that promotes contrast increase as disclosed in Japanese Patent O.P.I. Publications No. 210458/1987 and No. 139546/1987.

The light-sensitive material according to the present invention may contain a polymer latex. The polymer latex that can be incorporated in the light-sensitive material may preferably include hydrates of a vinyl polymer such as acrylate, methacrylate or styrane, as exemplified by those disclosed in U.S. Pat. No. 2,772,166, No. 3,325,286, No. 3,411,911, No. 3,311,912 and No. 3,525,620 and Research Disclosure No. 195 19551 (July, 1980).

Preferably usable polymer latex may include homopolymers of an alkyl methacrylate such as methyl methacrylate or ethyl methacrylate, homopolymers of styrene, copolymers of an alkyl methacrylate or styrene with acrylic acid, N-methylolacrylamide or glycidol methacrylate, homopolymers of methyl acrylate, ethyl acrylate or butyl acrylate or copolymers of an alkyl acrylate with acrylic acid or N-methylolacrylamide (the copolymer component such as acrylic acid should preferably be not more than 30% by weight), homopolymers of butadiene or copolymers of butadiene with at least one of styrene and butoxymethylacrylamide acrylic acid, and a vinylidene chloride-methyl acrylate-acrylic acid tarpolymer. The polymer latex may preferably have an average particle diameter in the range of from 0.005 to 1 μm, and particularly preferably from 0.2 to 0.1 μm.

The polymer latex may be contained in a layer on only one side of a support, or may be contained in layers on both sides thereof. It is preferred for the polymer latex to be contained in layers on both sides. In the case when it is contained in layers on both sides of a support, the types and/or amounts of the polymer latex contained in either side may be the same or different.

The polymer latex may be added to any layers. For example, when it is contained in a layer on a support at its side on which a light-sensitive silver halide layer is provided, the polymer latex may be contained in the light-sensitive silver halide layer or in an outermost layer non-sensitive colloid layer usually called a protective layer. Of course, when other layer as exemplified by an intermediate layer is present between the light-sensitive silver halide layer and the outermost layer, it may be contained in the intermediate layer. On the side on which a plurality of layers are provided, the polymer latex may be contained in any single layer, or may be contained in a plurality of layers (not necessarily two layers) comprised of any desired combination.

Gelatin is used as a binder for the light-sensitive material used in the present invention. The gelatin may include gelatin derivatives, and may be used in combination with a cellulose derivative, a graft polymer of gelatin with other high polymer, or other hydrophilic colloid such as protein, a sugar derivative, a cellulose derivative or a homo- or copolymer synthetic hydrophilic polymeric material.

As the gelatin, rime-treated gelatin as well as acid-treated gelatin or enzyme-treated gelatin as described in Bull. Soc. Phot. Japan, No. 16, p.30 (1966) may be used. Hydrolysates or enzymolysates of gelatin can also be used.

The gelatin derivatives include those obtained by reacting gelatin with any of various compounds as exemplified by acid halides, acid anhydrides, isocyanates, bromoacetic acid, alkanesultones, vinyl sulfonamides, maleimide compounds, polyalkylene oxides and epoxydated compounds, any of which can be used. Examples thereof are disclosed in U.S. Pat. No. 2,614,928, No. 3,132,945, No. 3,186,845 and No. 3,312,553, British Patents No. 861,414, No. 1,033,189 and No. 1,005,784 and Japanese Patent Examined Publication No. 26845/1967.

The protein includes albumin and casein, the cellulose derivatives include hydroxyethyl cellulose, carboxymethyl cellulose and sulfuric acid esters of cellulose, and the sugar derivatives include potassium alginate and starch derivatives, which may be used in combination with the gelatin.

The graft polymer of gelatin with other high polymer includes graft polymers of gelatin with a homo- or copolymer of acrylic acid, mathacrylic acid, an ester or amide derivative thereof or a vinyl monomer such as acrylonitrile or styrene. In particular, graft polymers of gelatin with a polymer having a certain compatibility therewith as exemplified by a polymer of acrylic acid, acrylamide, methacrylamide or hydroxyalkyl methacrylate are preferred. Examples thereof are disclosed in U.S. Pat. No. 2,763,625, No. 2,831,767 and No. 2,956,884.

With regard to the amount of gelatin to be coated, when no polymer latex layer Other than a subbing layer is provided on the corresponding side of the light-sensitive material, the gelatin may preferably be coated in an amount of from 1.0 g/m$^2$ to 5.5 g/m$^2$ and particularly preferably from 1.3 g/m$^2$ to 4.8 g/m$^2$ per one side of a support.

On account of a recent demand for rapid processing, various researches are also made on techniques for decreasing the quantity of gelatin and preventing the silver sludge accompanying it. In particular, there is a method of incorporating a polymer latex stabilized with gelatin, in at least one non-sensitive hydrophilic colloidal layer. For example, gelatin is used from the beginning of the synthesis of latex so that it is used in the protective layer.

More specifically, a conventional latex is aqueous-dispersed using a surface active agent. The latex that can be used in the present invention, on the other hand, is characterized by a polymer latex whose surface and/or inside has or have been dispersion-stabilized with gelatin. The polymer constituting the latex may have any linkage to the gelatin. In this instance, the polymer and gelatin may be directly linked, or may be linked through a cross-linking agent. For this purpose, the monomers constituting the latex should contain those having a reactive group such as a carboxyl group, an amino group, an amido group, an epoxy group, a hydroxyl group, an aldehyde group, an oxazoline group, an ether group, an ester group, a methylol group, a cyano group, an acetyl group or an unsaturated carbon bond. In the case when the cross-linking agent is used, conventional agents used as cross-linking agents for gelatin can be used. For example, it is possible to use a cross-linking agent of an aldehyde type, a glycol type, a triazine type, an epoxy type, a vinylsulfone type, an oxazoline type, a methacrylic type or an acrylic type.

The polymer latex can be obtained by a method in which, after polymerization reaction of polymer latex has been completed, a gelatin solution is added in the reaction system to carry out reaction. It is preferred that a polymer latex synthesized in a surface active agent is allowed to react with gelatin in the presence of the cross-linking agent. Alternatively, the gelatin may be made present in the course of the polymerization reaction of a polymer. This method also gives preferable results. In this instance, no surface active agent should preferably be used in the course of the polymerization reaction of a polymer. When, however, the surface active agent is used, it may preferably be added in an amount of from 0.1 to 3%, and particularly preferably from 0.1 to 1.5%, based on the polymer component. In the synthesis, the polymer and the latex may preferably be in a proportion of gelatin/polymer=1/100 to 2/1, and particularly preferably 1/50 to 1/2.

The latex may be so added as to be in an amount of 30% or more based on the gelatin, and particularly preferably from 30 to 200%. The latex may be in an amount of from 50 mg/m$^2$ to 5 mg/m$^2$ and preferably from 100 mg/m$^2$ to 2.5 mg/m$^2$.

Examples of preferable monomers are shown below. The latex may be comprised of any combination (types, compositional ratios) of these monomers. Examples are by no means limited to these monomers.

For the purpose of antistatic, the light-sensitive silver halide photographic material may have at least one antistatic layer on the side of backing and/or the side of emulsion layers on a support. In this instance, the surface resistivity on the side on which the antistatic layer is provided may preferably be not higher than $1.0\times10^{12}\,\Omega$, and particularly preferably not higher than $8.0\times10^{12}$ 106 , at 25° C. and 50%RH. The antistatic layer may preferably be an antistatic layer containing a reaction product of a water-soluble conductive polymer, hydrophobic polymer particles and a hardening agent or an antistatic layer containing a metal oxide.

The water-soluble conductive polymer may include polymers having at least one conductive group selected from a sulfonic acid group, a sulfuric acid ester group, a quaternary ammonium salt group, a tertiary ammonium salt group, a carboxyl group and a polyethylene oxide group. Of these groups, the sulfonic acid group, sulfuric acid ester group and quaternary ammonium salt group are preferred. The conductive group must be in an amount of 5% by weight per molecule of the water-soluble conductive polymer.

In the water-soluble conductive polymer, a carboxyl group, a hydroxyl group, an amino group, an epoxy group, an aziridine group, an active methylene group, a sulfinic acid group, an aldehyde group or a vinyl sulfone group is contained. Of these, the carboxyl group, hydroxyl group, amino group, epoxy group, aziridine group or aldehyde group may preferably be contained. Any of these groups must be contained in an amount of not less than 5% by weight per molecule of the polymer. The water-soluble conductive polymer may have a number average molecular weight of from 3,000 to 100,000, and preferably from 3,500 to 50,000.

The metal oxide includes tin oxide, indium oxide, antimony oxide, vanadium oxide, zinc oxide, or any of these metal oxides doped with metal silver, metal phosphorus or metal indium. These metal oxides may preferably have an average particle diameter of from 1 to 0.01 μm.

The support used in the light-sensitive material of the present invention may include paper laminated with α-olefin polymer as exemplified by a polyethylene-butene copolymer, flexible reflective supports made of synthetic paper or the like, films comprised of a semi-synthetic or synthetic polymer such as cellulose acetate, cellulose nitrate, polystyrene, polyvinyl chloride, polyethylene terephthalate, polycarbonate or polyamide.

The subbing layer may include subbing layers formed using an organic solvent system containing a polyhydroxybenzen, as disclosed in Japanese Patent O.P.I. Publication No. 3972/1974, and subbing layer formed using an aqueous latex, as disclosed in Japanese Patent O.P.I. Publications No. 11118/1974, No. 104913/1977, No. 19941/1984, No. 19940/1984, No. 18945/1984, No. 112326/1976, No. 11761/1976, No. 58469/1976, No. 114120/1976, No. 121323/1976, No. 123139/1976, No. 114121/1976, No. 139320/1977, No. 65422/1977, No. 109923/1977, No. 119919/1977, No. 65949/1980, No. 128332/1982 and No. 19941/1984.

The subbing layer can usually be chemically or physically treated on its surface. Such treatment may include surface-activating treatment such as treatment with chemicals, mechanical treatment, corona discharge treatment, flame treatment, ultraviolet treatment, high frequency treatment, Glow discharge treatment, activated plasma treatment, laser treatment, mixed acid treatment or ozone oxidation treatment.

There are no particular limitations on the time or conditions at or under which the subbing layer is formed.

In the light-sensitive silver halide photographic material, dyes may be used as filter dyes or for the purpose of anti-halation and other various purposes. The dyes used include triellyl dyes, oxanol dyes, hemioxanol dyes, merocyanine dyes, cyanine dyes, styryl dyes and azo dyes. Of these, the oxanol dyes, hemioxanol dyes and merocyanine dyes are useful. Examples of the dyes used are those disclosed in West German Patent No. 616,007, British Patents No. 584,609 and No. 1,177,429, Japanese Patent Examined Publications No. 7777/1950, No. 22069/1964 and No. 38129/1979, Japanese Patent O.P.I. Publications No. 85130/1973, No. 99620/1974, No. 11442/1974, No. 129537/1974, No. 28827/1975, NO. 108115/1977, No. 185038/1982 and No. 24845/1984, U.S. Pat. No. 1,878,961, No. 1,884,035, No. 1,912,797, No. 2,098,891, No. 2,150,695, No. 2,274,782, No. 2,298,731, No. 2,409,612, No. 2,461,484, No. 2,527,583, No. 2,533,472, No. 2,865,752, No. 2,956,879, No. 3,094,418, No. 3,125,448, No. 3,148,187, No. 3,177,078, No. 3,247,127, No. 3,260,601, No. 3,282,699, No. 3,409,433, No. 3,540,887, No. 3,575,704, No. 3,653,905, No. 3,718,472, No. 3,865,817, No. 4,070,352 and No. 4,071,312, PB Report 74175 and Photographic Abstract 1 28 ('21). In particular, in the case of daylight room contact light-sensitive materials, it is preferable to use these dyes, and is particularly preferably to use them so that a sensitivity to light of 400 nm can be 30 times or more the sensitivity of light of 360 nm.

An organic desensitizer that is positive in the sum of anode potential and cathode potential of a polarograph as disclosed in Japanese Patent O.P.I. Publication No. 26041/1986 may be further used.

The light-sensitive silver halide photographic material of the present invention can be exposed to light using electromagnetic waves having a spectrum region in which the emulsion layers constituting the light-sensitive material have sensitivity. Light sources thereof include known light sources such as natural light (sunlight), a tungsten lamp, a fluorescent lamp, an iodine quartz lamp, a mercury lamp, a microwave emitting UV lamp, a xenon arc lamp, a carbon arc lamp, a xenon flash lamp, a cathode ray tube flying spot, all sorts of laser light, light from a light-emitting diode, and light emitted from a phosphor excited with electron rays, X-rays, γ-rays, α-rays or the like, any of which can be used. An absorbing filter capable of absorbing a wavelength of 370 nm or less may be fitted to the UV light source as disclosed in Japanese Patent O.P.I. Publication No. 210458/1987, or an UV light source having a light-emitting wavelength of 370 to 420 nm as main wavelength may be used, making it possible to obtain preferable results.

Exposure may be carried out of course in the exposure time of 1 millisecond to 1 second as used in ordinary cameras, as well as in an exposure time shorter than 1 microsecond, for example, an exposure time of 100 nanoseconds to 1 microsecond using a cathode ray tube or a xenon flash lamp. It is also possible to give exposure longer than 1 second. Such exposure may be carried out continuously or intermittently.

The solid processing chemicals of the present invention can be preferably applied to developing solutions, fixing solutions and other processing solutions for various light-sensitive silver halide black and white photographic materials containing the compound represented by Formula T or H previously described, used for print photography, X-ray photography, general-purpose negatives, general-purpose reversals, general-purpose positives, direct positives and so forth.

EXAMPLES

The present invention will be described below in greater detail by giving Examples. The present invention is by no means limited by these Examples.

EXAMPLE 1

The following color developing chemicals for color papers were thoroughly mixed, and formed into powdered processing chemicals for a 10 liter developing solution. From the powdered processing chemicals, 80 tablets were produced using a tableting machine by the common method as described above in this specification.

| Powdered processing chemicals for 10 liter developing solution; color developing chemicals | |
|---|---|
| Potassium bromide | 0.2 g |
| Potassium chloride | 33 g |
| Potassium carbonate | 250 g |
| Potassium sulfite | 2 g |
| Sodium diethylenetriaminepentaacetate | 30 g |
| 4-Amino-3-methyl-N-ethyl-N-(methanesulfonamidoethyl) aniline sulfate SFP (CD-3) | 48 g |
| TINOPAL SFP (trade name; Ciba-Geigy Corp.) | 30 g |
| Sodium hydrogencarbonate | 31 g |
| Diethylhydroxylamine sulfate (liquid) | 70 g |
| Cyclodextrin, branched cyclodextrin or cyclodextrin polymer (as shown in Table 1) | in an amount as shown in Table 4 |

Observations on whether or not cracking occurred during the tableting were as shown in Table 1. After the tableting, the tablets were put in a polyethylene bag, which was then sealed and stored for a month in an autoclave under conditions of 30° C. and 60%RH and further under $O_2$ pressure of 2 kg/cm$^2$. Thereafter the tables were dissolved using a chemical mixer to carry out photographic processing.

The bag was cut with a cutter and the tablets were put into water to dissolve them, where their dissolving speed was observed. After the photographic processing, the reflection blue maximum density Dmax (Y) of color paper samples was measured.

A portion of 1 liter of the color developing solution obtained after dissolution was taken out and put in a container with an open top area of 10 $cm^2$, made of hard vinyl chloride. This developing solution was stored at 30° C. for a month, and thereafter observed to examine whether or not any deposition of crystals occurred at the boundary where the container wall came in contact with the surface of the developing solution inside the container.

Results obtained are shown together in Table 1.

The color paper samples were prepared and processed according to the methods shown below.

Color Paper

Layers with the following constitution were provided on a paper support to one side of which polyethylene was laminated and to the other side of which, the first layer side, polyethylene containing titanium oxide was laminated. Color papers were thus produced. Coating solutions were prepared in the following way.

First-Layer Coating Solution

In 0.67 g of high-boiling solvent (DNP), 26.7 g of of yellow coupler Y-1, 10 g and 6.67 g of dye-image stabilizing agents ST-1 and ST-2, respectively, and 0.67 g of additive HQ-1 were dissolved with addition of 60 ml of ethyl acetate. The resulting solution was emulsifyingly dispersed in 220 ml of aqueous 10% gelatin solution containing 7 ml of surface active agent SU-1, using an ultrasonic homogenizer, to produce a yellow coupler dispersion. This dispersion was mixed with a blue-sensitive silver halide emulsion (containing 10 g of silver) produced under conditions as shown later. A first-layer coating solution was thus prepared.

Second- to seventh-layer coating solutions were also prepared in the manner similar to the above first-layer coating solution.

A hardening agent H-1 was also added to the second layer and the fourth layer each, and H-2, to the seventh layer. As coating aids, surface active agents SU-2 and SU-3 were added to adjust surface tension.

| Layer | Constitution | Amount ($g/m^2$) |
|---|---|---|
| Seventh layer: (Protective layer) | Gelatin | 1.00 |
| Sixth layer: (Ultraviolet absorbing layer) | Gelatin | 0.40 |
| | Ultraviolet absorbent UV-1 | 0.10 |
| | Ultraviolet absorbent UV-2 | 0.04 |
| | Ultraviolet absorbent UV-3 | 0.16 |
| | Anti-stain agent HQ-1 | 0.01 |
| | DNP | 0.2 |
| | PVP | 0.03 |
| | Anti-irradiation dye AI-2 | 0.02 |
| Fifth layer: (Red-sensitive layer) | Gelatin | 1.30 |
| | Red-sensitive silver bromide emulsion Em-R in terms of silver, | 0.21 |
| | Cyan coupler C-1 | 0.17 |
| | Cyan coupler C-2 | 0.25 |
| | Dye image stabilizer ST-1 | 0.20 |
| | Anti-stain agent HQ-1 | 0.01 |
| | HBS-1 | 0.20 |
| | DOP | 0.20 |
| Fourth layer: (Ultraviolet absorbing layer) | Gelatin | 0.94 |
| | Ultraviolet absorbent UV-1 | 0.28 |
| | Ultraviolet absorbent UV-2 | 0.09 |
| | Ultraviolet absorbent UV-3 | 0.38 |
| | Anti-stain agent HQ-1 | 0.03 |
| | DNP | 0.40 |
| Third layer: (Green-sensitive layer) | Gelatin | 1.40 |
| | Green-sensitive silver bromide emulsion Em-G in terms of silver, | 0.17 |
| | Magenta coupler M-1 | 0.35 |
| | Dye image stabilizer ST-3 | 0.15 |
| | Dye image stabilizer ST-4 | 0.15 |
| | Dye image stabilizer ST-5 | 0.15 |
| | DNP | 0.20 |
| | Anti-irradiation dye AI-1 | 0.01 |
| Second layer: (Intermediate layer) | Gelatin | 1.20 |
| | Anti-stain agent HQ-2 | 0.12 |
| | DIDP | 0.15 |
| First layer: (Blue-sensitive layer) | Gelatin | 1.20 |
| | Blue-sensitive silver bromide emulsion EmA in terms of silver, | 0.26 |
| | Yellow coupler Y-1 | 0.80 |
| | Dye image stabilizer ST-1 | 0.30 |
| | Dye image stabilizer ST-2 | 0.20 |
| | Anti-stain agent HQ-1 | 0.02 |
| | Anti-irradiation dye AI-3 | 0.01 |
| | DNP | 0.20 |
| Support | Polyethylene-laminated paper | |

Y-1

-continued
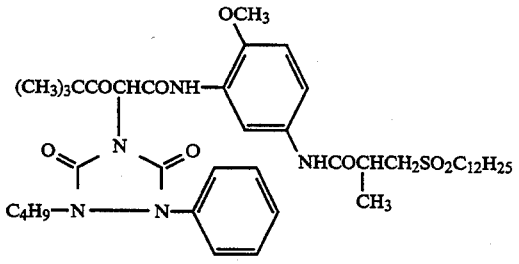
M-1
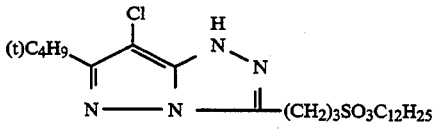
C-1
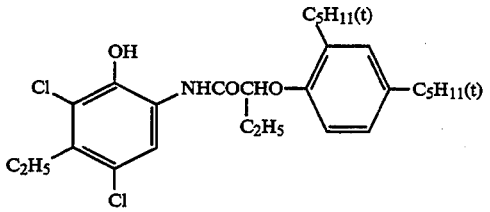
C-2
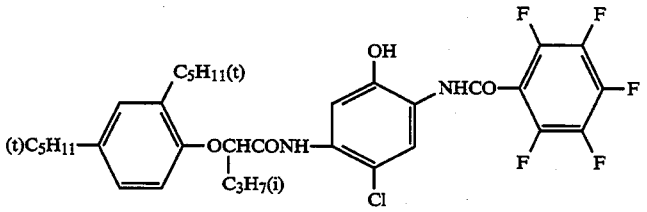
ST-1
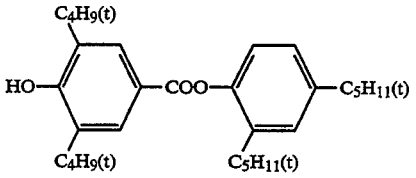
ST-2
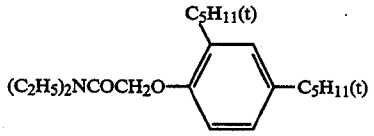
ST-3
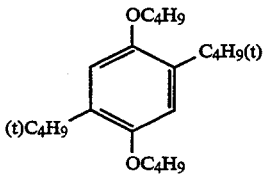
ST-4

-continued
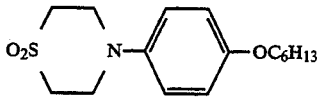
ST-5
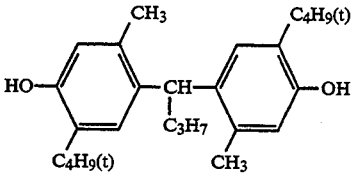
UV-1
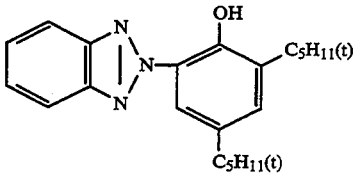
UV-2
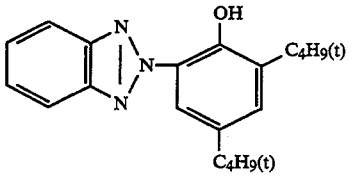
UV-3
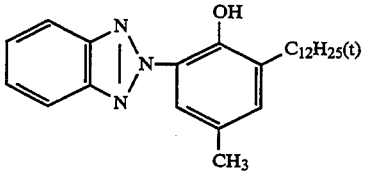
DOP: Dioctylphthalate
DNP: Dinonylphthalate
DIDP: Diisodecylphthalate
PVP: Polyvinyl pyrrolidone
HQ-1
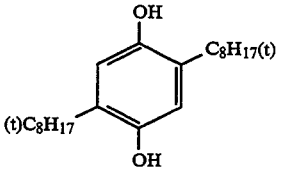
HQ-2
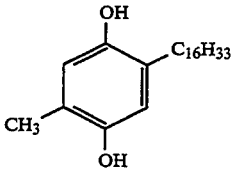
HBS-1

-continued
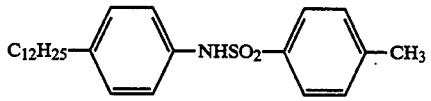
AI-1
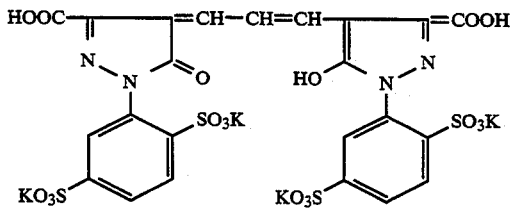
AI-2
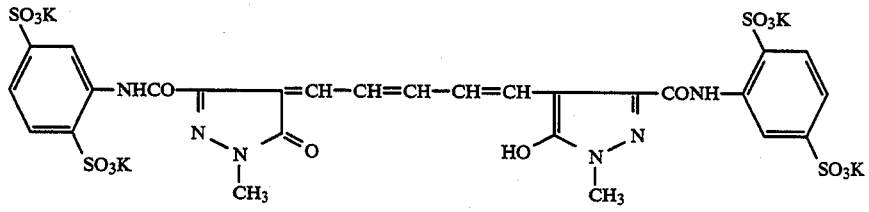
AI-3
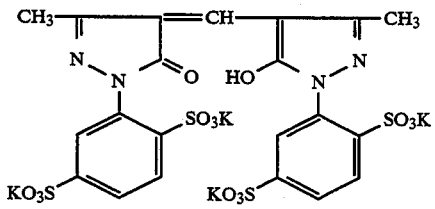
SU-1
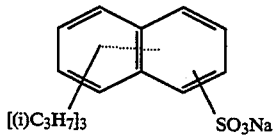
SU-2
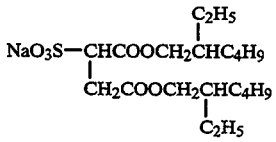
SU-3
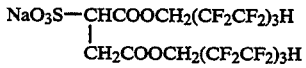
H-1
$(CH_2{=}CHSO_2CH_2)_4C$
H-2
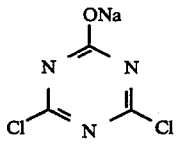

Preparation of Blue-Sensitive Silver Halide emulsion

In 1,000 ml of an aqueous 2% gelatin solution kept at a temperature of 40° C., the following solution A and solution B were simultaneously added in 30 minutes while controlling the pAg and pH to be 6.5 and 3.0, respectively, and the following solution C and solution D were further simultaneously added over a period of 180 minutes while controlling the pAg and pH to be 7.3 and 5.5, respectively. At this time, the pAg was controlled by the method disclosed in Japanese Patent O.P.I. Publication No. 45437/1984 and the pH was controlled using an aqueous solution of sulfuric acid or sodium hydroxide.

| | |
|---|---|
| Solution A: | |
| Sodium chloride | 3.42 g |
| Potassium bromide | 0.03 g |
| By adding water, made up to | 200 ml |
| Solution B: | |
| Silver nitrate | 10 g |
| By adding water, made up to | 200 ml |
| Solution C: | |
| Sodium chloride | 102.7 g |
| Potassium bromide | 1.0 g |
| By adding water, made up to | 600 ml |
| Solution D: | |
| Silver nitrate | 300 g |
| By adding water, made up to | 600 ml |

After completion of the addition, the emulsion was desalted using an aqueous 5% solution of Demol-N, produced by Kao Atlas Co. and an aqueous 20% solution of magnesium sulfate, and then mixed with an aqueous gelatin solution to give a monodisperse cubic emulsion EMP-1 having an average grain size of 0.85 μm, a variation coefficient of 0.07 and a silver chloride content of 99.5 mol %.

The above emulsion EMP-1 was subjected to chemical sensitization at 50° C. for 90 minutes using the following compounds to give a blue-sensitive silver halide emulsion Em-B.

Sodium thiosulfate 0.8 mg/mol.AgX
Chloroauric acid 0.5 mg/mol.AgX
Stabilizer STAB-1 $6\times10^{-4}$ mg/mol.AgX
Spectral sensitizer BS-1 $4\times10^{-4}$ mg/mol.AgX
Spectral sensitizer BS-2 $1\times10^{-4}$ mg/mol.AgX Preparation of Green-Sensitive Silver Halide emulsion The same procedure for the preparation of EMP-1 was repeated except that the addition time of the solutions A and B and the addition time of the solutions C and D were changed, to give a monodisperse cubic emulsion EMP-2 having an average grain size of 0.43 μm, a variation coefficient of 0.08 and a silver chloride content of 99.5 mol %.

The emulsion EMP-2 was subjected to chemical sensitization at 65° C. for 120 minutes using the following compounds to give a green-sensitive silver halide emulsion Em-G.

Sodium thiosulfate 1.5 mg/mol.AgX
Chloroauric acid 1.0 mg/mol.AgX
Stabilizer STAB-1 $6\times10^{-4}$ mg/mol.AgX
Spectral sensitizer GS-2 $4\times10^{-4}$ mg/mol.AgX Preparation of Red-Sensitive Silver Halide Emulsion The same procedure for the preparation of EMP-1 was repeated except that the addition time of the solutions A and B and the addition time of the solutions C and D were changed, to give a monodisperse cubic emulsion EMP-3 having an average grain size of 0.50 μm, a variation coefficient of 0.08 and a silver chloride content of 99.5 mol %.

The emulsion EMP-3 was subjected to chemical sensitization at 60° C. for 90 minutes using the following compounds to give a red-sensitive silver halide emulsion Em-R.

Sodium thiosulfate 1.8 mg/mol.AgX
Chloroauric acid 2.0 mg/mol.AgX
Stabilizer STAB-1 $6\times10^{-4}$ mg/mol.AgX Spectral sensitizer RS-1 $4\times10^{-4}$ mg/mol · AgX

BS-1

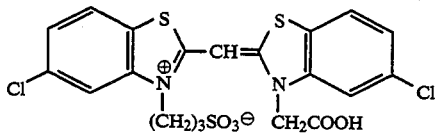

BS-2

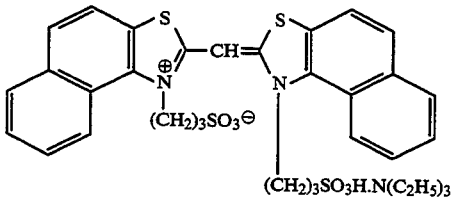

GS-1

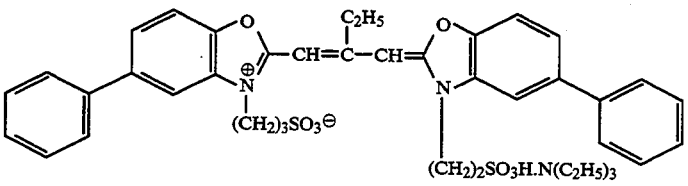

-continued

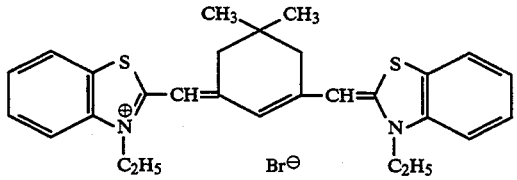

RS-1

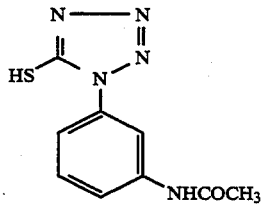

STAB-1

The sample thus obtained was subjected to wedge exposure by a conventional method, and then running-processed under the following conditions.

| Processing step | Temperature | Processing time |
|---|---|---|
| Color developing | 38 ± 0.3° C. | 30 seconds |
| Bleach-fixing | 38 ± 3° C. | 30 seconds |
| Stabilizing* | 38 ± 5° C. | 20 seconds × 3 |
| Drying | 60 ± 5° C. | 45 seconds |

*The stabilizing bath is comprised of three tanks, and has a counter-current system in which a replenishing solution is supplied to the third tank (final tank) and and its overflowing solution is successively flowed into its forebaths.

In the respective processing steps, the following processing solutions were used.

As a color developing solution, the solution obtained by dissolving the Color developing chemicals (tablets) was used.

Bleach-fixing Solution Water

Water 700 g
Ferric ammonium ethylenediaminetetraacetate 75 g
Ethylenediaminetetraacetic acid 2 g
Ammonium thiosulfate 50 g
Ammonium thiocyanate 30 g
Potassium sulfite 10 g
p-Toluenesulfinic acid 5 g
Ammonium bromide 10 g
Made up to 1,000 ml by adding water, and adjusted to pH 6.5 using acetic acid or sodium hydroxide.

As a stabilizing solution, a solution with the following composition was used.

Water 800 g
1,2-Benzisothiazolin-3-one 0.1 g
1-Hydroxyethylidene-l,l-diphosphonic acid 50 g
Ethylenediaminetetraacetic acid log 1.0 g
TINOPAL SFP (Ciba-Geigy Corp.) 2.0 g
Ammonium sulfate 2.5 g
Zinc chloride 1.0 g
Magnesium chloride 0.5 g
o-Phenylphenol 1.0 g
Sodium sulfite 2.0 g
Made up to 1,000 ml by adding water, and adjusted to pH 8.0 using 50% sulfuric acid or 25% ammonia water.

TABLE 1

| Test | Cyclodextrin compound or comparative compound Amnt. | Dissolving speed | Dmax |
|---|---|---|---|

TABLE 1-continued

| No. | Type | (g) | (1) | (%)* | (2) | (Y) | (3) |
|---|---|---|---|---|---|---|---|
| 1-1 | None | — | C | 100** | C | 2.40 | X |
| 1-2 | Polyethylene glycol (Mw: 1,540) | 2 | A | 95 | B | 1.84 | X |
| 1-3 | α-Cyclodextrin | 2 | A | 70 | A | 2.00 | Y |
| 1-4 | β-Cyclodextrin | 2 | A | 75 | A | 2.01 | Y |
| 1-5 | γ-Cyclodextrin | 2 | A | 65 | A | 2.00 | Y |
| 1-6 | D-5 | 2 | A | 65 | AA-A | 1.99 | Y |
| 1-7 | D-2 | 2 | A | 70 | A | 2.00 | Y |
| 1-8 | D-1 | 2 | A | 65 | A | 2.00 | Y |
| 1-9 | Cyclodextrin polymer ($n_2$ = 3) | 2 | A | 55 | AA-A | 2.00 | Y |
| 1-10 | Cyclodextrin polymer ($n_2$ = 4) | 2 | A | 50 | AA | 2.00 | Y |

(1): Cracking observed after tableting
(2): Solution storage stability,
(3): Remarks
*Relative value,
**Standard
X: Comparative Example,
Y: Present Invention
Evaluation criterions
Cracking after tableting:
A: Not occurs at all.
B: A little occurs.
C: So much occurs that tablets collapse when grasped.
Dissolving speed:
Indicated as relative values assuming the value of Test No. 1-1 as standard 100. The smaller the value is, the higher the dissolving speed is.
Solution storage stability:
AA: No deposition of crystals is seen at all, and in a good state.
A: Deposition of crystals is very slightly seen at the container wall/solution surface boundary, but has no problem.
B: Deposition of crystals is a little seen at the container wall/solution surface boundary.
C: Deposition of crystals is seen both at the container wall/solution surface boundary and in the solution.

From Table 1, it is seen that the incorporation of the cyclodextrin, branched cyclodextrin or cyclodextrin polymer prevents the cracking from occurring during tableting, causes no change in photographic performance, and gives photographic processing chemicals improved in dissolving speed and solution storage stability. It is also seen from Table 1 that the cyclodextrin polymer brings about a better effect of the present invention.

Moreover, use of the photographic processing chemicals of the present invention makes it unnecessary to use the plastic bottles conventionally used to hold therein photographic processing liquid concentrates. As a result, the quantity of use of plastics decreased to as much as 1/5 to 1/30. The volume of the processing chemical kit has been reduced to 1/3 to 1/10.

EXAMPLE 2

Example 1 was repeated except that the color developing chemicals used therein were granulated using a commercially available fluidized bed spray granulator, according to the method as disclosed in Japanese Patent O.P.I. Publication No. 109042/1990. Granulated processing chemicals were thus produced, and tests were made in the same manner. As a result, substantially the same results as in Example 1 were obtained.

EXAMPLE 3

Tests were made in the same manner as Test No. 1–5 of Example 1 except that the diethylhydroxylamine.sulfate in the color developing chemicals used therein was replaced by those shown in Table 2. Results obtained are shown together in Table 2.

TABLE 2

| Test | Compound of Formula I | | Dissolving speed | Solution storage |
|---|---|---|---|---|
| No. | Type | Amount (mol/lit.) | (Relative value) (%) | stability |
| 3-1 | 1-22 | 0.04 | 45 | AA |
| 3-2 | 1-15 | 0.04 | 45 | AA |
| 3-3 | 1-16 | 0.04 | 45 | AA |
| 3-4 | 1-18 | 0.04 | 45 | AA |
| 3-5 | 1-23 | 0.04 | 50 | AA-A |
| 3-6 | 1-27 | 0.04 | 55 | AA-A |
| 3-7 | 1-6 | 0.04 | 50 | AA-A |
| 3-8 | 1-19 | 0.04 | 55 | AA-A |
| 3-9 | 1-14 | 0.04 | 50 | AA-A |
| 3-10 | 1-30 | 0.04 | 50 | AA |

No meaningful differences were seen in the cracking observed after tableting and the photographic performance Dmax (Y). It is seen from Table 2 that the compound of Formula I of the present invention can be well effective.

EXAMPLE 4

Color negative films were produced in the following manner.

In the following, the amounts of the components added in the light-sensitive silver halide photographic material are indicated as gram number per 1 $m^2$ unless particularly noted. Those of silver halides and colloidal silver are indicated in terms of silver.

Color Negative Film

One side (the front) of a triacetylcellulose film support (thickness: 50μ) was subbed. Then, with the support between, on the opposite side (the back) of the surface having been subbed, the following layers were formed successively from the support side.

| | |
|---|---|
| Back-side first layer: | |
| Alumina sol AS-100 (aluminum oxide) (available from Nissan Chemical Industries, Ltd.) | 0.8 g |
| Back-side second layer: | |
| Diacetylcellulose | 100 mg |
| Stearic acid | 10 mg |
| Fine silica powder (average particle diameter: 0.2μ) | 50 mg |

Subsequently, on the surface having been subbed, of the triacetylcellulose film, the following layers were formed successively from the support side. Thus a multilayer light-sensitive color photographic material a-1 was produced.

| | |
|---|---|
| First layer: Anti-halation layer HC | |
| Black colloidal silver | 0.15 g |
| UV absorbent UV-4 | 0.20 g |
| Colored cyan coupler CC-1 | 0.02 g |
| High-boiling solvent Oil-1 | 0.20 g |
| High-boiling solvent Oil-2 | 0.20 g |
| Gelatin | 1.6 g |
| Second layer: Intermediate layer IL-1 | |
| Gelatin | 1.3 g |
| Third layer: Low-speed red-sensitive emulsion layer RL | |
| Silver iodobromide emulsion (average grain size: 0.3 μm) | 0.42 g |
| Silver iodobromide emulsion (average grain size: 0.4 μm) | 0.28 g |
| Spectral sensitizer S-1 | $3.2 \times 10^{-4}$ mol/mol · Ag |
| Spectral sensitizer S-2 | $3.2 \times 10^{-4}$ mol/mol · Ag |
| Spectral sensitizer S-3 | $0.2 \times 10^{-4}$ mol/mol · Ag |
| Cyan coupler C-3 | 0.50 g |
| Cyan coupler C-4 | 0.13 g |
| Colored cyan coupler CC-1 | 0.07 g |
| DIR compound D-1 | 0.006 g |
| DIR compound D-2 | 0.01 g |
| High-boiling solvent Oil-1 | 0.55 g |
| Gelatin | 1.0 g |
| Fourth layer: High-speed red-sensitive emulsion layer RH | |
| Silver iodobromide emulsion (average grain size: 0.7 μm) | 0.91 g |
| Spectral sensitizer S-1 | $1.7 \times 10^{-4}$ mol/mol · Ag |
| Spectral sensitizer S-2 | $1.6 \times 10^{-4}$ mol/mol · Ag |
| Spectral sensitizer S-3 | $0.1 \times 10^{-4}$ mol/mol · Ag |
| Cyan coupler C-4 | 0.23 g |
| Colored cyan coupler CC-1 | 0.03 g |
| DIR compound D-2 | 0.02 g |
| High-boiling solvent Oil-1 | 0.25 g |
| Gelatin | 1.0 g |
| Fifth layer: Intermediate layer IL-2 | |
| Gelatin | 0.8 g |
| Sixth layer: Low-speed green-sensitive emulsion layer GL | |
| Silver iodobromide emulsion (average grain size: 0.4 μm) | 0.6 g |
| Silver iodobromide emulsion (average grain size: 0.3 μm) | 0.2 g |
| Spectral sensitizer S-4 | $6.7 \times 10^{-5}$ mol/mol · Ag |
| Spectral sensitizer S-5 | $0.8 \times 10^{-4}$ mol/mol · Ag |
| Magenta coupler M-2 | 0.17 g |
| Magenta coupler M-3 | 0.43 g |
| Colored magenta coupler CM-1 | 0.10 g |
| DIR compound D-3 | 0.02 g |
| High-boiling solvent Oil-2 | 0.7 g |
| Gelatin | 1.0 g |
| Seventh layer: High-speed green-sensitive emulsion layer GH | |
| Silver iodobromide emulsion (average grain size: 0.7 μm) | 0.91 g |
| Spectral sensitizer S-6 | $1.1 \times 10^{-4}$ mol/mol · Ag |
| Spectral sensitizer S-7 | $2.0 \times 10^{-4}$ mol/mol · Ag |
| Spectral sensitizer S-8 | $0.3 \times 10^{-4}$ mol/mol · Ag |
| Magenta coupler M-2 | 0.30 g |
| Magenta coupler M-3 | 0.13 g |
| Colored magenta coupler CM-1 | 0.04 g |
| DIR compound D-3 | 0.004 g |
| High-boiling solvent Oil-2 | 0.35 g |
| Gelatin | 1.0 g |
| Eighth layer: Yellow filter layer YC | |
| Yellow colloidal silver | 0.1 g |
| Additive HS-1 | 0.07 g |
| Additive HS-2 | 0.07 g |
| Additive SC-1 | 0.12 g |
| High-boiling solvent Oil-2 | 0.15 g |
| Gelatin | 1.0 g |
| Ninth layer: Low-speed blue-sensitive emulsion layer BH | |
| Silver iodobromide emulsion | 0.25 g |

-continued

| | |
|---|---|
| (average grain size: 0.3 μm) | |
| Silver iodobromide emulsion (average grain size: 0.4 μm) | 0.25 g |
| Spectral sensitizer S-9 | $5.8 \times 10^{-4}$ mol/mol · Ag |
| Yellow coupler Y-2 | 0.6 g |
| Yellow coupler Y-3 | 0.32 g |
| DIR compound D-1 | 0.003 g |
| DIR compound D-2 | 0.006 g |
| High-boiling solvent Oil-2 | 0.18 g |
| Gelatin | 1.3 g |
| Tenth layer: High-speed blue-sensitive emulsion layer BH | |
| Silver iodobromide emulsion (average grain size: 0.8 μm) | 0.5 g |
| Spectral sensitizer S-10 | $3.0 \times 10^{-4}$ mol/mol · Ag |
| Spectral sensitizer S-11 | $1.2 \times 10^{-4}$ mol/mol · Ag |
| Yellow coupler Y-2 | 0.18 g |
| Yellow coupler Y-3 | 0.10 g |
| High-boiling solvent Oil-2 | 0.05 g |
| Gelatin | 1.0 g |
| Eleventh layer: First protective layer PRO-1 | |
| Silver iodobromide emulsion (average grain size: 0.08 μm) | 0.3 g |
| Ultraviolet absorbent UV-4 | 0.07 g |

-continued

| | |
|---|---|
| Ultraviolet absorbent UV-5 | 0.10 g |
| Additive HS-1 | 0.2 g |
| Additive HS-2 | 0.1 g |
| High-boiling solvent Oil-1 | 0.07 g |
| High-boiling solvent Oil-3 | 0.07 g |
| Gelatin | 0.8 g |
| Twelfth layer: Second protective layer PRO-2 | |
| Lubricant WAX-1 | 0.04 g |
| Activator SU-1 | 0.004 g |
| Polymethyl methacrylate (average particle diameter: 3 μm) | 0.02 g |
| Methyl methacrylate/ethyl methacrylate/methacrylic acid copolymer (3:3:4 in weight ratio) (average particle diameter: 3 μm) | 0.13 g |

The above color negative film further contains compounds SU-1 and SU-2, a viscosity regulator, hardening agents H-1 and H-2, stabilizer STAB-2, antifoggants AF-1 and two kinds of AF-2 with weight average molecular weights of 10,000 and 1,100,000. dyes AI-4 and AI-5, and compound DI-1 (9.4 mg/m$^2$).

C-3

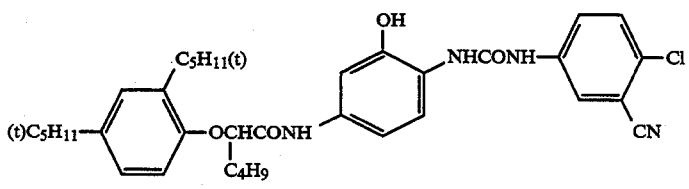

C-4

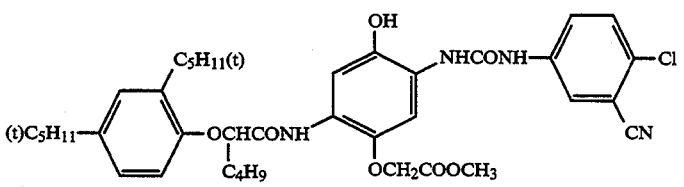

M-2

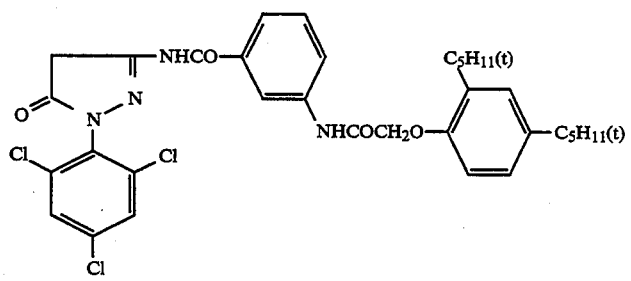

M-3

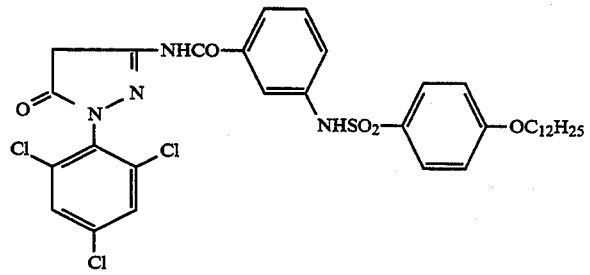

-continued
Y-2
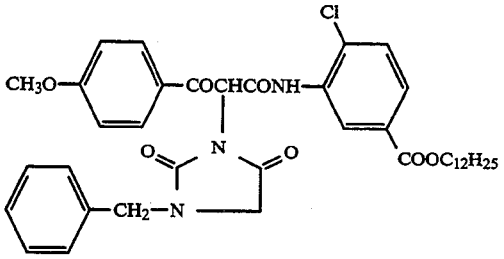
Y-3
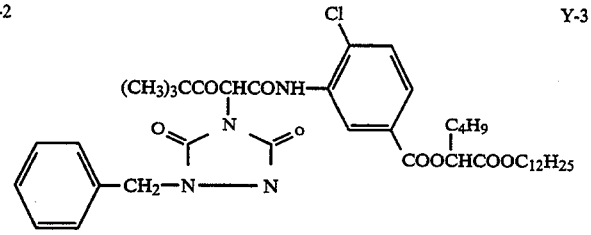
CC-1
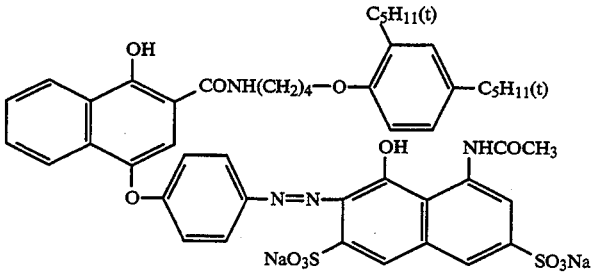
CM-1
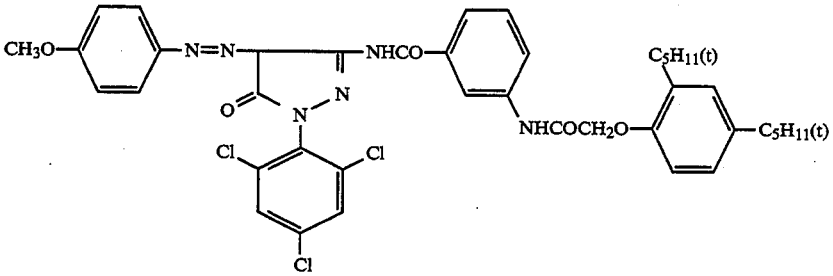
D-1
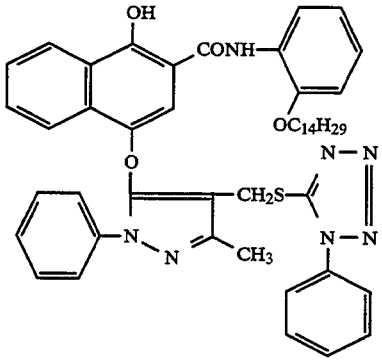
D-2
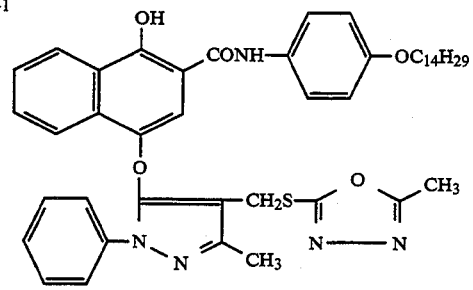
D-3
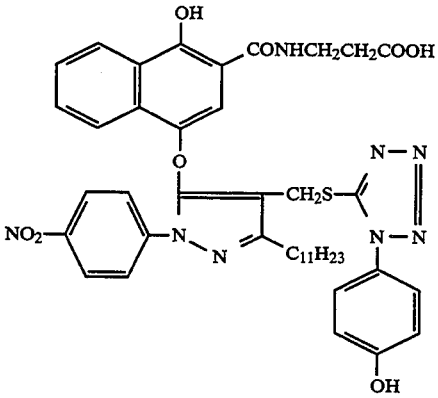
UV-4
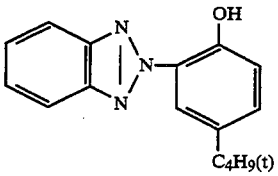

-continued
UV-5
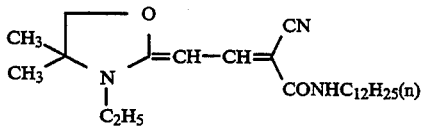
S-1
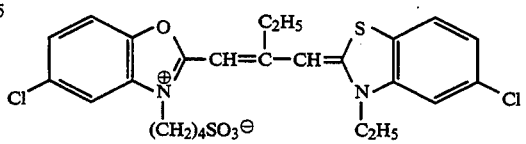
S-2
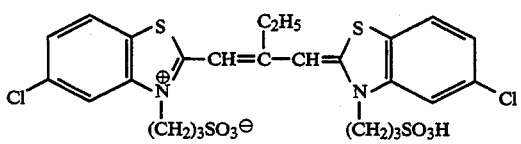
S-3
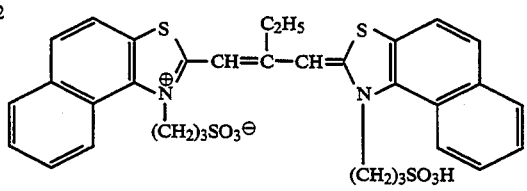
S-4
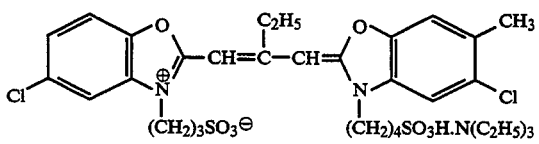
S-5
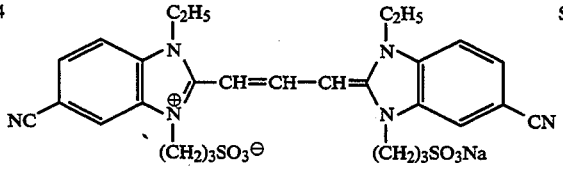
S-6
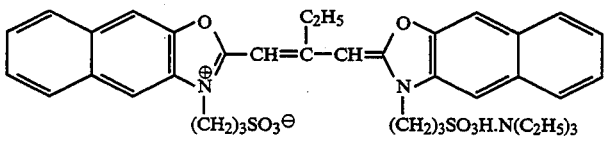
S-7
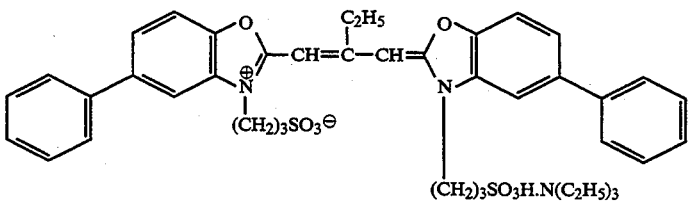
S-8
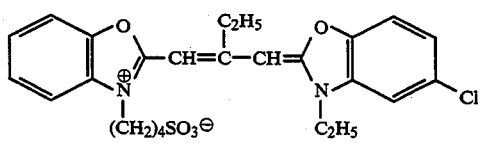
S-9
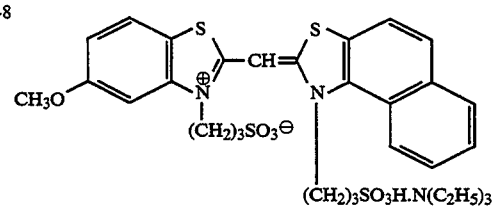
S-10
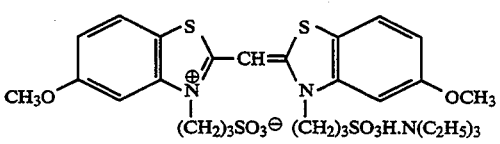
S-11
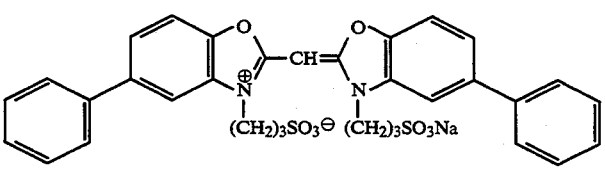
HS-1
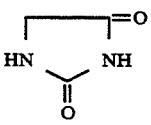
HS-2
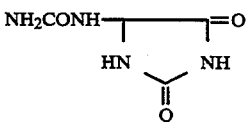

-continued
SC-1
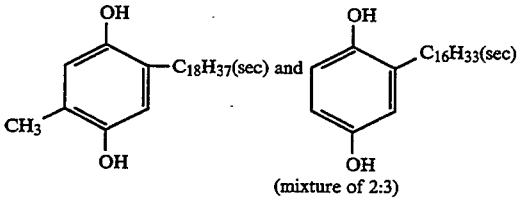
Oil-1
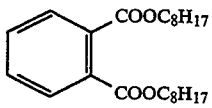
Oil-2
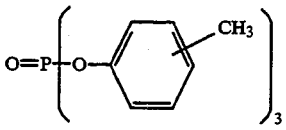
Oil-3
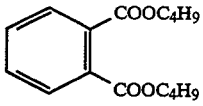
H-1
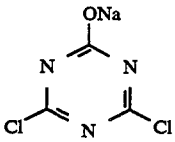
H-2
$(CH_2{=}CHSO_2CH_2)_2O$
SU-1
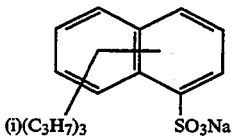
SU-4
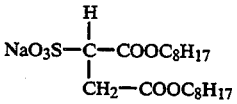
AI-4
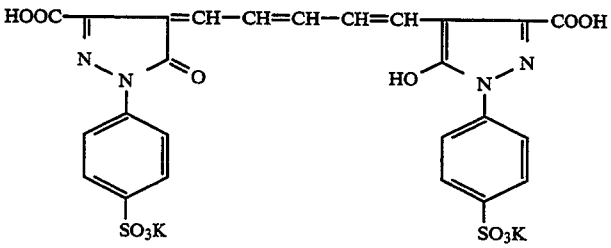
AI-2
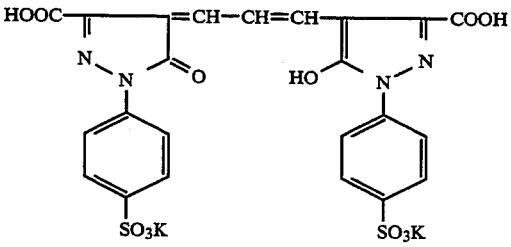
STAB-2
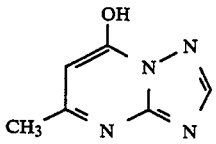
AF-1
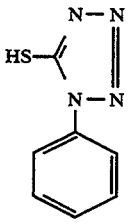
AF-2
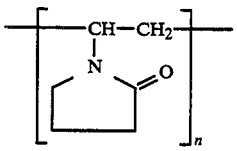
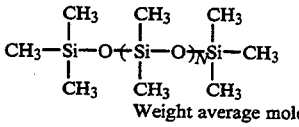
Weight average molecular weight: 30,000
Lubricant WAX-1 A mixture of the following three components:
DI-1
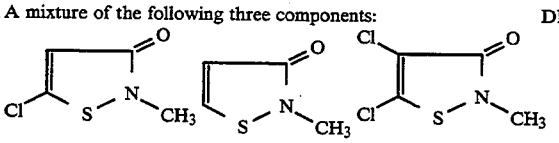
(Component A) (Component B) (Component C)
Component A:Component B:Component C = 50:46:40 (mole ratio)

Preparation of Emulsions

The silver iodobromide emulsion used in the tenth layer was prepared in the following manner.

Using, as seed crystals, monodisperse silver iodobromide grains with an average grain size of 0.33 μm (silver iodide content: 2 mol %) were prepared by double-jet precipitation.

Solution G-1 shown below was maintained at a temperature of 70° C., pAg 7.8 and pH 7.0, and a seed emulsion corresponding to 0.34 mol was added thereto with thorough stirring.

(Formation of inside iodide-rich phase, core phase)

Thereafter, H-1 and S-1 shown below were added at accelerated flow rates (flow rate at initial stage: 3.6 times the flow rate at the time the addition was completed) over a period of 86 minutes, while keeping their flow rate ratio at 1:1.

(Formation of outside phase with low iodide content, shell phase)

Subsequently, while maintaining the pAg and pH at 10.1 and 6.0, respectively, H-2 and S-2 shown below were added at accelerated flow rates (flow rate at initial stage: 5.2 times the flow rate at the time the addition was completed) over a period of 65 minutes, while keeping their flow rate ratio at 1:1.

The pAg and pH in the course of the formation of grains were controlled using an aqueous potassium bromide and an aqueous 56% acetic acid solution. After the formation of grains was completed, washing with water was applied by conventional flocculation. Thereafter, gelatin was added to effect re-dispersion, and the pH and pAg were adjusted to 5.8 and 8.06, respectively, at 40° C.

The emulsion thus obtained was a monodisperse emulsion containing octahedral silver iodobromide grains having an average grain size of 0.80 μm, a breadth of distribution of 12.4% and a silver iodide content of 8.5 mol %.

G-1

Ossein gelatin 100.0 g
10% by weight Methanol solution of Compound-1 25.0 ml
Aqueous 28% ammonia solution 440.0 ml
Aqueous 56% acetic acid solution 660.0 ml
Using water, made up to 5,000.0 ml

H-1

Ossein gelatin 82.4 g
Potassium bromide 151.6 g
Potassium iodide 90.6 g
Using water, made up to 1,30.5 ml

S-1

Silver nitrate 309.2 g
Aqueous 28% ammonia solution equivalent weight
Using water, made up to 1,030.5 ml

H-2

Ossein gelatin 302.1 g
Potassium bromide 770.0 g
Potassium iodide 33.2 g
Using water, made up to 3,776.8 ml

S-2

Silver nitrate 1,133.0 g
Aqueous 28% ammonia solution equivalent weight
Using water, made up to 3,776.8 ml Compound-1

$HO(CH_2CH_2O)_m[CH(CH_3)CH_2O]_{17}(CH_2CH_2O)_nH$

Average molecular weight: about 1,300)

According to the same procedure, but changing the average grain size of seed grains, the temperature, the pAg, the pH, the flow rate, the addition time and the halide composition, the above respective emulsions having different average grain size and silver iodide content were prepared.

All of them were core/shell type monodisperse emulsions with a breadth of distribution of 20% or less. Each emulsion was subjected to optimal chemical ripening in the presence of sodium thiosulfate, chloroauric acid and ammonium thiocyanate, and then spectral sensitizers, 4-hydroxy-6-methyl-1,3,3a,7-tetrazaindene and 1-phenyl-5-mercaptotetrazole were added.

The color film samples thus produced were subjected to wedge exposure according to a conventional method, and thereafter processed according to the following processing steps.

| Processing step | Temperature | Processing time |
|---|---|---|
| Color developing | 38 ± 0.3° C. | 3 min 15 sec |
| Bleaching | 38 ± 2° C. | 45 sec |
| Fixing | 38 ± 2° C. | 1 min 30 sec |
| Stabilizing* | 38 ± 5° C. | 1st tank: 30 sec<br>2nd tank: 30 sec |
| Drying | 60 ± 5° C. | 1 minute |

*The first and second stabilizing tanks are set in a counter-current system, where a replenishing solution is supplied to the second tank.

Processing solutions used in the respective processing steps are as follows:

| Color developing chemicals (Tableted processing chemicals for 1 liter developing solution) | |
|---|---|
| Potassium carbonate | 30 g |
| Sodium hydrogencarbonate | 3.5 g |
| Sodium 1-hydroxyethane-1,1-diphosphonate | 2.5 g |
| Sodium diethylenetriaminepentaacetate | 2.0 g |
| 4-Amino-3-methyl-N-ethyl-N-(β-hydroxyethyl)aniline sulfate (CD-4) | 4.8 g |
| Sodium sulfite | 3.5 g |
| Hydroxylamine sulfate | 2.8 g |
| Sodium bromide | 1.3 g |
| Potassium iodide | 0.8 mg |
| Cyclodextrin, branched cyclodextrin or cyclodextrin polymer | as shown in Table 3 |
| **Bleaching chemicals (Tableted processing chemicals for 1 liter bleaching solution)** | |
| Ferric potassium 1,3-propanediaminetetraacetate | 180 g |
| Ferric sodium ethylenediaminetetraacetate | 40 g |
| Sodium ethylenediaminetetraacetate | 5 g |
| Potassium bromide | 150 g |
| Sodium nitrate | 35 g |
| Maleic acid | 28 g |
| **Fixing chemicals (Tableted processing chemicals for 1 liter fixing solution)** | |
| Sodium thiosulfate | 200 g |
| Sodium sulfite | 20 g |
| Potassium thiocyanate | 100 g |
| Sodium ethylenediaminetetraacetate | 5 g |
| **Stabilizing chemicals (Slurry processing chemicals for 1 liter stabilizing solution)** | |
| Hexamethylenetetramine | 10 g |
| Polyethylene glycol (molecular weight: 1,540) | 2 g |

-continued

| | |
|---|---|
| $pC_8H_{17}$—$(C_6H_4)$—O—(—$CH_2CH_2O$—)$_{10}$—H | 2 G |
| Diethylene glycol | 10 g |

(Tableted processing chemicals for 1 liter fixing solution)

The stabilizing solution was formed into a slurry by means of a commercially available kneader and put into use.

The same tests as in Example 1 were made, provided that, as to the photographic performance, transmission green density was measured using a photoelectric densitometer.

Results obtained are shown together in Table 3.

TABLE 3

| Test No. | Cyclodextrin compound or comparative compound Type | Amnt. (g) | (1) | Dissolving speed (%)* | (2) | Dmax (Y) | (3) |
|---|---|---|---|---|---|---|---|
| 4-1 | None | — | C | 100** | C | 2.48 | X |
| 4-2 | Polyethylene glycol (Mw: 1,540) | 2 | A | 92 | B | 2.20 | X |
| 4-3 | α-Cyclodextrin | 2 | A | 71 | A | 2.39 | Y |
| 4-4 | β-Cyclodextrin | 2 | A | 70 | A | 2.38 | Y |
| 4-5 | γ-Cyclodextrin | 2 | A | 75 | A | 2.40 | Y |
| 4-6 | D-5 | 2 | A | 65 | AA-A | 2.39 | Y |
| 4-7 | D-2 | 2 | A | 60 | A | 2.40 | Y |
| 4-8 | D-1 | 2 | A | 65 | A | 2.40 | Y |
| 4-9 | Cyclodextrin polymer ($n_2$ = 3) | 2 | A | 55 | AA-A | 2.39 | Y |
| 4-10 | Cyclodextrin polymer ($n_2$ = 4) | 2 | A | 60 | AA | 2.40 | Y |

(1): Cracking observed after tableting
(2): Solution storage stability,
(3): Remarks
*Relative value,
**Standard
X: Comparative Example,
Y: Present Invention

Evaluation Criterions

The same as in Example 1.

Substantially the same results were obtained, and the present invention proved to give good results.

EXAMPLE 5

Preparation of granulated black and white developing chemicals:

Formulation for 1 liter developing solution

| | |
|---|---|
| <Composition A> | |
| Hydroquinone | 45.0 g |
| N-methyl-p-aminophenol ½ sulfate | 0.8 g |
| Sodium hydroxide | 18.0 g |
| Potassium hydroxide | 55.0 g |
| 5-Sulfosalicylic acid | 45.0 g |
| Boric acid | 25.0 g |
| Potassium sulfite | 110.0 g |
| Disodium ethylenediaminetetraacetate | 1.0 g |
| KBr | 6.0 g |
| 5-Methylbenzotriazole | 0.6 g |
| m-Butyldiethanolamine | 15.0 g |
| Water | 20.0 g |
| <Composition B> | |
| Cyclodextrin compound or comparative compound | as shown in Table 4 |

Solidification

The compounds of the above Composition A and Composition B were uniformly mixed, and thereafter extruded into granules of 3 mm in diameter using an extrusion granulator, followed by drying to give granulated developing chemicals.

Evaluation

Granule strength

The developing chemicals thus obtained were void-freely packed into a packaging material made of paper coated with polyethylene on its inner wall, and then shaked for 24 hours using a commercially available shaking tester. The quantity of any fine powder produced was visually measured to make evaluation.

Dissolving Performance

The granules were dissolved at room temperature to visually compare the time by which they had been completely dissolved.

Solution Storage Stability

The solution formed by dissolution was put in a container with an open top area of 50 $cm^2$, made of hard vinyl chloride. The solution was stored at 30° C. for a month, and thereafter observed to examine whether or not any deposition of crystals occurred.

Results obtained are shown in Table 4 below.

TABLE 4

| Test No. | Cyclodextrin compound or comparative compound Type | Amnt. (g) | (1) | Dissolving speed (%)* | (2) | Remarks |
|---|---|---|---|---|---|---|
| 5-1 | None | — | 2 | 100** | C | X |
| 5-2 | Polyethylene glycol (Mw: 400) | 4.0 | 3 | 95 | B-C | X |
| 5-3 | Polyethylene glycol (Mw: 400) | 10.0 | 2 | 90 | C | X |
| 5-4 | α-Cyclodextrin | 4.0 | 4 | 50 | A | Y |
| 5-5 | β-Cyclodextrin | 4.0 | 4 | 60 | A | Y |
| 5-6 | γ-Cyclodextrin | 4.0 | 4 | 50 | A | Y |
| 5-7 | D-5 | 4.0 | 4 | 30 | A | Y |
| 5-8 | D-14 | 4.0 | 5 | 25 | A | Y |
| 5-9 | Isoelite | 4.0 | 4 | 30 | A | Y |
| 5-10 | Isoelite | 10.0 | 5 | 25 | AA | Y |
| 5-11 | Cyclodextrin polymer ($n_2$ = 3) | 4.0 | 4 | 75 | A | Y |
| 5-12 | Cyclodextrin polymer ($n_2$ = 4) | 4.0 | 4 | 80 | A | Y |

(1): Granule strength
(2): Solution storage stability
*Relative value,
**Standard
X: Comparative Example,
Y: Present Invention
Evaluation criterions
Granule strength:
5: Fine powder little occurs.
3 or less:
Fine powder occurs. Not suitable for practical use because of its adhesion to the packaging material and the flying of the fine powder when the packaging material is opened.
Dissolving speed:
Indicated as relative values assuming the value of Test No. 5-1 as standard 100. The smaller the value is, the higher the dissolving speed is.
Solution storage stability:
AA: No deposition of crystals is seen at all, and in a good state.
A: Deposition of crystals is very slightly seen at the container wall/solution surface boundary, but has no problem.
B: Deposition of crystals is a little seen at the container wall/solution surface boundary.
C: Deposition of crystals is seen both at the container TABLE 4-continued wall/solution surface boundary and in the solution.

EXAMPLE 6

| Preparation of granulated black and white developing chemicals: | |
|---|---|
| Formulation for 1 liter developing solution | |
| <Composition A> | |
| Hydroquinone | 20.0 g |
| 1-Phenyl-4,4'-dimethyl-3-pyrazolidinone | 0.3 g |
| Sodium hydroxide | 10.5 g |
| Potassium sulfite | 33.0 g |
| Disodium ethylenediaminetetraacetate | 2.0 g |
| Potassium bromide | 3.5 g |
| 5-Methylbenzotriazole | 0.3 g |
| 1-Phenyl-5-mercaptotetrazole | 0.06 g |
| Potassium carbonate | 15.0 g |
| Compound a* | 0.03 g |
| Water | 10.0 g |
| <Composition B> | |
| Cyclodextrin compound or comparative compound | as shown in Table 5 |

Compound a $$CH_3—N(CH_2CH_2CH_2NHCONHCH_2CH_2SC_2H_5)_2$$

The compounds of the above Composition A and Composition B were uniformly mixed, and granulated developing chemicals were produced in the same manner as in Example 5. The same evaluation as in Example 5 was made.

Results obtained are shown in Table 5 below.

TABLE 5

| Test No. | Cyclodextrin compound or comparative compound Type | Amnt. (g) | (1) | Dissolving speed (%)* | (2) | Remarks |
|---|---|---|---|---|---|---|
| 6-1 | None | — | 2 | 100** | C | X |
| 6-2 | Polyethylene glycol (Mw: 400) | 2.0 | 3 | 90 | B-C | X |
| 6-3 | Polyethylene glycol (Mw: 400) | 5.0 | 2 | 85 | B | X |
| 6-4 | α-Cyclodextrin | 2.0 | 4 | 50 | A | Y |
| 6-5 | β-Cyclodextrin | 2.0 | 4 | 55 | A | Y |
| 6-6 | γ-Cyclodextrin | 2.0 | 4 | 50 | A | Y |
| 6-7 | D-5 | 2.0 | 4 | 35 | A | Y |
| 6-8 | D-14 | 2.0 | 4 | 20 | AA | Y |
| 6-9 | Isoelite | 2.0 | 4 | 30 | A | Y |
| 6-10 | Isoelite | 5.0 | 5 | 20 | AA | Y |
| 6-11 | Cyclodextrin polymer ($n_2$ = 3) | 2.0 | 4 | 70 | A | Y |
| 6-12 | Cyclodextrin polymer ($n_2$ = 4) | 2.0 | 5 | 85 | A | Y |

(1): Granule strength
(2): Solution storage stability
*Relative value,
**Standard
X: Comparative Example,
Y: Present Invention

EXAMPLE 7

| Preparation of solid black and white fixing chemicals: | |
|---|---|
| Formulation for 1 liter fixing solution | |
| <Composition A> | |
| Ammonium thiosulfate | 100.0 g |
| Sodium thiosulfate | 20.0 g |
| Sodium sulfite | 10.0 g |
| Sodium citrate | 1.0 g |

-continued

| Preparation of solid black and white fixing chemicals: | |
|---|---|
| Formulation for 1 liter fixing solution | |
| Boric acid | 5.0 g |
| Aluminum sulfate | 20.0 g |
| Sodium acetate | 15.0 g |
| Sodium oxalate | 8.0 g |
| Water | 15.0 g |
| <Composition B> | |
| Cyclodextrin compound or comparative compound | as shown in Table 6 |

The solidification and evaluation, as well as its criterions, were made in the same manner as in Example 8.

Results obtained are shown in Table 6 below.

TABLE 6

| Test No. | Cyclodextrin compound or comparative compound Type | Amnt. (g) | (1) | Dissolving speed (%)* | (2) | Remarks |
|---|---|---|---|---|---|---|
| 7-1 | None | — | 2 | 100** | C | X |
| 7-2 | Polyethylene glycol (Mw: 400) | 3.0 | 3 | 95 | C | X |
| 7-3 | Polyethylene glycol (Mw: 400) | 6.0 | 3 | 90 | B-C | X |
| 7-4 | α-Cyclodextrin | 3.0 | 4 | 45 | A | Y |
| 7-5 | β-Cyclodextrin | 3.0 | 4 | 55 | A | Y |
| 7-6 | γ-Cyclodextrin | 3.0 | 4 | 40 | A | Y |
| 7-7 | D-5 | 3.0 | 4 | 35 | A | Y |
| 7-8 | D-14 | 3.0 | 4 | 20 | AA | Y |
| 7-9 | Isoelite | 3.0 | 4 | 25 | AA | Y |
| 7-10 | Isoelite | 6.0 | 5 | 20 | AA | Y |
| 7-11 | Cyclodextrin polymer ($n_2$ = 3) | 3.0 | 4 | 80 | A | Y |
| 7-12 | Cyclodextrin polymer ($n_2$ = 4) | 3.0 | 5 | 85 | A | Y |

(1): Granule strength
(2): Solution storage stability
*Relative value,
**Standard
X: Comparative Example,
Y: Present Invention

EXAMPLE 8

Using a typical formulation of conventional liquid chemicals, their dissolving performance in the state of powder was checked. Formulation of developing solutions D-1 and D-2 is shown in Table 7. Liquid components are omitted therein.

TABLE 7

| Components | Amount |
|---|---|
| D-1: | |
| Hydroquinone | 15 g |
| Phenidone | 0.5 g |
| Potassium sulfite | 49.5 g |
| Potassium carbonate | 66 g |
| Potassium hydrogencarbonate | 9 g |
| Potassium bromide | 4.5 g |
| 1-Phenyl-5-mercaptotetrazole | 0.02 g |
| *5-Nitroindazole (I-1) | 0.15 g |
| *5-Methylbenzotriazole (II-2) | 0.16 g |
| Disodium ethylenediaminetetraacetate dihydrate | 1.025 g |
| D-2: | |
| Hydroquinone | 19.2 g |
| Methol | 0.35 g |
| Sodium pyrosulfite | 63.5 g |
| Potassium phosphate | 26.1 g |
| Sodium chloride | 2.4 g |
| Sodium hydroxide | 33.8 g |
| Potassium bromide | 1.2 g |
| *5-Methylbenzotriazole (II-2) | 0.19 g |
| Disodium ethylenediaminetetraacetate dihydrate | 1.0 g |

In Table 7, the asterisked(*) compounds (II-1) and (II-2) are slightly water-soluble organic compounds VI-1 and VII-2, respectively, the components participating in the present invention. Inclusion products of the cyclodextrin compound with exemplary compounds V-I and V-II (Test No. 8-21 to 8-26) or with exemplary compound VII-2 (Test No. 8-37 to 8-43) were produced by the method (2) previously described. As alkali agents in the production process, the alkali agents shown in Table 7 (potassium carbonate in D-1 and sodium hydroxide in D-2; the amounts of the alkali agents contained in 1 liter of the final developing solution were the same) were used.

Evaluation of Dissolving Performance

Processing chemicals formulated for 1 liter solutions as shown in Tables 8A-8B and 9A-9B were put in 1 liter of 25° C. water, and the time by which thereafter the solutions had been completely dissolved was measured to make evaluation. Needless to say, the shorter the time is, the better the dissolving performance is. The evaluation was made on a mode in which the powdery mixtures with the above formulation D-1 or D-2 were dissolved as they were, a mode in which VI-1 or VII-2 was removed from D-1 or D-2 and the resulting powdery mixtures were dissolved, and a mode in which VI-1 and VII-2 were removed from D-1 and the resulting powdery mixtures were dissolved. Using these modes as bases for comparison, a manner in which the cyclodextrin compound was added to the above formulation and the resulting mixture was dissolved or a manner in which the inclusion product of the cyclodextrin compound with VI-1 and VII-2 or with VII-2 was mixed in the powdery mixture and then the mixture was dissolved was used.

As will be seen from Tables 8A-8B (in pair) and 9A-9B (in pair) shown below, use of the cyclodextrin compound brings about a remarkable improvement in dissolving performance and, in particular, use of the inclusion product is very advantageous.

TABLE 8A

| Sample No. | Formulation | Slightly water-soluble organic compound | Cyclodextrin compound Compound No. | Amount (g/l) |
|---|---|---|---|---|
| 8-1 | D-1 | I-1,II-2 | — | — |
| 8-2 | " | I-1 | — | — |
| 8-3 | " | II-2 | — | — |
| 8-4 | " | — | — | — |
| 8-5 | " | I-1,II-2 | α-Cyclodextrin | 3 |
| 8-6 | " | " | " | 5 |
| 8-7 | " | " | " | 7 |
| 8-8 | " | " | β-Cyclodextrin | 3 |
| 8-9 | " | " | " | 5 |
| 8-10 | " | " | " | 7 |
| 8-11 | " | " | D-5 | 1 |
| 8-12 | " | " | " | 3 |
| 8-13 | " | " | " | 5 |
| 8-14 | " | " | " | 7 |
| 8-15 | " | " | D-14 | 3 |
| 8-16 | D-1 | " | D-14 | 5 |
| 8-17 | " | " | Isoelite | 3 |
| 8-18 | " | " | " | 5 |
| 8-19 | " | I-1 | D-5 | 5 |
| 8-20 | " | II-2, | D-5 | 5 |
| 8-21 | " | — | — | — |
| 8-22 | " | — | — | — |
| 8-23 | " | — | — | — |
| 8-24 | " | — | — | — |
| 8-25 | " | — | — | — |
| 8-26 | " | — | — | — |
| 8-27 | D-2 | II-2 | — | — |
| 8-28 | " | — | — | — |

TABLE 8A-continued

| Sample No. | Formulation | Slightly water-soluble organic compound | Cyclodextrin compound Compound No. | Amount (g/l) |
|---|---|---|---|---|
| 8-29 | " | II-2 | α-Cyclodextrin | 3 |
| 8-30 | " | " | " | 5 |
| 8-31 | D-2 | II-2 | β-Cyclodextrin | 5 |
| 8-32 | " | " | D-5 | 3 |
| 8-33 | " | " | " | 5 |
| 8-34 | " | " | D-14 | 3 |
| 8-35 | " | " | " | 5 |
| 8-36 | " | " | Isoelite | 5 |
| 8-37 | " | — | — | — |
| 8-38 | " | — | — | — |
| 8-39 | " | — | — | — |
| 8-40 | " | — | — | — |
| 8-42 | " | — | — | — |
| 8-43 | " | — | — | — |
| 8-44 | " | — | β-Cyclodextrin | 5 |
| 8-45 | " | — | Isoelite | 5 |

TABLE 8B

| Sample No. | Compound No. | Inclusion product of cyclodextrin compound with slightly water-soluble organic compound: Amount I-1 (g/l) | II-2 (g/l) | Cyclodex. compound (g/l) | Total (g/l) | (1) (sec) | (2) |
|---|---|---|---|---|---|---|---|
| 8-1 | — | — | — | — | — | ND* | X |
| 8-2 | — | — | — | — | — | " | " |
| 8-3 | — | — | — | — | — | 650 | " |
| 8-4 | — | — | — | — | — | 120 | " |
| 8-5 | — | — | — | — | — | 280 | Y |
| 8-6 | — | — | — | — | — | 240 | " |
| 8-7 | — | — | — | — | — | 200 | " |
| 8-8 | — | — | — | — | — | 275 | " |
| 8-9 | — | — | — | — | — | 238 | " |
| 8-10 | — | — | — | — | — | 201 | " |
| 8-11 | — | — | — | — | — | 220 | " |
| 8-12 | — | — | — | — | — | 198 | " |
| 8-13 | — | — | — | — | — | 170 | " |
| 8-14 | — | — | — | — | — | 140 | " |
| 8-15 | — | — | — | — | — | 180 | " |
| 8-16 | — | — | — | — | — | 145 | Y |
| 8-17 | — | — | — | — | — | 180 | " |
| 8-18 | — | — | — | — | — | 160 | " |
| 8-19 | — | — | — | — | — | 169 | " |
| 8-20 | — | — | — | — | — | 120 | " |
| 8-21 | α-Cyclodextrin | 0.15 | 0.16 | 3 | 3.31 | 120 | " |
| 8-22 | " | " | " | 5 | 5.31 | 118 | " |
| 8-23 | D-5 | " | " | 1 | 1.31 | 118 | " |
| 8-24 | " | " | " | 3 | 3.31 | 110 | " |
| 8-25 | " | " | " | 5 | 5.31 | 109 | " |
| 8-26 | D-14 | " | " | 5 | 5.31 | 105 | " |
| 8-27 | — | — | — | — | — | 598 | X |
| 8-28 | — | — | — | — | — | 112 | " |
| 8-29 | — | — | — | — | — | 180 | Y |
| 8-30 | — | — | — | — | — | 170 | " |
| 8-31 | — | — | — | — | — | 170 | Y |
| 8-32 | — | — | — | — | — | 165 | " |
| 8-33 | — | — | — | — | — | 140 | " |
| 8-34 | — | — | — | — | — | 120 | " |
| 8-35 | — | — | — | — | — | 115 | " |
| 8-36 | — | — | — | — | — | 125 | " |
| 8-37 | α-Cyclodextrin | — | 0.19 | 3 | 3.19 | 110 | " |
| 8-38 | " | — | " | 5 | 5.19 | 108 | " |
| 8-39 | D-5 | — | " | 1 | 1.19 | 105 | " |
| 8-40 | " | — | " | 3 | 3.19 | 100 | " |
| 8-41 | " | — | " | 5 | 5.19 | 95 | " |
| 8-42 | D-14 | — | " | 5 | 5.19 | 100 | " |
| 8-43 | Isoelite | — | " | 5 | 5.19 | 110 | " |
| 8-44 | — | — | " | — | — | 112 | " |

TABLE 8B-continued

| Sample No. | Inclusion product of cyclodextrin compound with slightly water-soluble organic compound: Compound No. | Amount: I-1 (g/l) | II-2 (g/l) | Cyclodex. compound (g/l) | Total (g/l) | (1) (sec) | (2) |
|---|---|---|---|---|---|---|---|
| 8-45 | — | — | " | — | — | 111 | " |

(1): Dissolving time,
(2): Remarks,
*Not dissolved
X: Comparative Example,
Y: Present Invention

EXAMPLE 9

Preparation of Emulsion A

In an acidic environment of pH 3.0, silver chlorobromide grains containing a rhodium salt in an amount of $10^{-5}$ mol per mol of silver, having an average grain size of 0.20 μm and a coefficient of variation of grain size distribution, of 20% and containing 2 mol % of silver bromide were prepared by controlled double jet precipitation. The grains were made to grow in a system containing benzyladenine in an amount of 30 mg per liter of an aqueous 1% gelatin solution. After silver and halide were mixed, 6-methyl-4-hydroxy-1,3,3a,7-tetrazaindene was added in an amount of 600 mg per mol of silver halide, followed by washing with water and desalting. Subsequently, sodium thiosulfate was added to carry out sulfur sensitization.

To the emulsion thus obtained, additives were added so as to give the following coating weights, and the resulting emulsion was coated on a subbed polyethylene terephthalate support.

| | |
|---|---|
| Latex polymer: styrene-butyl acrylate-acrylic acid terpolymer | 1.0 g/m² |
| Phenol | 1 mg/m² |
| Saponin | 200 mg/m² |
| Dedecylbenzenesulfonate | 40 mg/m² |
| Compound of Formula T (Exemplary Compound T-2) | 50 mg/m² |
| Compound N (shown below) | 40 mg/m² |
| Compound O (shown below) | 50 mg/m² |
| Styrene-maleic acid copolymer | 20 mg/m² |
| Alkali-treated gelatin (isoelectric point: 4.9) | 2.0 mg/m² |
| Silver weight | 3.5 g/m² |
| Formalin | 10 mg/m² |

Compound N

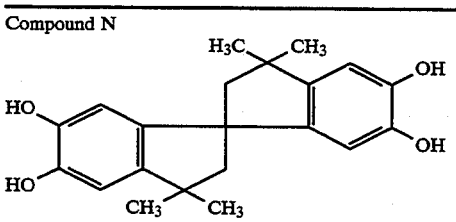

Compound O

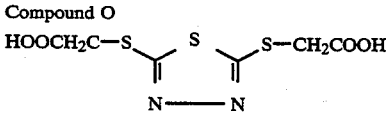

The coating solution was previously adjusted to pH 6.5 using sodium hydroxide and thereafter coated. To form an emulsion protective layer, additives were used so as to give the following coating weights to prepare a coating solution, which was then simultaneously double-layer coated together with the emulsion coating solution.

| Protective layer: | |
|---|---|
| Fluorinated dioctylsulfosuccinic acid ester | 100 mg/m² |
| Dioctylsulfosuccinic acid ester | 100 mg/m² |
| Matting agent: amorphous silica | 50 mg/m² |
| Compound O | 30 mg/m² |
| 5-Methylbenzotriazole | 20 mg/m² |
| Compound P (shown below) | 500 mg/m² |
| Gallic acid propyl ester | 300 mg/m² |
| Styrene-maleic acid copolymer | 100 mg/m² |
| Alkali-treated gelatin (isoelectric point: 4.9) | 1.0 mg/m² |
| Formalin | 10 mg/m² |

The coating solution was previously adjusted to pH 5.4 using citric acid and thereafter coated.

Compound P

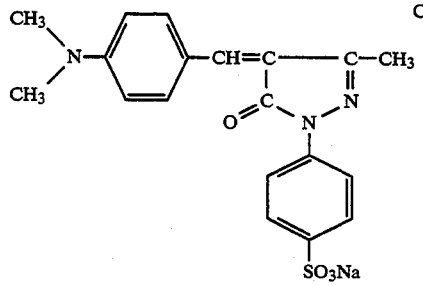

Next, on the support on its side opposite to the emulsion layer side, a backing layer with the following composition was provided in entirely the same manner as in Example 2 in Japanese Patent O.P.I. Publication No. 226143/1990.

| | |
|---|---|
| Gallic acid propyl ester | 300 mg/m² |
| Styrene-maleic acid copolymer | 100 mg/m² |
| Alkali-treated gelatin (isoelectric point: 4.9) | 1.0 mg/m² |
| Formalin | 10 mg/m² |

The coating solution was previously adjusted to pH 5.4 using citric acid and thereafter coated.

| Preparation of granulated developing chemicals: Formulation for 1 liter developing solution | |
|---|---|
| <Composition A> | |
| Hydroquinone | 15 g |
| Phenidone | 0.5 g |
| <Composition B> | |
| Potassium sulfite | 49.5 g |
| Potassium carbonate* | 66 g |
| Potassium hydrogencarbonate | 9 g |
| Potassium bromide | 4.5 g |
| EDTA.2Na | 1.025 g |
| 5-Methylbenzotriazole (VII-2)* | 0.16 g |
| 1-Phenyl-5-mercaptotetrazole | 0.02 g |
| 5-Nitroindazole (VI-I)* | 0.11 g |
| Cyclodextrin compound, or diethylene glycol (comparative compound) | as shown in Table 9A |

Inclusion products of the cyclodextrin compound with compounds VI-1 and VII-2 were prepared by dissolving 66 g of the asterisked(*) potassium carbonate in 100 ml of water, dissolving therein the cyclodextrin compound in the amount as shown in Table 9A, and thereafter adding the asterisked(*) compounds VI-1 and VII-2 in the amounts as shown in the above formulation, followed by homogenization at 5,000 rpm for 10 minutes and then spray drying.

The powdered chemicals of composition A were ground into fine powder of about 1 to 10 μm in particle diameter by means of a disintegrator and the fine powder was mixed using a mixer. The resulting material was granulated using water as a binder (binder content: 3% by weight) by means of an extrusion granulator to give granules of about 3 mm in particle diameter. Chemicals of composition B were disintegrated in the same manner as those of composition A, except for the components used in the preparation of the inclusion product. The inclusion product was added thereto and mixed, and the resulting material was granulated using water as a binder to give granules.

These developing chemicals were dissolved in an appropriate quantity of water to prepare a developing solution. Thereafter, the light-sensitive material described above was exposed to light by a conventional method and then processed using the developing solution on an automatic processor GR-27 (manufactured by Konica Corporation) under conditions set out below. Quality of halftone dots was evaluated according to a five-ranked system in which "5" denotes the best, "1" to "2" indicates "unusable", and "3" or more the level of practical use. Running stability was evaluated on exposed films of a size of 610 mm×508 mm which were processed by 100 sheets per day, by measuring photographic performances on the day the processing was started (the 1st day), the 7th day and the 14th day. Film stain was also evaluated, which was visually evaluated according to a five-ranked system in which "5" denotes the best, "1" to "2" indicates "unusable", and "3" or more the level of practical use.

| Steps | Processing conditions: Temperature (°C.) | Time (sec) |
|---|---|---|
| Developing | 28 | 30 |
| Fixing | 28 | 20 |
| Washing | 25 | 20 |

| | |
|---|---|
| <Composition A> | |
| Ammonium thiosulfate (aqueous 72.5% w/v solution) | 240 ml |
| Sodium sulfite | 17 g |
| Sodium acetate trihydrate | 6.5 g |
| Boric acid | 6 g |
| Sodium citrate dihydrate | 2 g |
| Acetic acid (aqueous 90% w/v solution) | 13.6 ml |
| <Composition> | |
| Pure water (ion-exchanged water) | 17 ml |
| Sulfuric acid (aqueous 50% w/v solution) | 4.7 g |
| Aluminum sulfate (aqueous 8.1% w/v solution as a content in terms of $Al_2O_3$) | 26.5 g |

When the fixing solution was used, the above compositions A and B were dissolved in this order in 500 ml of water, and the resulting solution was made up to 1 liter. This fixing solution had a pH of about 4.3.

Results obtained are shown in Tables 9A to 9C below.

TABLE 9A

| Sample No. | Diethylene glycol Amount (g/l) | Cyclodextrin compound Compound No. | Cyclodextrin compound Amount (g/l) |
|---|---|---|---|
| 9-1 | — | — | — |
| 9-2 | 50 | — | — |
| 9-3 | 100 | — | — |
| 9-4 | 150 | — | — |
| 9-5 | 0 | α-Cyclodextrin | 3 |
| 9-6 | " | " | 5 |
| 9-7 | " | " | 7 |

TABLE 9A-continued

| Sample No. | Diethylene glycol Amount (g/l) | Cyclodextrin compound Compound No. | Cyclodextrin compound Amount (g/l) |
|---|---|---|---|
| 9-8 | " | β-Cyclodextrin | 3 |
| 9-9 | " | " | 5 |
| 9-10 | " | " | 7 |
| 9-11 | " | γ-Cyclodextrin | 3 |
| 9-12 | " | " | 5 |
| 9-13 | " | D-4 | 5 |
| 9-14 | " | D-5 | 5 |
| 9-15 | " | D-6 | 5 |
| 9-16 | " | D-13 | 3 |
| 9-17 | " | " | 5 |
| 9-18 | " | D-14 | 3 |
| 9-19 | 0 | D-14 | 5 |
| 9-20 | " | D-15 | 3 |
| 9-21 | " | " | 5 |
| 9-22 | " | Isoelite | 3 |
| 9-23 | " | " | 5 |
| 9-24 | " | " | 7 |

TABLE 9B

| Sample No. | Sensitivity 1st day | Sensitivity 7th day | Sensitivity 14th day | Fog 1st day | Fog 7th day | Fog 14th day | Remarks |
|---|---|---|---|---|---|---|---|
| 9-1 | — | — | — | — | — | — | X |
| 9-2 | 100 | 95 | 90 | 0.03 | 0.04 | 0.05 | " |
| 9-3 | 101 | 94 | 91 | 0.03 | 0.04 | 0.06 | " |
| 9-4 | 100 | 94 | 89 | 0.03 | 0.04 | 0.05 | " |
| 9-5 | 102 | 103 | 102 | 0.02 | 0.02 | 0.02 | Y |
| 9-6 | 101 | 100 | 101 | 0.02 | 0.02 | 0.02 | " |
| 9-7 | 102 | 102 | 101 | 0.02 | 0.02 | 0.02 | " |
| 9-8 | 101 | 100 | 101 | 0.02 | 0.02 | 0.02 | " |
| 9-9 | 101 | 101 | 101 | 0.02 | 0.02 | 0.02 | " |
| 9-10 | 102 | 102 | 102 | 0.02 | 0.02 | 0.02 | " |
| 9-11 | 101 | 101 | 101 | 0.02 | 0.02 | 0.02 | " |
| 9-12 | 102 | 101 | 102 | 0.02 | 0.02 | 0.02 | " |
| 9-13 | 101 | 102 | 101 | 0.02 | 0.02 | 0.02 | " |
| 9-14 | 101 | 102 | 101 | 0.02 | 0.02 | 0.02 | " |
| 9-15 | 101 | 101 | 101 | 0.02 | 0.02 | 0.02 | " |
| 9-16 | 102 | 102 | 102 | 0.02 | 0.02 | 0.02 | " |
| 9-17 | 101 | 98 | 101 | 0.02 | 0.02 | 0.02 | " |
| 9-18 | 100 | 99 | 101 | 0.02 | 0.02 | 0.02 | " |
| 9-19 | 101 | 100 | 101 | 0.02 | 0.02 | 0.02 | Y |
| 9-20 | 101 | 101 | 100 | 0.02 | 0.02 | 0.02 | " |
| 9-21 | 102 | 102 | 102 | 0.02 | 0.02 | 0.02 | " |
| 9-22 | 101 | 101 | 101 | 0.02 | 0.02 | 0.02 | " |
| 9-23 | 100 | 101 | 101 | 0.02 | 0.02 | 0.02 | " |
| 9-24 | 101 | 100 | 101 | 0.02 | 0.02 | 0.02 | " |

X: Comparative Example
Y: Present Invention

TABLE 9C

| Sample No. | Halftone quality 1st day | Halftone quality 7th day | Halftone quality 14th day | Film stain 1st day | Film stain 7th day | Film stain 14th day | Remarks | |
|---|---|---|---|---|---|---|---|---|
| 9-1 | — | — | — | — | — | — | (1) | X |
| 9-2 | 3.5 | 3.25 | 3.0 | 4 | 3.25 | 3 | (2) | " |
| 9-3 | 3.5 | 3.25 | 3.0 | 4 | 3 | 2.75 | " | " |
| 9-4 | 3.5 | 3.25 | 3.0 | 4 | 3 | 2.75 | " | " |
| 9-5 | 5 | 5 | 5 | 4 | 4 | 4.5 | (3) | Y |
| 9-6 | 5 | 5 | 5 | 4 | 4 | 4.5 | " | " |
| 9-7 | 5 | 5 | 5 | 4 | 4 | 4.5 | " | " |
| 9-8 | 5 | 5 | 4.75 | 4 | 4 | 4.5 | " | " |
| 9-9 | 5 | 5 | 4.75 | 4 | 4 | 4.5 | " | " |
| 9-10 | 5 | 5 | 5 | 4 | 4 | 4.5 | " | " |
| 9-11 | 5 | 5 | 5 | 4 | 4 | 4.5 | " | " |
| 9-12 | 5 | 5 | 5 | 4 | 4 | 4.5 | " | " |
| 9-13 | 5 | 5 | 5 | 4 | 4 | 4.5 | " | " |
| 9-14 | 5 | 5 | 5 | 4 | 4 | 4.5 | " | " |
| 9-15 | 5 | 5 | 5 | 4 | 4 | 4.5 | " | " |
| 9-16 | 5 | 5 | 5 | 4 | 4 | 4.5 | " | " |
| 9-17 | 5 | 5 | 5 | 4.25 | 4.25 | 4.5 | " | " |
| 9-18 | 5 | 5 | 5 | 4.25 | 4.25 | 4.5 | " | " |
| 9-19 | 5 | 5 | 5 | 4 | 4 | 4.5 | (3) | Y |
| 9-20 | 5 | 5 | 5 | 4 | 4 | 4.5 | " | " |
| 9-21 | 5 | 5 | 5 | 4 | 4 | 4.5 | " | " |

TABLE 9C-continued

| Sample No. | Halftone quality 1st day | 7th day | 14th day | Film stain 1st day | 7th day | 14th day | Remarks | |
|---|---|---|---|---|---|---|---|---|
| 9-22 | 5 | 5 | 5 | 4 | 4 | 4.5 | " | " |
| 9-23 | 5 | 5 | 5 | 4 | 4 | 4.5 | " | " |
| 9-24 | 5 | 5 | 5 | 4 | 4 | 4.5 | " | " |

(1): Compound VI-1 did not dissolve.
(2): Compounds VI-1 and VII-2 were dissolved in diethylene glycol and thereafter added to the solution.
(3): Dissolved in water in 60 minutes.
X: Comparative Example
Y: Present Invention As is clear from Tables 9A to 9C, the present invention much better improves photographic performances than conventional liquid types.

EXAMPLE 10

Preparation of solid fixing chemicals:

Formulation for 1 liter fixing solution

| | |
|---|---|
| <Composition A> | |
| Ammonium thiosulfate | 135 g |
| Sodium sulfite | 5 g |
| <Composition B> | |
| Sodium oxalate | 5 g |
| Sodium acetate | 20 g |
| Sodium citrate | 2 g |
| Boric acid | 9 g |
| Aluminum sulfate | 15 g |
| Inclusion product of cyclodextrin compound with thioether compound | as shown in Table 10 |

The solid fixing chemicals were prepared in the same manner as in Example 7.

Fixing clearness was expected to be remarkably improved if the thioether compound having the ability of dissolving silver halides was made present in the processing solution in a stably dissolved state. Evaluation was also made on how the cyclodextrin compound was effective for dissolving the thioether compound in the fixing solution. As a method of evaluating the fixing clearness, the clearness was evaluated based on the time by which the fixing was completed after the film samples in Example 8 (unexposed films of 2 cm×7 cm) having been subjected to developing at 28° C. for 30 seconds were brought into a fixing solution kept at 28° C. As a method of evaluating deposit-free properties at low temperatures, the fixing solution was stored for 14 days in a refrigerated chamber kept at 2° C.

Results obtained are shown in Table 10.

TABLE 10

| Sample No. | Cyclodextrin inclusion product: Thioether compound No. | Amount (g) | Cyclodextrin compound No. | Amount (g/l) | Clearness (sec) | Low-temp. deposition | Remarks |
|---|---|---|---|---|---|---|---|
| 10-1 | — | — | — | — | 15 | None | X |
| 10-2 | S-1 | 2 | D-14 | 5 | 9 | " | Y |
| 10-3 | " | " | " | 8 | 8 | " | " |
| 10-4 | " | 5 | D-14 | 5 | 8 | " | " |
| 10-5 | " | " | " | 8 | 8 | " | " |
| 10-6 | S-5 | " | " | 8 | 8 | " | " |
| 10-7 | S-8 | " | Isoelite | 8 | 8 | " | " |
| 10-8 | S-9 | " | " | 8 | 8 | " | " |

As is evident from Table 10, the present invention has brought about a great improvement in the clearness. What is demonstrated in Example are only a few examples, even from which the inclusion of the slightly water-soluble organic compound into the cyclodextrin compound is seen to have brought about a remarkable increase in the degree of freedom in improvement of the performance of processing solutions.

EXAMPLE 11

Preparation of Emulsion B

A silver iodobromide emulsion (silver iodide: 2 mol % per mol of silver) was prepared by double jet precipitation. During the precipitation, $K_2IrCl_6$ was added in an amount of $8\times10^{-7}$ mol per mol of silver. The emulsion thus obtained was an emulsion comprised of cubic monodisperse grains having an average grain size of 0.20 μm (coefficient of variation of grain size distribution: 9%), followed by washing with water and desalting by conventional methods. The pAg after the desalting was 8.0 at 25° C. Subsequently, the following spectral sensitizers Z-1 and Z-2 were added in amounts of 200 mg and 10 mg, respectively, per mol of silver, and a mixture of the following compounds A, B and C was further added, followed by sulfur sensitization to give emulsion B.

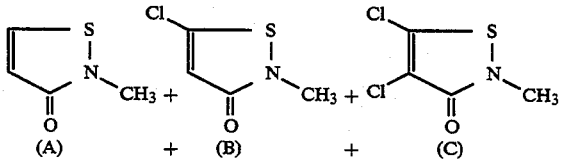

(A) + (B) + (C)

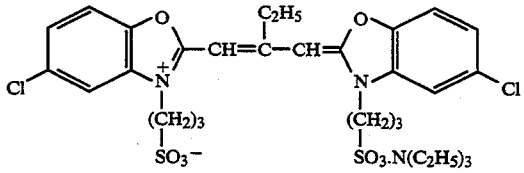

Spectral Sensitizer Z-1

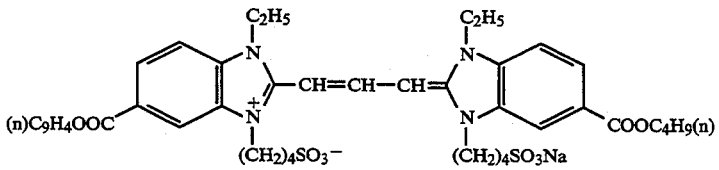

Spectral Sensitizer Z-2

On one side of a subbed polyethylene terephthalate support, a silver halide emulsion layer with the following formulation 1 was provided, and an emulsion protective layer with the following formulation 2 was further provided thereon. On the support on its side opposite to the emulsion layer side, a backing layer with the following formulation 3 was provided, and a backing protective layer with the following formulation 4 was further provided thereon. On the emulsion layer side and backing layer side, the respective protective layers were provided by simultaneous double-layer coating.

- Formulation 1 -
(Composition of light-sensitive silver halide emulsion layer)

| | |
|---|---|
| Gelatin | 2.0 g/m$^2$ |
| Silver halide emulsion B, silver weight | 3.2 g/m$^2$ |
| Stabilizer: 4-Methyl-6-hydroxy-1,3,3a,7-tetrazaindene | 30 mg/m$^2$ |
| Antifoggant: 1-Phenyl-5-mercaptotetrazole | 5 mg/m$^2$ |
| Surface active agent: Sodium dodecylbenzenesulfonate | 0.1 mg/m$^2$ |
| Surface active agent: Y-1 | 8 mg/m$^2$ |

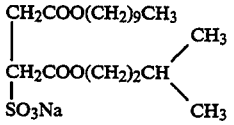

| | |
|---|---|
| Hydrazine derivative: H-29 or H-34 | $7 \times 10^{-5}$ mol/m$^2$ |
| Latex polymer: | 1 g/m$^2$ |

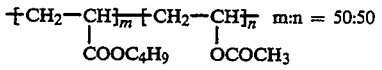

| | |
|---|---|
| Polyethylene glycol (molecular weight: 4,000) | 0.1 g/m$^2$ |
| Hardening agent: HA-1 | 60 mg/m$^2$ |

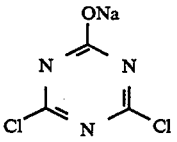

- Formulation 2 -
(Composition of emulsion protective layer)

| | |
|---|---|
| Gelatin | 0.9 g/m$^2$ |
| Surface active agent: Y-2 | 10 g/m$^2$ |

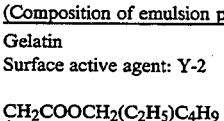

| | |
|---|---|
| Surface active agent: Y-3 | 10 mg/m$^2$ |

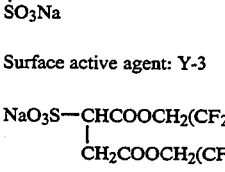

| | |
|---|---|
| Matting agent: Monodisperse silica with an average particle diameter of 3.5 μm | 3 mg/m$^2$ |
| Hardening agent: 1,3-Vinylsulfonyl-2-propanol | 40 mg/m$^2$ |

- Formulation 3 -
(Composition of backing layer)

(a) 30 mg/m$^2$

-continued

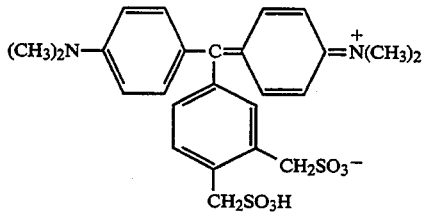

(b) 75 mg/m$^2$

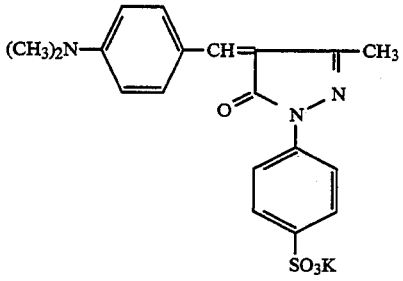

(c) 30 mg/m$^2$

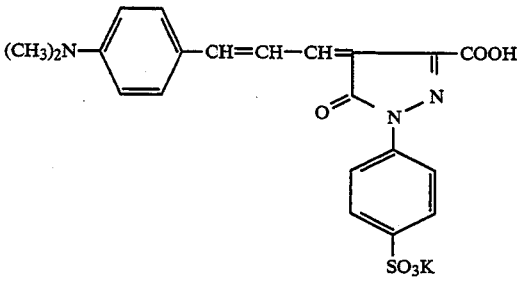

| | |
|---|---|
| Gelatin | 2.4 g/m$^2$ |
| Surface active agent: Sodium dodecylbenzenesulfonate | 0.1 g/m$^2$ |
| Surface active agent: Y-1 | 6 mg/m$^2$ |
| Colloidal silica | 100 mg/m$^2$ |
| Hardening agent: E | 55 mg/m$^2$ |

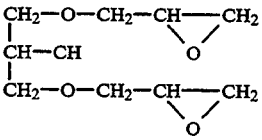

- Formulation 4 -
(Composition of backing protective layer)

| | |
|---|---|
| Gelatin | 1 g/m$^2$ |
| Matting agent: Monodisperse polymethyl methacrylate with an average particle diameter of 5.0 μm | 1 g/m$^2$ |
| Surface active agent: Y-2 | 10 mg/m$^2$ |
| Hardening agent: Glyoxal | 25 mg/m$^2$ |
| Hardening agent: HA-1 | 35 mg/m$^2$ |

The light-sensitive material thus obtained, with which a step wedge was then brought into close contact, was exposed for 5 seconds, and thereafter processed using a developing solution having the composition shown in the following formulation of developing chemicals.

| Preparation of granulated developing chemicals: - Formulation for 1 liter developing solution - | |
|---|---|
| < Composition A > | |
| Hydroquinone | 29 g |
| N-methyl-p-aminophenol sulfate | 350 mg |
| Disodium ethylenediaminetetraacetate | 1 g |
| < Composition B > | |
| Sodium bisulfite | 40 g |
| Sodium chloride | 5 g |
| Potassium bromide | 1.2 g |
| Trisodium phosphate | 75 g |
| 5-Methylbenzotriazole (VII-2)* | 250 mg |
| 2-Mercaptobenzothiazole | 23 mg |
| Benzotriazole (VII-1)* | 83 mg |
| Diisopropylaminoethanol | 2.3 ml |
| Amine compound: Am-1 (shown below) | 0.5 ml |
| Potassium hydroxide* in the amount for adjusting the pH of the solution used, to 11.6 | |
| Cyclodextrin compound* | as shown in Table 11A |
| Am-1: $H_2N—CH(CH_3)—CH_2—[OCH_2CH_2(CH_3)]_x—NH_2$ x = 2.6 (average) | |

Inclusion products of the cyclodextrin compound with compounds VII-1 and VII-2 were prepared by dissolving 10 g of the asterisked(*) potassium hydroxide in 50 ml of water, dissolving therein the cyclodextrin compound in the amount as shown in Table 11A, and thereafter dissolving the compounds VII-1 and VII-2, followed by homogenization at 5,000 rpm for 10 minutes and then spray drying.

The powdered chemicals of composition A were ground into fine powder of about 1 to 10 μm in particle diameter by means of a disintegrator and the fine powder was mixed using a mixer. The resulting material was granulated using water as a binder (binder content: 3% by weight) by means of an extrusion granulator to give granules of about 3 mm in particle diameter. Chemicals of composition B were disintegrated in the same manner as those of composition A, except for the components used in the preparation of the inclusion product. The inclusion product was added thereto and mixed, and the resulting material was granulated using a binder comprising water in which liquid components had been dissolved, to give granules.

Using the resulting granulated developing chemicals, processing and evaluation were made in the same manner as in Example 9. Formulation of the fixing solution and conditions for the processing were changed as follows:

| Formulation of fixing solution: | |
|---|---|
| Ammonium thiosulfate (aqueous 59.5% w/v solution) | 830 ml |
| Disodium ethdylenediaminetraacetate | 515 mg |
| Sodium sulfite | 63 g |
| Boric acid | 22.5 g |
| Acetic acid (aqueous 90% w/v solution) | 82 g |
| Ciric acid (aqueous 50% w/v solution) | 15.7 g |
| Gluconic acid (aqueous 50% w/v solution) | 8.55 g |
| Aluminum sulfate (aqueous 48% w/v solution) | 13 ml |
| Glutaldehyde | 3 g |
| Sulfuric acid in the amount for adjusting the pH of the solution used, to 4.6 | |
| When used, made up to 1 liter by adding water. | |

Processing conditions:

| Steps | Temperature | Time |
|---|---|---|
| Developing | 38° C. | 30 sec |
| Fixing | 38° C. | 20 sec |
| Washing | Room temp. | 15 sec |
| Drying | 40° C. | 15 sec |

Each processing time includes cross-over time taken for the next step.

Results obtained are shown in Tables 11A to 11C below.

TABLE 11A

| Sample No. | Compound of Formula H in light-sensitive material | Cyclodextrin compound: Compound No. | Cyclodextrin compound: Amount (g/l) |
|---|---|---|---|
| 11-1 | H-29 | — | — |
| 11-2 | " | α-Cyclodextrin | 3 |
| 11-3 | " | " | 5 |
| 11-4 | " | " | 7 |
| 11-5 | " | β-Cyclodextrin | 5 |
| 11-6 | " | γ-Cyclodextrin | 5 |
| 11-7 | " | D-5 | 3 |
| 11-8 | " | " | 5 |
| 11-9 | " | " | 7 |
| 11-10 | " | D-14 | 3 |
| 11-11 | " | " | 5 |
| 11-12 | " | " | 7 |
| 11-13 | " | Isoelite | 3 |
| 11-14 | " | " | 5 |
| 11-15 | " | " | 7 |
| 11-16 | H-34 | — | — |
| 11-17 | " | α-Cyclodextrin | 5 |
| 11-18 | " | " | 7 |
| 11-19 | " | D-5 | 5 |
| 11-20 | " | " | 7 |
| 11-21 | " | D-14 | 5 |
| 11-22 | " | " | 7 |
| 11-23 | " | Isoelite | 5 |
| 11-24 | " | " | 7 |

TABLE 11B

| Sample No. | Sensitivity 1st day | Sensitivity 7th day | Sensitivity 14th day | Fog 1st day | Fog 7th day | Fog 14th day | Remarks |
|---|---|---|---|---|---|---|---|
| 11-1 | 100 | 95 | 80 | 0.03 | 0.05 | 0.07 | X |
| 11-2 | 102 | 102 | 101 | 0.03 | 0.03 | 0.03 | Y |
| 11-3 | 104 | 104 | 104 | 0.03 | 0.03 | 0.03 | " |
| 11-4 | 105 | 105 | 105 | 0.03 | 0.03 | 0.03 | " |
| 11-5 | 103 | 103 | 103 | 0.03 | 0.03 | 0.03 | " |
| 11-6 | 104 | 104 | 104 | 0.03 | 0.03 | 0.03 | " |
| 11-7 | 105 | 105 | 106 | 0.03 | 0.03 | 0.03 | " |
| 11-8 | 105 | 105 | 105 | 0.02 | 0.02 | 0.02 | " |
| 11-9 | 105 | 105 | 105 | 0.02 | 0.02 | 0.02 | " |
| 11-10 | 106 | 106 | 106 | 0.03 | 0.03 | 0.02 | " |
| 11-11 | 105 | 106 | 106 | 0.02 | 0.02 | 0.02 | " |
| 11-12 | 106 | 105 | 106 | 0.02 | 0.02 | 0.02 | " |
| 11-13 | 102 | 101 | 103 | 0.03 | 0.03 | 0.03 | " |
| 11-14 | 102 | 102 | 102 | 0.03 | 0.03 | 0.03 | " |
| 11-15 | 102 | 102 | 102 | 0.03 | 0.03 | 0.03 | " |
| 11-16 | 98 | 80 | 72 | 0.03 | 0.06 | 0.08 | X |
| 11-17 | 104 | 104 | 103 | 0.03 | 0.03 | 0.03 | Y |
| 11-18 | 104 | 104 | 104 | 0.03 | 0.03 | 0.03 | " |
| 11-19 | 104 | 104 | 104 | 0.02 | 0.02 | 0.02 | " |
| 11-20 | 104 | 104 | 104 | 0.02 | 0.02 | 0.02 | " |
| 11-21 | 105 | 105 | 105 | 0.02 | 0.02 | 0.02 | " |
| 11-22 | 104 | 105 | 105 | 0.02 | 0.02 | 0.02 | " |
| 11-23 | 100 | 105 | 105 | 0.03 | 0.03 | 0.03 | " |
| 11-24 | 101 | 105 | 105 | 0.03 | 0.03 | 0.03 | " |

TABLE 11C

| Sample No. | Halftone quality 1st day | Halftone quality 7th day | Halftone quality 14th day | Film stain 1st day | Film stain 7th day | Film stain 14th day | Remarks |
|---|---|---|---|---|---|---|---|
| 11-1 | 3.5 | 3.0 | 2.5 | 4 | 3.5 | 3 | X |
| 11-2 | 4.5 | 4.5 | 4.5 | 4 | 4 | 4 | Y |
| 11-3 | 4.5 | 4.5 | 4.5 | 4.5 | 4.5 | 4.5 | " |
| 11-4 | 5 | 5 | 5 | 5 | 5 | 5 | " |

TABLE 11C-continued

| Sample No. | Halftone quality 1st day | 7th day | 14th day | Film stain 1st day | 7th day | 14th day | Remarks |
|---|---|---|---|---|---|---|---|
| 11-5 | 4.0 | 4.0 | 4.0 | 4.0 | 4.0 | 4.0 | " |
| 11-6 | 4.5 | 4.5 | 4.5 | 4.5 | 4.5 | 4.5 | " |
| 11-7 | 5 | 5 | 5 | 5 | 5 | 5 | " |
| 11-8 | 5 | 5 | 5 | 5 | 5 | 5 | " |
| 11-9 | 5 | 5 | 5 | 5 | 5 | 5 | " |
| 11-10 | 5 | 5 | 5 | 5 | 5 | 5 | " |
| 11-11 | 5 | 5 | 5 | 5 | 5 | 5 | " |
| 11-12 | 5 | 5 | 5 | 5 | 4.5 | 5 | " |
| 11-13 | 5 | 5 | 5 | 5 | 5 | 5 | " |
| 11-14 | 5 | 5 | 5 | 5 | 5 | 5 | " |
| 11-15 | 5 | 5 | 5 | 5 | 5 | 5 | " |
| 11-16 | 3 | 2.5 | 1.5 | 3.5 | 2 | 1.5 | X |
| 11-17 | 5 | 5 | 5 | 5 | 5 | 5 | Y |
| 11-18 | 5 | 5 | 5 | 5 | 5 | 5 | " |
| 11-19 | 5 | 5 | 5 | 5 | 5 | 5 | " |
| 11-20 | 5 | 5 | 5 | 5 | 5 | 5 | " |
| 11-21 | 5 | 5 | 5 | 5 | 5 | 5 | " |
| 11-22 | 5 | 5 | 5 | 5 | 5 | 5 | " |
| 11-23 | 5 | 5 | 5 | 5 | " | 5 | 5 |
| 11-24 | 5 | 5 | 5 | 5 | 5 | 5 | " |

As is evident from Tables 11A to 11C, like Example 9, incorporation of the cyclodextrin compound in the solid processing chemicals has brought about a remarkable improvement in photographic performances.

The present invention can bring about the following effects (1) to (7).

(1) The processing chemicals can decrease use of packaging materials and have a suitability to social environment.

(2) The processing chemicals have been made lightweight because of the solid form, promise reduction of transportation cost, and require no wide space for keeping them in photofinishing laboratories.

(3) They have been improved in storage stability of the processing solutions prepared from the solid processing chemicals, and can be free from occurrence of stain at development and scratches (cause by deposition of crystals) in light-sensitive materials having been processed.

(4) They can be free from flying up of fine powder of solid photographic processing chemicals, and have a suitability to work environment.

(5) The anti-laminating at tableting (lateral cracking of tablets) can be improved.

(6) The dissolving performance of solid processing chemicals can be improved.

(7) The improvement in dissolving performance, brought about by incorporation of the slightly water-soluble organic compound in the solid processing chemicals increases the degree of freedom of the conditions under which the slightly water-soluble organic compound is contained, thereby making it possible to improve processing performances and overall photographic performances obtained when used in combination with the light-sensitive material.

What is claimed is:

1. A solid composition for processing an exposed light-sensitive silver halide photographic material comprising a cyclodextrin compound and a developing agent.

2. The solid composition of claim 1 wherein the cyclodextrin compound is selected from the group consisting of cyclodextrin, a cyclodextrin derivative, a branched cyclodextrin and a cyclodextrin polymer.

3. The solid composition of claim 1 in a form of a tablet or granule.

4. The solid composition of claim 1 further comprising a compound represented by formula I

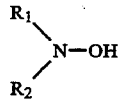

Formula I wherein $R_1$ and $R_2$ represent a substituted or unsubstituted alkyl group, a substituted or unsubstituted aryl group, $R_3$—C(=O)—, or a hydrogen atom, or may combine with each other to form a ring, provided that $R_1$ and $R_2$ are not hydrogen atoms at the same time, $R_3$ represents a substituted or unsubstituted alkoxy group, a substituted or unsubstituted alkyl group or a substituted or unsubstituted aryl group.

5. The solid composition of claim 2 further comprising a slightly water-soluble organic compound represented by Formulas VI, VII, VIII or S,

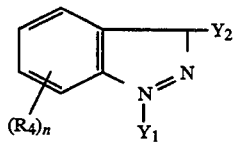

Formula VI

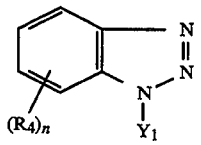

Formula VII

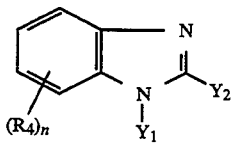

Formula VIII wherein $Y_1$ represents hydrogen, alkali metal, or mercapto; $R_4$ and $Y_2$ each are hydrogen, halogen, nitro, amino, cyano, hydroxyl, mercapto, sulfo, substituted or unsubstituted alkyl, substituted or unsubstituted alkenyl, substituted or unsubstituted alkynyl, substituted or unsubstituted alkoxy, hydroxycarbonyl, alkylcarbonyl, or alkoxycarbonyl; and n represents an integer of 1 to 4,

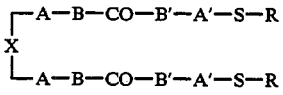

Formula S wherein A represents lower molecular weight alkylene having 1 to 3 carbon atoms, or polyalkylene ether which is represented by $-(CH_2CH_2O)_p-$, $-(CH_2CH_2O)_p-CH_2CH_2-$, or

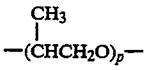

and does not combine with B through O, and A' represents lower alkylene having 1 to 3 carbon atoms, or polyalkylene ether represented by $-(CH_2CH_2)_p-(CH_2CH_2)-$ or

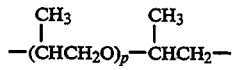

and does not combine with B through O; provided that A and A' are not polyalkylene ether at the same time; p represents an integer of 2 to 30, B and B' each represents —NH— or —O—, provided that B and B' are not —O— at the same time; R represents lower alkyl having 1 to 3 carbon atoms, phenyl, aralkyl, or $-(CH_2)_q-COOR'$, wherein q is an integer of 1 to 3; X represents a divalent group selected from —S—, —O—, $-CH_2-$,

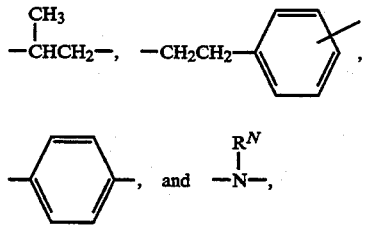

wherein R' and $R^N$ each represents a lower alkyl group having 1 to 3 carbon atoms.

6. The solid composition of claim 2 wherein the cyclodextrin is represented by Formulas II, III or IV, Formula II

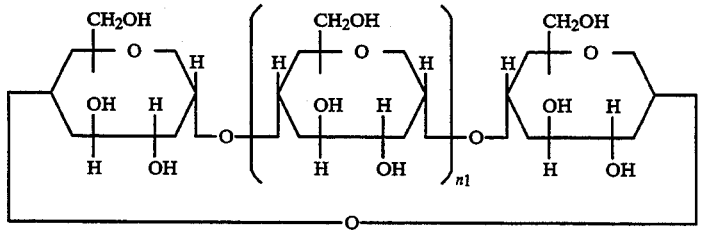

wherein $n_1$ represents a positive integer of 4 to 6,

Formula III

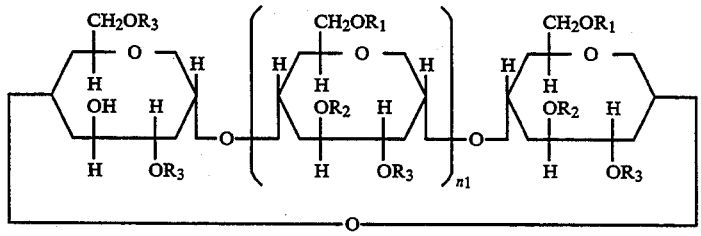

wherein $n_1$ represents a positive integer of 4 to 10, $R_1$ to $R_3$ may be the same or different and each represents a hydrogen atom, an alkyl group or a substituted alkyl group, Formula IV

CD—(O—R)

wherein R represents a hydrogen atom, $-R^2CO_2SO_3H$, $-R^2NH_2$, or $(R^3)_2N-$, where $R^2$ represents a straight-chain or branched alkylene group having 1 to 5 carbon atoms, CD represents cyclodextrin, and $R^3$ represents a straight-chain or branched alkyl group having 1 to 5 carbon atoms.

7. The solid composition of claim 2 wherein the cyclodextrin polymer is represented by Formula V, Formula V

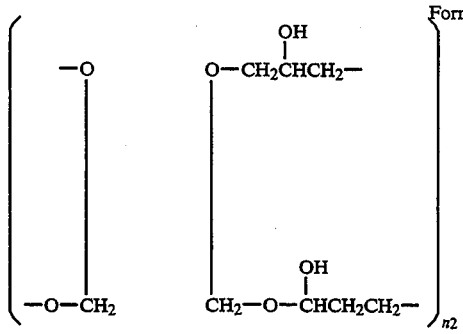

wherein $n_2$ is an integer of 3 or 4.

8. A processing composition for light-sensitive silver halide photographic material comprising a cyclodextrin linked with maltose or glucose, and a slightly water-soluble organic compound selected from the group consisting of Formulae VI, VII, VIII and S, Formula VI

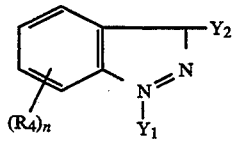

Formula VII

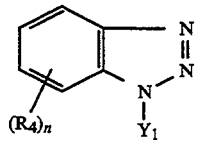

-continued

Formula VIII

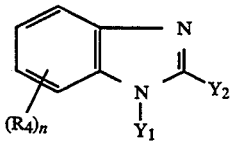

wherein $Y_1$ represents hydrogen, alkali metal, or mercapto; $R_4$ and $Y_2$ are each hydrogen, halogen, nitro, amino, cyano, hydroxyl, mercapto, sulfo, substituted or unsubstituted alkyl, substituted or unsubstituted alkenyl, substituted or unsubstituted alkynyl, substituted or unsubstituted alkoxy, hydroxycarbonyl, alkylcarbonyl, or alkoxycarbonyl; and n represents an integer of 1 to 4, Formula S

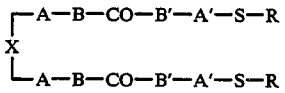

wherein A represents lower alkylene having 1 to 3 carbon atoms, or polyalkylene ether which is represented by $-(CH_2CH_2))_p$, $-(CH_2CH_2O)_p-CH_2CH_2-$ or

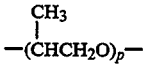

and does not combine with B through O, and A' represents lower alkylene having 1 to 3 carbon atoms, or polyalkylene ether represented by $-(CH_2CH_2O)_p-CH_2CH_2-$ or

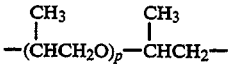

and does not combine with B through O; provided that A and A' are not polyalkylene ether at same time; p represents an integer of 2 to 30, B and B' represents —NH— or —O—, provided that B and B' are not —O— at the same time; R represents lower alkyl having 1 to 3 carbon atoms, phenyl, aralkyl, or $-(CH_2)_q-COOR'$, wherein q is an integer of 1 to 3 and R' represents an alkyl group having 1 to 3 to carbon atoms; X represents a divalent group selected from —S—, —O—, $-CH_2-$,

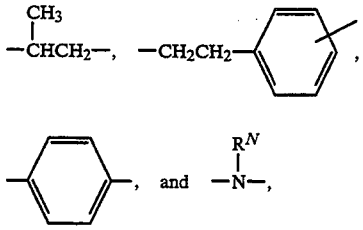

wherein $R^N$ represents lower alkyl having 1 to 3 carbon atoms.

* * * * *